US007239294B2

(12) United States Patent
Onozawa et al.

(10) Patent No.: US 7,239,294 B2
(45) Date of Patent: Jul. 3, 2007

(54) PLASMA DISPLAY DEVICE

(75) Inventors: Makoto Onozawa, Kawasaki (JP); Kunio Umehara, Kawasaki (JP); Shinsuke Tanaka, Kawasaki (JP); Hideaki Ohki, Yokohama (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 588 days.

(21) Appl. No.: 10/798,369

(22) Filed: Mar. 12, 2004

(65) Prior Publication Data

US 2004/0227700 A1 Nov. 18, 2004

(30) Foreign Application Priority Data

May 16, 2003 (JP) ..... 2003-138546

(51) Int. Cl.
*G09G 3/28* (2006.01)

(52) U.S. Cl. ..... 345/60; 345/66; 345/67; 345/68

(58) Field of Classification Search ..... 345/60–68; 315/169.1, 169.4
See application file for complete search history.

(56) References Cited

U.S. PATENT DOCUMENTS 6,344,841 B1 2/2002 Moon
6,373,452 B1 4/2002 Ishii et al.
2002/0044106 A1* 4/2002 Iseki ..... 345/60
2002/0047586 A1* 4/2002 Itoh et al. ..... 315/169.4
2002/0105278 A1* 8/2002 Kanazawa ..... 315/169.3
2003/0001801 A1* 1/2003 Setoguchi et al. ..... 345/60
2006/0050094 A1* 3/2006 Ishii et al. ..... 345/690

FOREIGN PATENT DOCUMENTS

EP 01065650 1/2001
KR 2000-0007601 2/2000
KR 2001-0004388 1/2001

OTHER PUBLICATIONS

European Search Report, mailed Dec. 1, 2006, and issued in corresponding European Patent Application No. 04251857.1-2205.

* cited by examiner

*Primary Examiner*—Richard Hjerpe
*Assistant Examiner*—Mansour M. Said
(74) *Attorney, Agent, or Firm*—Staas & Halsey LLP

(57) ABSTRACT

A plasma display device is provided which includes a plurality of X electrodes, a plurality of Y electrodes arranged adjacent to the plurality of X electrodes for causing sustain discharges between the plurality of X electrodes and the plurality of Y electrodes, an X electrode drive circuit for applying a sustain discharge voltage to the plurality of X electrodes, and a Y electrode drive circuit for applying a sustain discharge voltage to the plurality of Y electrodes. The X electrode drive circuit and the Y electrode drive circuit have a first sustain drive mode in which discharge pulses to predetermined adjacent electrodes rise or fall in the same direction at the same time and a second sustain drive mode in which discharge pulses to all adjacent electrodes rise or fall at different timings.

30 Claims, 36 Drawing Sheets

ADDRESS DRIVER
102
X SUSTAIN CIRCUIT 1
103a
X SUSTAIN CIRCUIT 2
103b
POWER SUPPLY CURRENT DETECTION CIRCUIT
118
POWER SUPPLY CIRCUIT
117
Vs
Is
Vs
X1
X2
X3
X4
X5
107
106
A1
A2
A3
Cij
Y1
Y2
Y3
Y4
105a
105b
SCAN DRIVER 1
SCAN DRIVER 2
Y SUSTAIN CIRCUIT 1
104a
Y SUSTAIN CIRCUIT 2
104b
101
CONTROL CIRCUIT SECTION
111
MICROCOMPUTER
HIGH IMAGE QUALITY MODE
114
HIGH LUMINANCE MODE
116
LOW POWER MODE
115
112
OPERATION ELEMENT
113

OF
Vs1
(Vs1+Vs2)/2
Vs2
CELL:A
CELL:B
CELL:C
CELL:D
Xn-1
Yn-1
Xn
Yn
Xn+1
Yn+1
Xn+2
Yn+2
DE1
DE2
DE3
DE4

EF
CELL:E
CELL:F
CELL:G

PLASMA DISPLAY DEVICE

CROSS-REFERENCE TO RELATED APPLICATIONS

This application is based upon and claims the benefit of priority from the prior Japanese Patent Application No. 2003-138546, filed on May 16, 2003, the entire contents of which are incorporated herein by reference.

BACKGROUND OF THE INVENTION

1. Field of the Invention

The present invention relates to a plasma display device.

2. Description of the Related Art

FIG. 34 is a diagram showing the basic configuration of a plasma display device. A control circuit section 1101 controls an address driver 1102, a sustain electrode (X electrode) sustain (sustain discharge) circuit 1103, a scan electrode (Y electrode) sustain circuit 1104, and a scan driver 1105.

The address driver 1102 supplies a predetermined voltage to address electrodes A1, A2, A3, . . . Hereafter, each of the address electrodes A1, A2, A3, . . . or their generic name is an address electrode Aj, j representing a suffix.

The scan driver 1105 supplies a predetermined voltage to scan electrodes Y1, Y2, Y3, . . . in accordance with control of the control circuit section 1101 and the scan electrode sustain circuit 1104. Hereafter, each of the scan electrodes Y1, Y2, Y3, . . . or their generic name is a scan electrode Yi, i representing a suffix.

The sustain electrode sustain circuit 1103 supplies the same voltage to sustain electrodes X1, X2, X3, . . . respectively. Hereafter, each of the sustain electrodes X1, X2, X3, . . . or their generic name is a sustain electrode Xi, i representing a suffix. The sustain electrodes Xi are connected to each other and have the same voltage level.

Within a display region 1107, the scan electrodes Yi and the sustain electrodes Xi form rows extending in parallel in the horizontal direction, and the address electrodes Aj form columns extending in the vertical direction. The scan electrodes Yi and the sustain electrodes Xi are alternately arranged in the vertical direction. Ribs 1106 have a stripe rib structure provided between the address electrodes Aj.

The scan electrodes Yi and the address electrodes Aj form a two-dimensional matrix with i rows and j columns. A display cell Cij is formed of an intersection of the scan electrode Yi and the address electrode Aj and the sustain electrode Xi correspondingly adjacent thereto. This display cell Cij corresponds to a pixel, so that the display region 1107 can display a two-dimensional image.

FIG. 35A is a view showing the configuration of a cross section of the display cell Cij in FIG. 34. The sustain electrode Xi and the scan electrode Yi are formed on a front glass substrate 1211. A dielectric layer 1212 for insulating the electrodes from a discharge space 1217 is applied thereover, and a MgO (magnesium oxide) protective film 1213 is further applied over the dielectric layer 1212.

On the other hand, the address electrode Aj is formed on a rear glass substrate 1214 which is disposed to oppose the front glass substrate 1211, a dielectric layer 1215 is applied thereover, and further phosphors are applied over the dielectric layer 1215. In the discharge space 1217 between the MgO protective film 1213 and the dielectric layer 1215, a Ne+Xe Penning gas or the like is sealed.

FIG. 35B is a view for explaining a capacitance Cp of an AC drive type plasma display. A capacitance Ca is a capacitance of the discharge space 1217 between the sustain electrode Xi and the scan electrode Yi. A capacitance Cb is a capacitance of the dielectric layer 1212 between the sustain electrode Xi and the scan electrode Yi. A capacitance Cc is a capacitance of the front glass substrate 1211 between the sustain electrode Xi and the scan electrode Yi. The sum of the capacitances Ca, Cb, and Cc determines the capacitance between the electrodes Xi and Yi.

FIG. 35C is a view for explaining light emission of the AC drive type plasma display. On an inner surface of a rib 1216, phosphors 1218 in red, blue and green are applied, arranged in stripes for each color, so that a discharge between the sustain electrode Xi and the scan electrode Yi excites the phosphors 1218 to generate light 1221.

FIG. 36 is a diagram of the configuration of one frame FR of an image. The image is formed of, for example, 60 frames per second. One frame FR is formed of a first subframe SF1, a second subframe SF2, . . . , and an nth subframe SFn. This n is, for example, 10, and corresponds to the number of grayscale bits. Each of the subframes SF1, SF2, and so on or their generic name is a subframe SF hereafter.

Each subframe SF is composed of a reset period Tr, an address period Ta, and a sustain period (sustain discharge period) Ts. During the rest period Tr, the display cell is initialized. During the address period Ta, lighting or non-lighting of each display cell can be selected by addressing. The selected cell emits light during the sustain period Ts. The number of light emissions (period of time) is different in each SF. This can determine a grayscale value.

FIG. 37 shows a driving method during the sustain period Ts of a progressive method plasma display. At time t1, an anode potential Vs1 is applied to the sustain electrodes Xn−1, Xn, and Xn+1, and a cathode potential Vs2 is applied to the scan electrodes Yn−1, Yn, and Yn+1. This applies a high voltage respectively between the sustain electrode Xn−1 and the scan electrode Yn−1, between the sustain electrode Xn and the scan electrode Yn, and between the sustain electrode Xn+1 and the scan electrode Yn+1 to perform sustain discharges 1410.

Subsequently, at time t2, the cathode potential Vs2 is applied to the sustain electrodes Xn−1, Xn, and Xn+1, and the anode potential Vs1 is applied to the scan electrodes Yn−1, Yn, and Yn+1. This applies a high voltage respectively between the sustain electrode Xn−1 and the scan electrode Yn−1, between the sustain electrode Xn and the scan electrode Yn, and between the sustain electrode Xn+1 and the scan electrode Yn+1 to perform sustain discharges 1410.

Subsequently, at time t3, the same potentials as those at time t1 are applied to perform sustain discharges 1410, and at time t4, the same potentials as those at time t2 are applied to perform sustain discharges 1410.

FIG. 38 shows a driving method during the sustain period Ts of a plasma display by an ALIS (Alternate Lighting of Surfaces) method. At time t1, the anode potential Vs1 is applied to the sustain electrodes Xn−1 and Xn+1 on odd-numbered rows, and the cathode potential Vs2 is applied to the scan electrodes Yn−1 and Yn+1 on odd-numbered rows. Further, the cathode potential Vs2 is applied to the sustain electrode Xn on an even-numbered row, and the anode potential Vs1 is applied to the scan electrode Yn on an even-numbered row. This applies a high voltage respectively between the sustain electrode Xn−1 and the scan electrode Yn−1, between the sustain electrode Xn and the scan electrode Yn, and between the sustain electrode Xn+1 and the scan electrode Yn+1 to perform sustain discharges 1510.

Subsequently, at time t2, the cathode potential Vs2 is applied to the sustain electrodes Xn−1 and Xn+1 on the odd-numbered rows, and the anode potential Vs1 is applied to the scan electrodes Yn−1 and Yn+1 on the odd-numbered rows. Further, the anode potential Vs1 is applied to the sustain electrode Xn on the even-numbered row, and the cathode potential Vs2 is applied to the scan electrode Yn on the even-numbered row. This applies a high voltage respectively between the sustain electrode Xn−1 and the scan electrode Yn−1, between the sustain electrode Xn and the scan electrode Yn, and between the sustain electrode Xn+1 and the scan electrode Yn+1 to perform sustain discharges 1510.

Subsequently, at time t3, the same potentials as those at time t1 are applied to perform sustain discharges 1510, and at time t4, the same potentials as those at time t2 are applied to perform sustain discharges 1510.

The above-described ALIS method is also described in the following patent document 1. Further, the following patent documents 2 and 3 are disclosed.

(Patent Document 1)

Japanese Patent No. 2801893 (U.S. Pat. No. 6,373,452)

(Patent Document 2)

Japanese Patent No. 3201603 (EP 01065650)

(Patent Document 3)

Japanese Patent Application Laid-open No. 2003-15585 (US 2003-0001801)

SUMMARY OF THE INVENTION

An object of the present invention is to provide a plasma display device having a high image quality display mode capable of performing a stable sustain discharge by reducing the influence of adjacent display cells, a low power display mode capable of performing a sustain discharge with a low power, and/or a high luminance display mode capable of performing a sustain discharge with high luminance.

According to one aspect of the present invention, a plasma display device is provided which includes a plurality of X electrodes, a plurality of Y electrodes arranged adjacent to the plurality of X electrodes for causing sustain discharges between the plurality of X electrodes and the plurality of Y electrodes, an X electrode drive circuit for applying a sustain discharge voltage to the plurality of X electrodes, and a Y electrode drive circuit for applying a sustain discharge voltage to the plurality of Y electrodes. The X electrode drive circuit and the Y electrode drive circuit have a first sustain drive mode in which discharge pulses to predetermined adjacent electrodes rise or fall in the same direction at the same time and a second sustain drive mode in which discharge pulses to all adjacent electrodes rise or fall at different timings.

In the second sustain drive mode, it is possible to prevent changes on the X electrode and the Y electrode for performing a sustain discharge from diffusing to adjacent electrodes, thus making it possible to eliminate an error display and perform a high image quality display. In the first sustain drive mode, the plasma display device can perform a low lower display when driven with the same number of discharge pulses as that in the second sustain drive mode, and can perform a high luminance display when driven with the same power consumption as that in the second sustain drive mode because the number of sustain discharge pulses increases.

DETAILED DESCRIPTION OF THE PREFERRED EMBODIMENTS

With an increase in definition of plasma displays, the distance between adjacent electrodes decreases. This results in shortened distances from the sustain electrode Xn and the scan electrode Yn constituting the discharge space to the scan electrode Yn−1 and the sustain electrode Xn+1 arranged adjacent thereto, respectively.

Therefore, when a discharge is caused between the sustain electrode Xn and the scan electrode Yn, electrons on the scan electrode Yn−1 or the sustain electrode Xn+1 are likely to diffuse (transfer) to cause an adjacent display cell constituted of the sustain electrode Xn−1 and the scan electrode Yn−1 or the sustain electrode Xn+1 and the scan electrode Yn+1 to perform error display such that the display cell lights up during time when the display cell should turn off, or the display cell turns off during time when the display cell should light up because the electrodes cannot sustain a discharge.

FIRST EMBODIMENT

Figure 1:
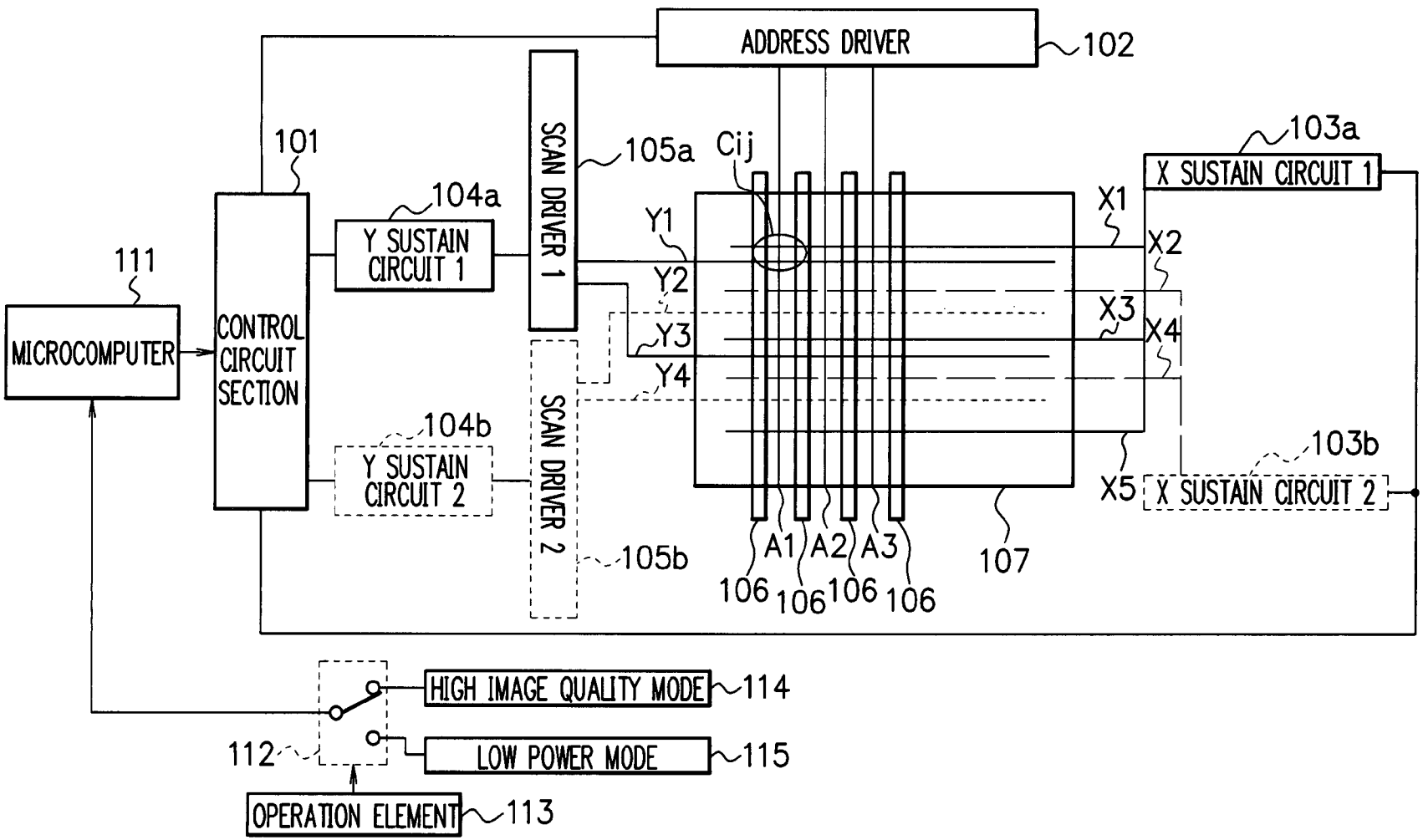
FIG. 1 is a diagram showing the configuration of a plasma display device according to a first embodiment of the present invention.

FIG. 1 is a diagram showing the configuration of a plasma display device according to a first embodiment of the present invention. A control circuit section 101 controls an address driver 102, sustain electrode (X electrode) sustain circuits 103*a* and 103*b*, scan electrode (Y electrode) sustain circuits 104*a* and 104*b*, and scan drivers 105*a* and 105*b*.

The address driver 102 supplies a predetermined voltage to address electrodes A1, A2, A3, . . . Hereafter, each of the address electrodes A1, A2, A3, . . . or their generic name is an address electrode Aj, j representing a suffix.

The first scan driver 105*a* supplies a predetermined voltage to scan electrodes (first discharge electrodes) Y1, Y3, . . . on odd-numbered rows in accordance with control of the control circuit section 101 and the first scan electrode sustain circuit 104*a*. The second scan driver 105*b* supplies a predetermined voltage to scan electrodes Y2, Y4, . . . on even-numbered rows in accordance with control of the control circuit section 101 and the second scan electrode sustain circuit 104*b*. Hereafter, each of the scan electrodes Y1, Y2, Y3, . . . or their generic name is a scan electrode Yi, i representing a suffix.

The first sustain electrode sustain circuit 103*a* supplies the same voltage to sustain electrodes (second discharge electrodes) X1, X3, . . . on odd-numbered rows, respectively. The second sustain electrode sustain circuit 103*b* supplies the same voltage to sustain electrodes X2, X4, . . . on even-numbered rows, respectively. Hereafter, each of the sustain electrodes X1, X2, X3, . . . or their generic name is a scan electrode Xi, i representing a suffix.

Within a display region 107, the scan electrodes Yi and the sustain electrodes Xi form rows extending in parallel in the horizontal direction, and the address electrodes Aj form columns extending in the vertical direction. The scan electrodes Yi and the sustain electrodes Xi are alternately and adjacently arranged in the vertical direction. Ribs 106 have a stripe rib structure provided between the address electrodes Aj.

Figure 35A:
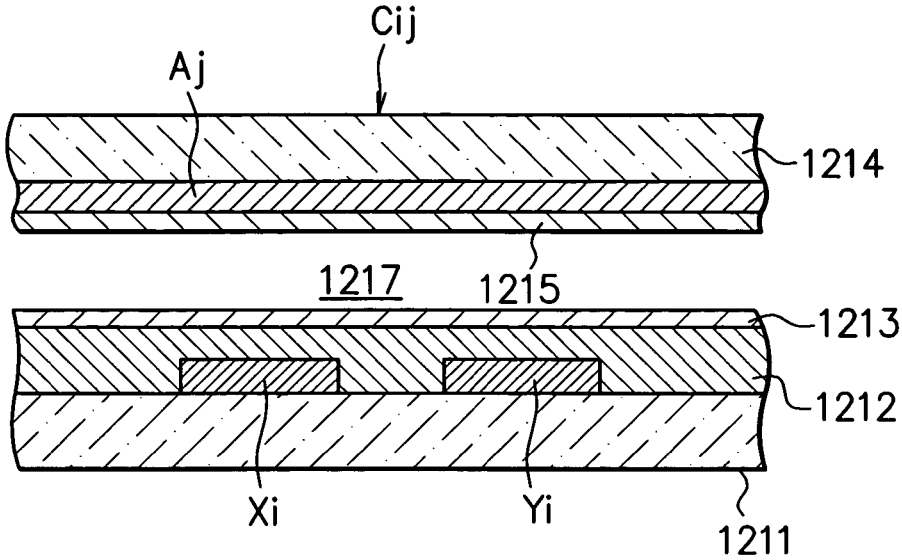
FIGS. 35A to 35C are cross-sectional views of a display cell of a plasma display.
Figure 35B:
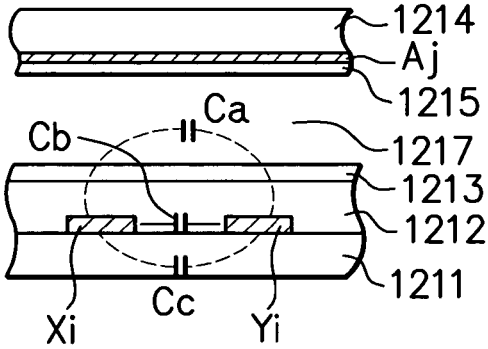
Figure 35C:
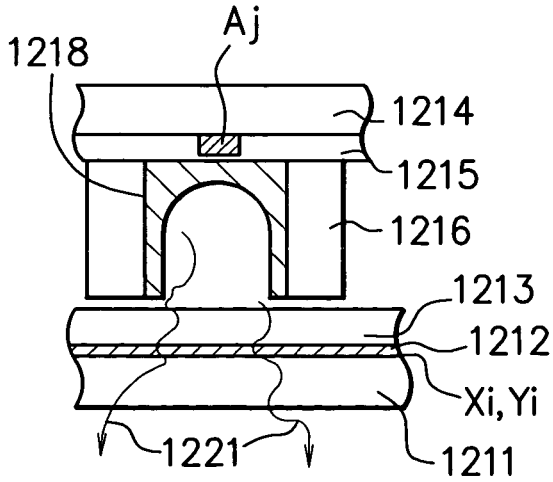

The scan electrodes Yi and the address electrodes Aj form a two-dimensional matrix with i rows and j columns. A display cell Cij is formed of an intersection of the scan electrode Yi and the address electrode Aj and the sustain electrode Xi correspondingly adjacent thereto. This display cell Cij corresponds to a pixel, so that the display region 107 can display a two-dimensional image. The configuration of the display cell Cij is the same as that in the above-described FIGS. 35A to 35C. Further, the frame of an image is the same as that in the description of the above-described FIG. 36.

In this plasma display device, a mode changeover switch 112 is provided which changes between a high image quality mode 114 and a low power mode 115. With the switch 112, a user can make a change between the two modes. The switch 112 may be composed of hardware such as a relay, semiconductor device, remote controller, or the like, or software such as a decision statement of a program or the like. The switch 112 may also be changed by an operation element 113. The result selected by the mode changeover switch 112 is sent to a microcomputer 111. The microcomputer 111 controls the control circuit section 101 based on the selection result.

Figure 2:
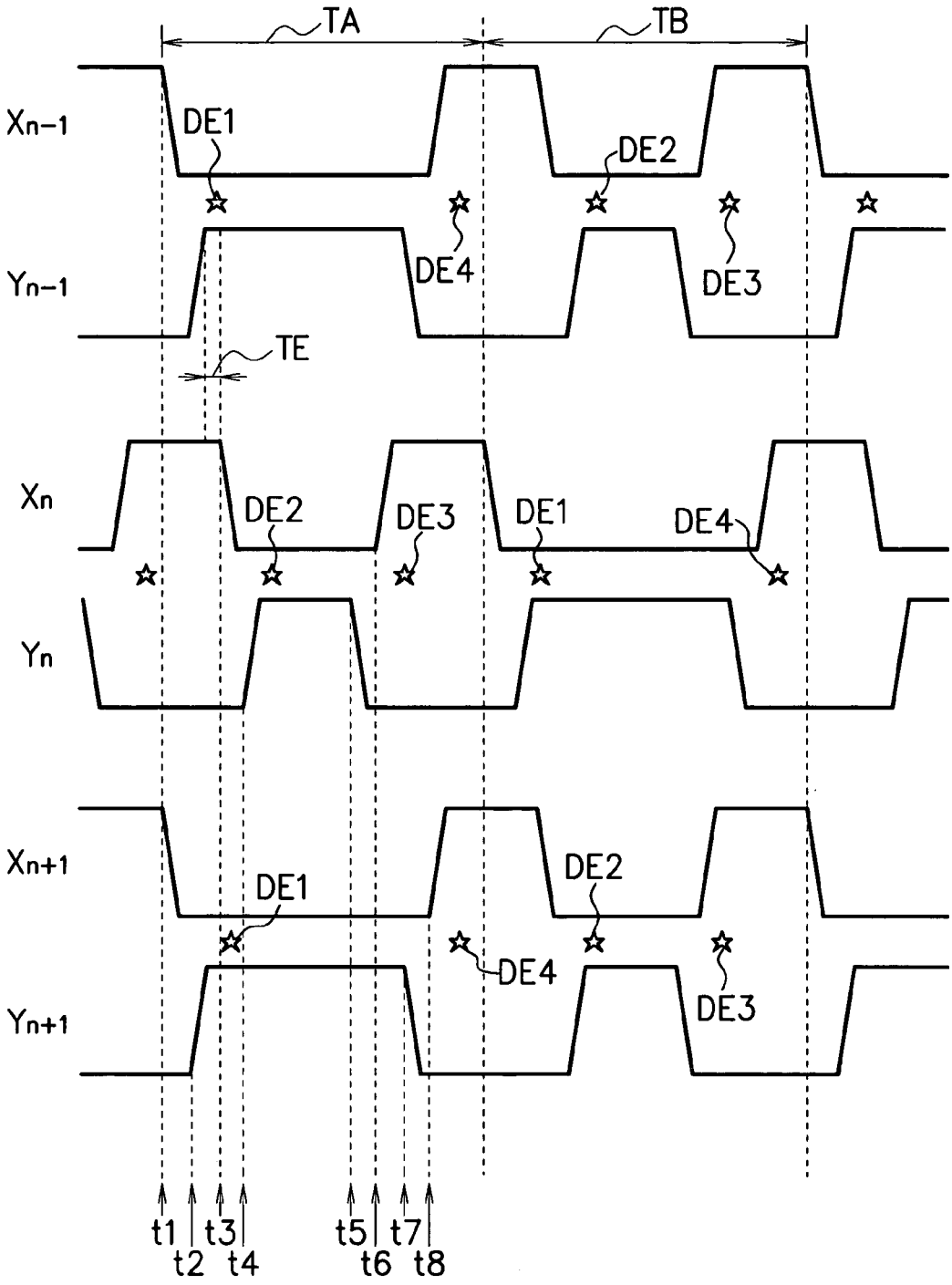
FIG. 2 is a timing chart showing sustain discharge pulses during a sustain period in a high image quality mode.

When the high image quality mode 114 is selected by the mode changeover switch 112, the sustain electrode sustain circuit 103*a*, the sustain electrode sustain circuit 103*b*, the scan electrode sustain circuit 104*a*, and the scan electrode sustain circuit 104*b* operate in the high image quality mode (second sustain drive mode) by the signal outputted from the control circuit section 101. In the high image quality mode, as shown in FIG. 2, sustain discharge pulses to all adjacent electrodes repeatedly rise or fall at different timings. The use of the high image quality mode can prevent charges on the sustain electrodes and scan electrodes that perform sustain discharges from diffusing to adjacent electrodes, so that high definition video can be displayed with high image quality with less noise and so on. The detailed description thereof will be made later with reference to FIG. 12. The details of the sustain discharge pulses in FIG. 2 will also be described later.

Figure 3:
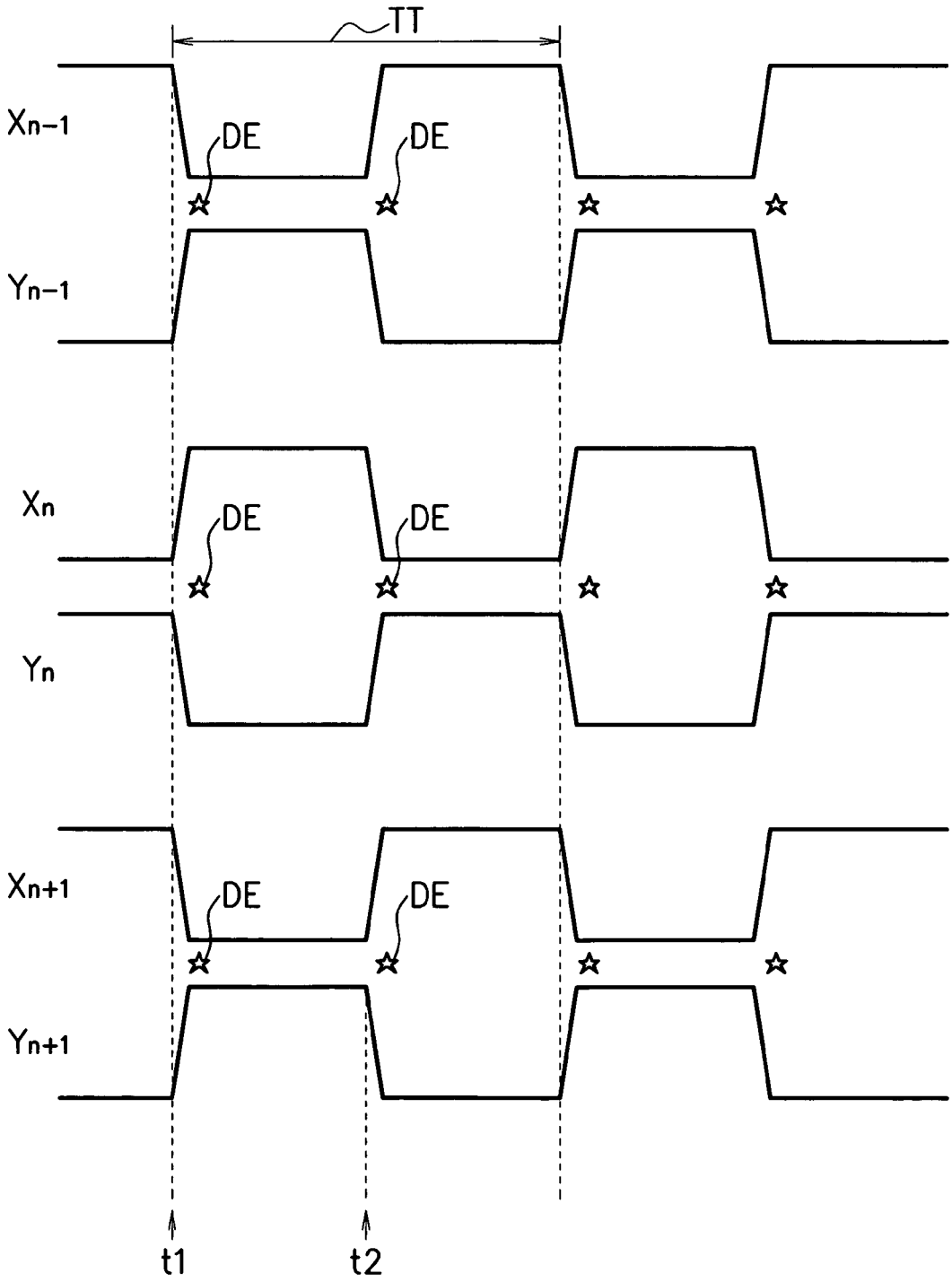
FIG. 3 is a timing chart showing sustain discharge pulses during a sustain period in a low power mode and a high luminance mode.

On the other hand, when the low power mode 115 is selected by the mode changeover switch 112, the sustain electrode sustain circuit 103*a*, the sustain electrode sustain circuit 103*b*, the scan electrode sustain circuit 104*a*, and the scan electrode sustain circuit 104*b* operate in the low power mode (first sustain drive mode) by the signal outputted from the control circuit section 101. In the low power mode, as shown in FIG. 3, sustain discharge pulses to predetermined adjacent electrodes rise or fall in the same direction at the same time. For example, sustain discharge pulses to a scan electrode Yn−1 and a sustain electrode Xn rise at the same time and then fall at the same time. When voltages change in the same direction at the same time between the adjacent electrodes as described above, the current flowing through the capacitance between the adjacent electrodes is little. Accordingly, the power loss that is caused by charge to/discharge from the capacitance between the adjacent electrodes is also little. The details of the sustain discharge pulses in FIG. 3 will also be described later.

In the high image quality mode, as shown in FIG. 2, the rising or falling timings of sustain discharge pulses are different between adjacent electrodes, thus increasing the amount of charges for charging/discharging the capacitance between the adjacent electrodes. This results in increases in power of the sustain electrode sustain circuits 103*a* and 103*b* and the scan electrode sustain circuits 104*a* and 104*b*, leading to high power consumption as compared to that in the low power mode. In contrast to this, in the low power mode, as shown in FIG. 3, sustain discharge pulses to, for example, the scan electrode Yn−1 and the sustain electrode Xn rise at the same time and then fall at the same time. In this case, since there is no potential difference between the adjacent electrodes, no current flows via the capacitance between the adjacent electrodes, so that the power consumption can be reduced.

The use of this embodiment allows a change to be made between the low power mode with low power consumption (first sustain drive mode) and the high image quality mode capable of high image quality display (second sustain drive mode) for use in accordance with the selection on the user side of the plasma display device.

It should be noted that in this embodiment, the numbers of sustain discharge pulses at the time of maximum load (white screen display) in both the first sustain drive mode (low power mode) and the second sustain drive mode (high image quality mode) are set to be equal.

FIG. 2 shows sustain discharge pulses during the sustain period Ts (FIG. 36) in the high image quality mode 114 in FIG. 1. One cycle of the sustain discharge pulse is composed of a period TA and a period TB, and this cycle is repeated.

The period TA will be described. First, at time t1, a cathode potential Vs2 is applied to the sustain electrodes Xn−1 and Xn+1 on odd-numbered rows, and the cathode potential Vs2 of the scan electrodes Yn−1 and Yn+1 on odd-numbered rows is sustained. Further, an anode potential Vs1 of the sustain electrode Xn on an even-numbered row is sustained, and the cathode potential Vs2 of the scan electrode Yn on an even-numbered row is sustained.

Subsequently, at time t2, the anode potential Vs1 is applied to the scan electrodes Yn−1 and Yn+1 on the odd-numbered rows. This applies a high voltage respectively between the sustain electrode Xn−1 and the scan electrode Yn−1 and between the sustain electrode Xn+1 and the scan electrode Yn+1 to perform sustain discharges DE1.

Subsequently, at time t3, the cathode potential Vs2 is applied to the sustain electrode Xn on an even-numbered row. Subsequently, at time t4, the anode potential Vs1 is applied to the scan electrode Yn on an even-numbered row. This applies a high voltage between the sustain electrode Xn and the scan electrode Yn to perform a sustain discharge DE2. A period TE here is a time period during which both the scan electrode Yn−1 on the odd-numbered row and the sustain electrode Xn on the even-numbered row are at the anode potential Vs1, and needs to be 500 ns or less.

Subsequently, at time t5, the cathode potential Vs2 is applied to the scan electrode Yn on the even-numbered row. Subsequently, at time t6, the anode potential Vs1 is applied to the sustain electrode Xn on the even-numbered row. This applies a high voltage between the sustain electrode Xn and the scan electrode Yn to perform a sustain discharge DE3.

Subsequently, at time t7, the cathode potential Vs2 is applied to the scan electrodes Yn−1 and Yn+1 on the odd-numbered rows. Subsequently, at time t8, the anode potential Vs1 is applied to the sustain electrodes Xn−1 and Xn+1 on the odd-numbered rows. This applies a high voltage respectively between the sustain electrode Xn−1 and the scan electrode Yn−1 and between the sustain electrode Xn+1 and the scan electrode Yn+1 to perform sustain discharges DE4.

During the period TB, the voltage waveforms at the sustain electrodes Xn−1 and Xn+1 on the odd-numbered rows and the voltage waveform at the sustain electrode Xn on the even-numbered row are exchanged, and the voltage waveforms at the scan electrodes Yn−1 and Yn+1 on the odd-numbered rows and the voltage waveform at the scan electrode Yn on the even-numbered row are exchanged, with respect to the period TA.

Figure 38:
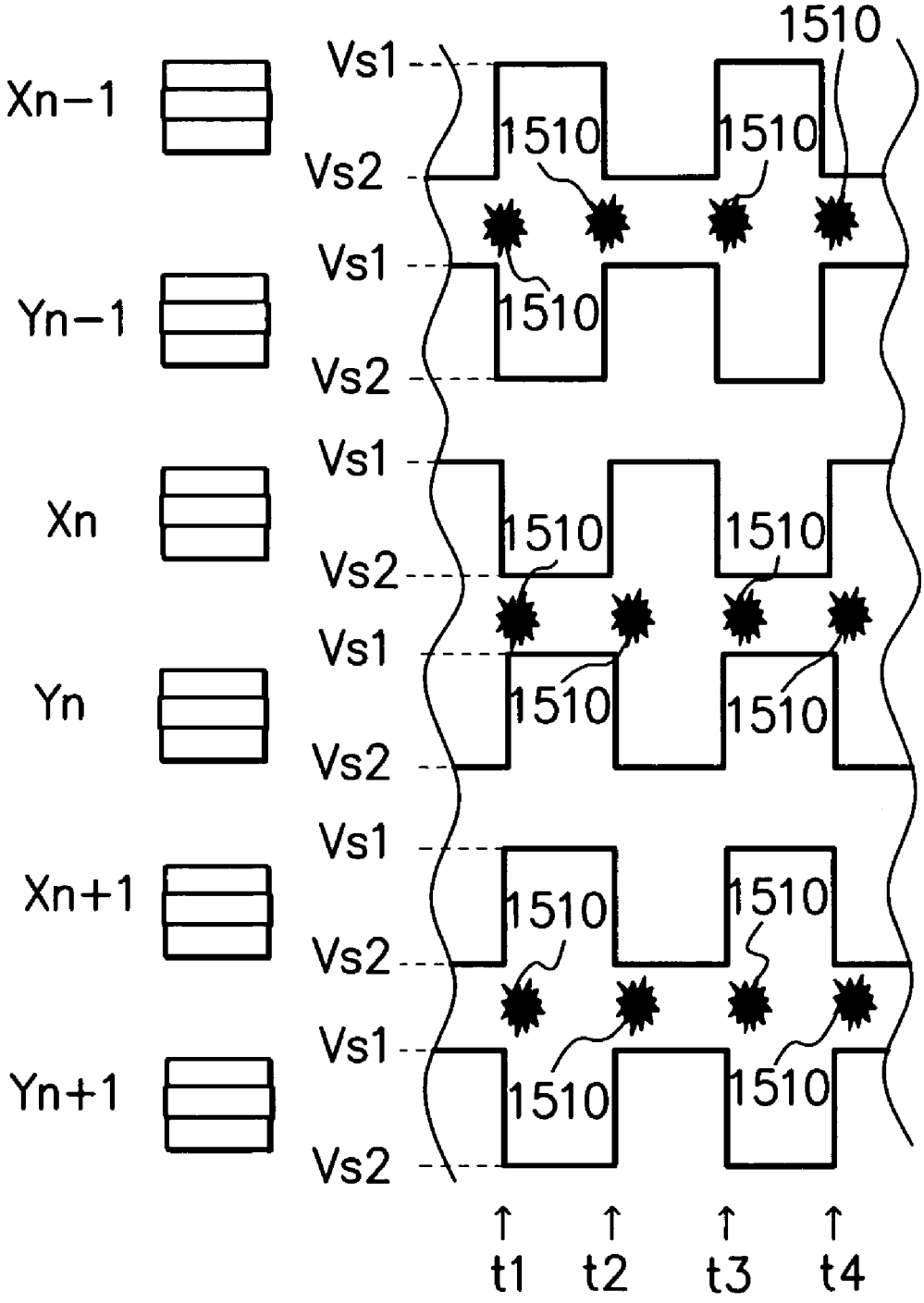
FIG. 38 is a diagram showing waveforms during a sustain period of an ALIS method plasma display.

FIG. 3 shows sustain discharge pulses during the sustain period Ts (FIG. 36) in the low power mode 115 in FIG. 1. The sustain discharge pulses are the same as those in the above-described FIG. 38. First, at time t1, the cathode potential Vs2 is applied to the sustain electrodes Xn−1 and Xn+1 on the odd-numbered rows, and the anode potential Vs1 is applied to the scan electrodes Yn−1 and Yn+1 on the odd-numbered rows. Further, the anode potential Vs1 is applied to the sustain electrode Xn on the even-numbered row, and the cathode potential Vs2 is applied to the scan electrode Yn on the even-numbered row. This applies a high voltage respectively between the sustain electrode Xn−1 and the scan electrode Yn−1, between the sustain electrode Xn and the scan electrode Yn, and between the sustain electrode Xn+1 and the scan electrode Yn+1 to perform sustain discharges DE.

Subsequently, at time t2, the anode potential Vs1 is applied to the sustain electrodes Xn−1 and Xn+1 on the odd-numbered rows, and the cathode potential Vs2 is applied to the scan electrodes Yn−1 and Yn+1 on the odd-numbered rows. Further, the cathode potential Vs2 is applied to the sustain electrode Xn on the even-numbered row, and the anode potential Vs1 is applied to the scan electrode Yn on the even-numbered row. This applies a high voltage respectively between the sustain electrode Xn−1 and the scan electrode Yn−1, between the sustain electrode Xn and the scan electrode Yn, and between the sustain electrode Xn+1 and the scan electrode Yn+1 to perform sustain discharges DE. The above operation, as one cycle TT, is repeated thereafter.

SECOND EMBODIMENT

Figure 4:
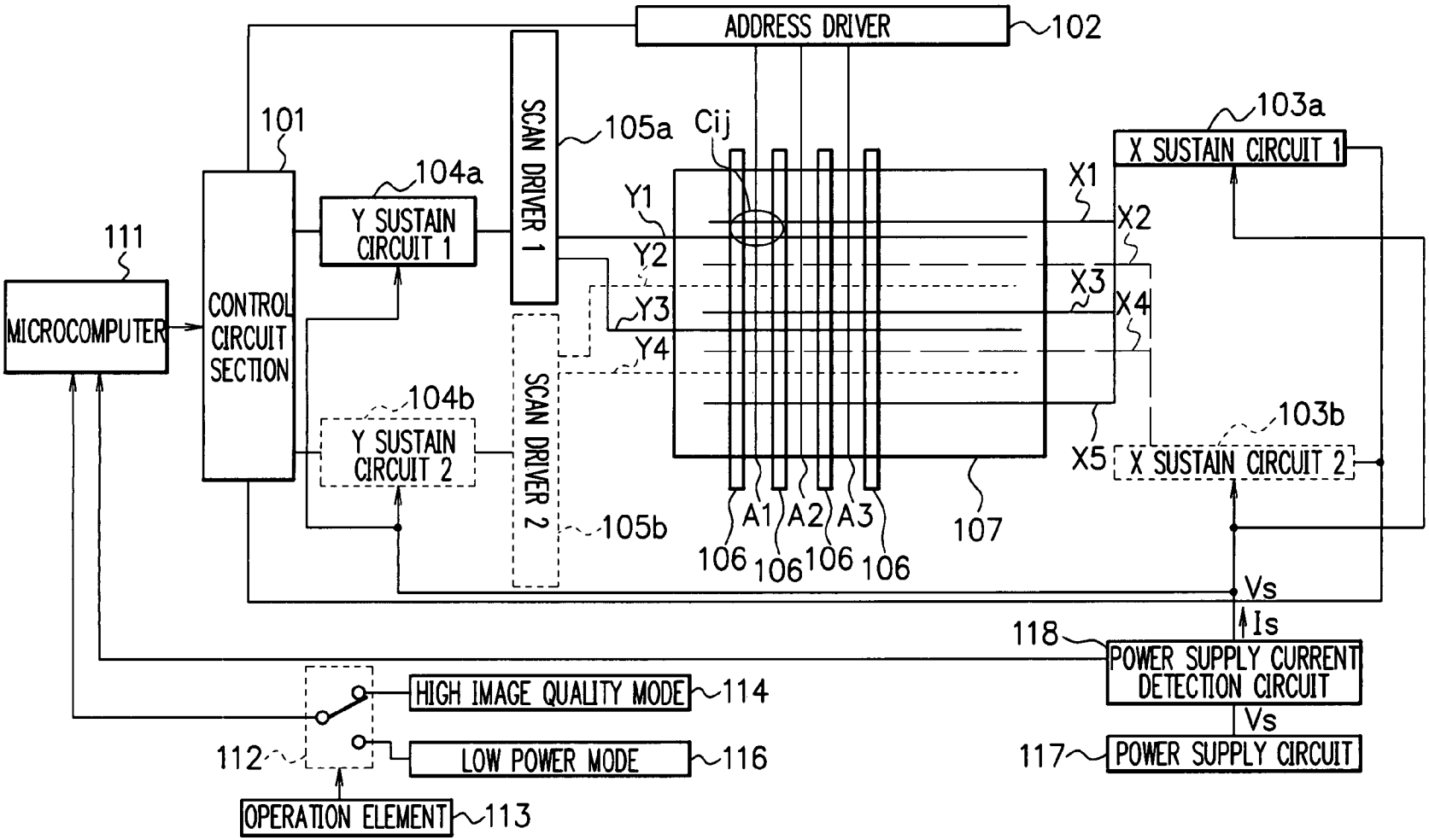
FIG. 4 is a diagram showing the configuration of a plasma display device according to a second embodiment of the present invention.

FIG. 4 is a diagram showing the configuration of a plasma display device according to a second embodiment of the present invention. This embodiment has basically the same configuration as that of the first embodiment (FIG. 1), and the description will be made on different points.

In this embodiment, a mode changeover switch 112 is provided which changes between a high image quality mode 114 and a high luminance mode 116. Further, a power supply circuit 117 supplies a sustain discharge voltage Vs via a power supply current detection circuit 118 to sustain electrode sustain circuits 103*a* and 103*b* and scan electrode sustain circuits 104*a* and 104*b*. The power supply current detection circuit 118 detects a power supply current Is to be supplied to the sustain electrode sustain circuits 103*a* and 103*b* and the scan electrode sustain circuits 104*a* and 104*b* and supplies the detection result to a microcomputer 111. The microcomputer 111 controls the number of sustain discharge pulses that is set by a control circuit section 101, based on the above power supply current Is so that the above power supply current Is becomes a predetermined value or less.

The mode changeover switch 112 allows a change to be made between the high image quality mode 114 and the high luminance mode 116 on a user side. For example, when the high image quality mode 114 is selected, the selection result is transmitted to the microcomputer 111, which controls the control circuit section 101 to make setting to generate the sustain discharge pulses in FIG. 2.

On the other hand, when the high luminance mode 116 is selected, the selection result is transmitted to the microcomputer 111, which controls the control circuit section 101 to make setting to generate the sustain discharge pulses in FIG. 3. As shown in FIG. 3, the operation waveforms in the high luminance mode 116, which are the same as the operation waveforms in the low power mode 115 shown in FIG. 1, repeat rising and falling at the same time at predetermined adjacent electrodes. In the high luminance mode 116, the operation waveforms repeat rising and falling at the same time at the adjacent scan electrode Yn−1 and sustain electrode Xn. As a result of this, the charge/discharge current flowing through the capacitance between the adjacent electrodes can be reduced. Consequently, the power consumption per the number of sustain discharge pulses can made low as compared to the high image quality mode shown in FIG. 2.

Since the number of sustain discharge pulses is controlled so that the power supply current Is becomes a predetermined value or less by the operations of the power supply current detection circuit 118 and the microcomputer 111, the number of sustain discharge pulses at the time of maximum current (at the time of maximum load such as the entire white display) can be made larger in the high luminance mode 116 with a low power consumption per the predetermined number of sustain discharge pulses than in the high image quality mode 114. Consequently, the luminance of an image at the time of maximum load such as the entire white display can be made higher in the high luminance mode 116 than in the high image quality mode 114.

The use of this embodiment allows a change to be made between the high luminance mode capable of high luminance display and the high image quality mode capable of high image quality display for use in accordance with a selection on the user side of the plasma display device. Consequently, a selection can be made between the high luminance mode and the high image quality mode in accordance with the ambient brightness, definition of an image to be displayed, or the like.

Figure 5:
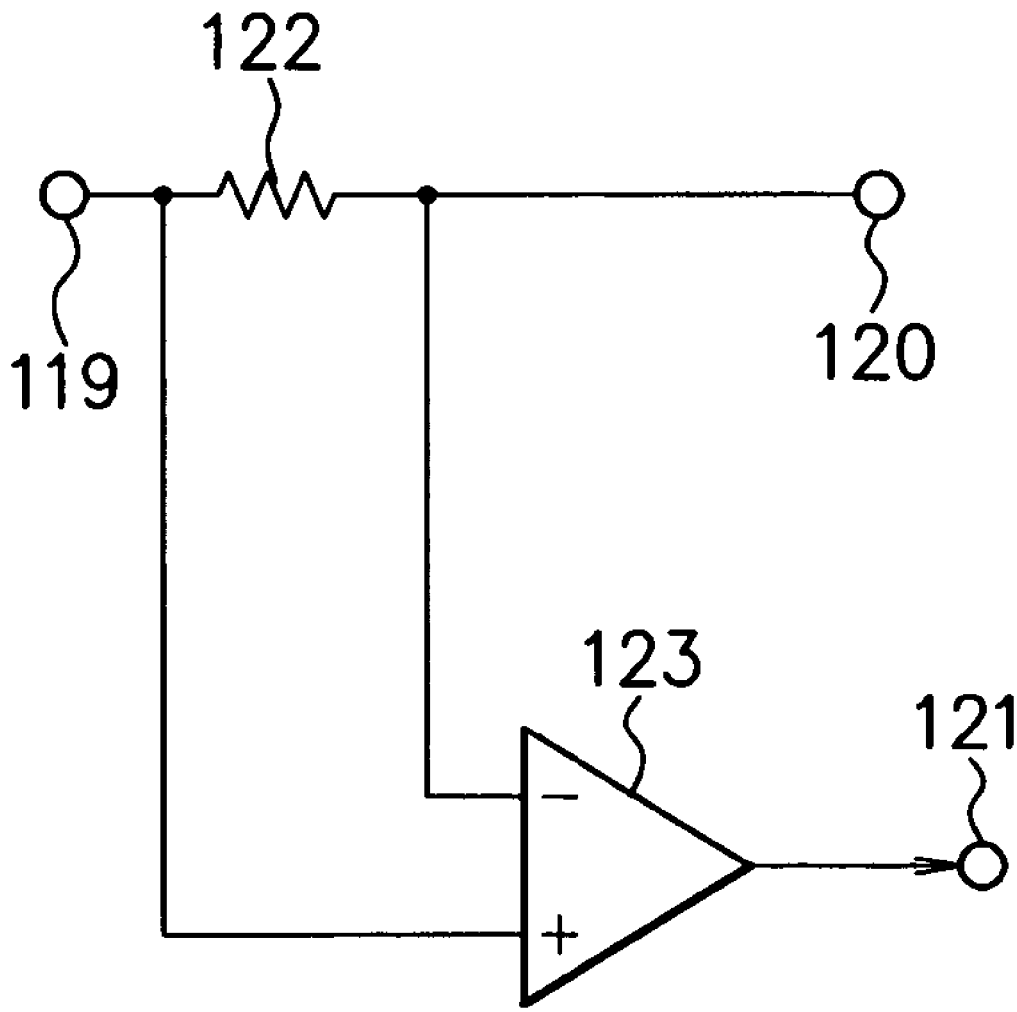
FIG. 5 is a diagram showing a configuration example of a power supply current detection circuit.

FIG. 5 shows a configuration example of the power supply current detection circuit 118 in FIG. 4. A terminal 119 is connected to the power supply circuit 117 in FIG. 4, and a terminal 120 is connected to the sustain circuits 103*a*, 103*b*, 104*a*, and 104*b* in FIG. 4. A resistor 122 is connected between the terminal 119 and the terminal 120 so that the power supply current Is flows therethrough. A differential circuit 123 has an inverting terminal connected to the terminal 120 and a non-inverting terminal connected to the terminal 119 and outputs a differential signal (a voltage corresponding to the power supply current Is) to the microcomputer 111 in FIG. 4 via a terminal 121. For example, the number of sustain discharge pulses is controlled so that an average power supply current Is per unit time becomes a predetermined value or less. Note that it is also adoptable to detect the power in place of the current to control the number of sustain discharge pulses.

Figure 6:
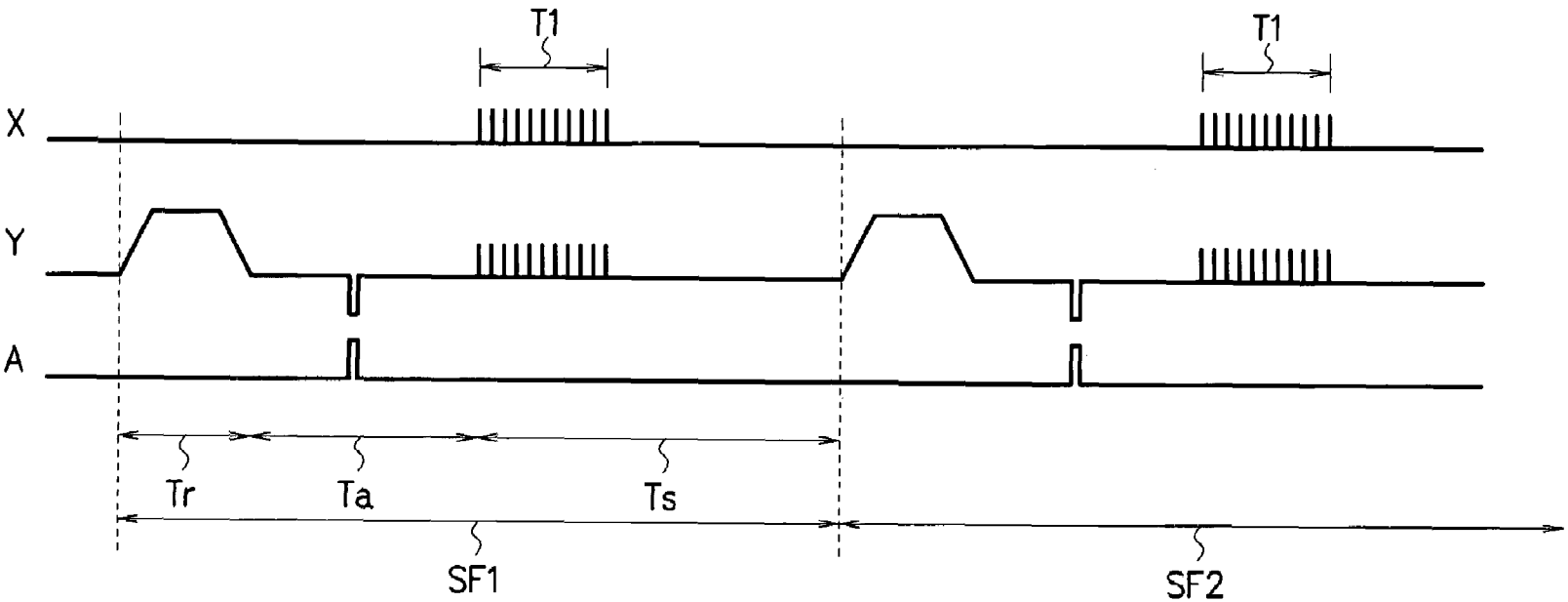
FIG. 6 is a timing chart showing voltage waveforms at a sustain electrode, a scan electrode, and an address electrode in the high image quality mode and the low power mode.

FIG. 6 shows voltage waveforms at a sustain electrode X, a scan electrode Y, and an address electrode A in the high image quality mode in FIG. 4. Corresponding to FIG. 36, subframes SF1 and SF2 are shown. Each subframe is composed of a reset period Tr, an address period Ta, and a sustain period (sustain discharge period) Ts. During the sustain period Ts, the sustain discharge pulses in the high image quality mode (FIG. 2) are generated in a period T1.

Figure 7:
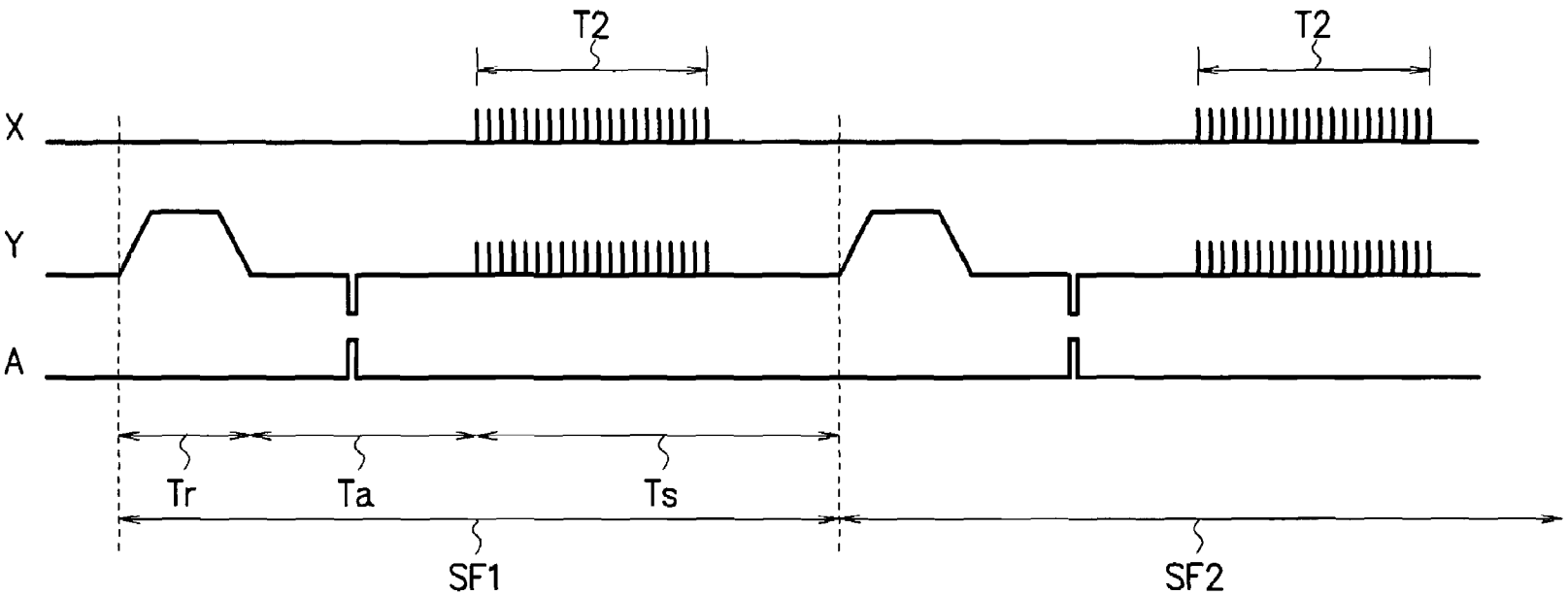
FIG. 7 is a timing chart showing voltage waveforms at the sustain electrode, the scan electrode, and the address electrode in the high luminance mode.

FIG. 7 shows voltage waveforms at the sustain electrode X, the scan electrode Y, and the address electrode A in the high luminance mode in FIG. 4. FIG. 7 is basically the same as FIG. 6, but during the sustain period Ts, the sustain discharge pulses in the high luminance mode (FIG. 3) are generated in a period T2. The sustain discharge pulse period T2 in the high luminance mode is longer than the sustain discharge pulse period T1 in the high image quality mode in FIG. 6. In other words, the number of sustain discharge pulses in the high luminance mode in FIG. 7 is larger than that in the high image quality mode in FIG. 6. It should be noted that the numbers of sustain discharge pulses are controlled so that the power consumptions in the high luminance mode and the high image quality mode are the same.

THIRD EMBODIMENT

Figure 8:
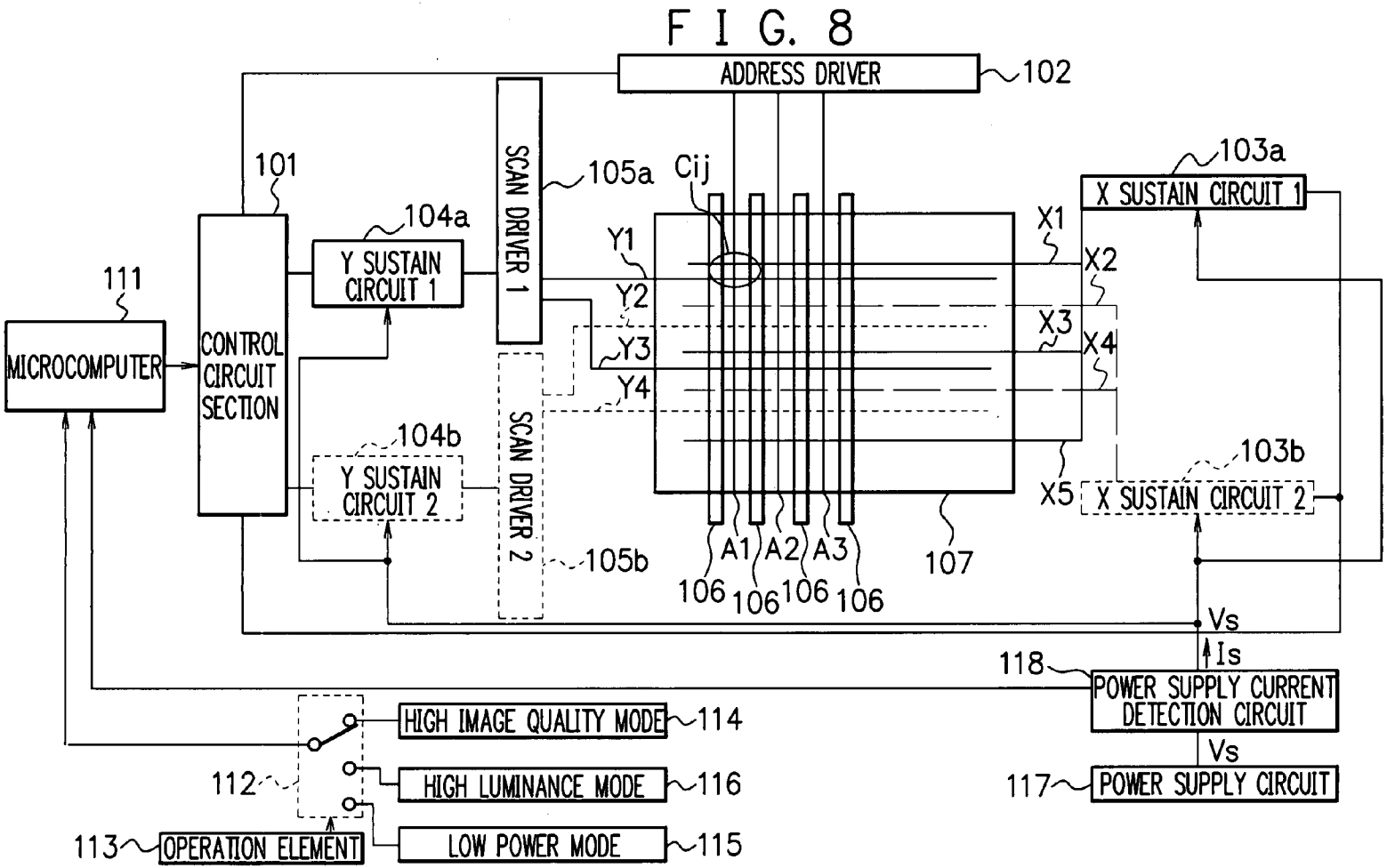
FIG. 8 is a diagram showing the configuration of a plasma display device according to a third embodiment of the present invention.

FIG. 8 is a diagram showing the configuration of a plasma display device according to a third embodiment of the present invention. This embodiment has basically the same configuration as that of the second embodiment (FIG. 4), and thus the description will be made on different points.

In this embodiment, a mode changeover switch 112 allows a change to be made among three modes, that is, a high image quality mode 114, a low power mode 115, and a high luminance mode 116 on a user side. The plasma display device is operated by the sustain discharge pulses shown in FIG. 2 in the high image quality mode 114 and operated by the sustain discharge pulses shown in FIG. 3 in the low power mode 115 and high luminance mode 116. In the low power mode 115, as shown in FIG. 6, the number of sustain discharge pulses T1 at the time of maximum load is set to be equal to that in the high image quality mode 114. Besides, in the high luminance mode 116, as shown in FIG. 7, the number of sustain discharge pulses T2 at the time of maximum load is set to be larger than the number of pulses T1 in the high image quality mode 114 under the condition where the power supply current Is becomes a predetermined value or less.

The use of this embodiment allows a selection of an appropriate mode in consideration of the ambient brightness, definition of an image to be displayed, or the like on the user side.

FOURTH EMBODIMENT

Figure 9:
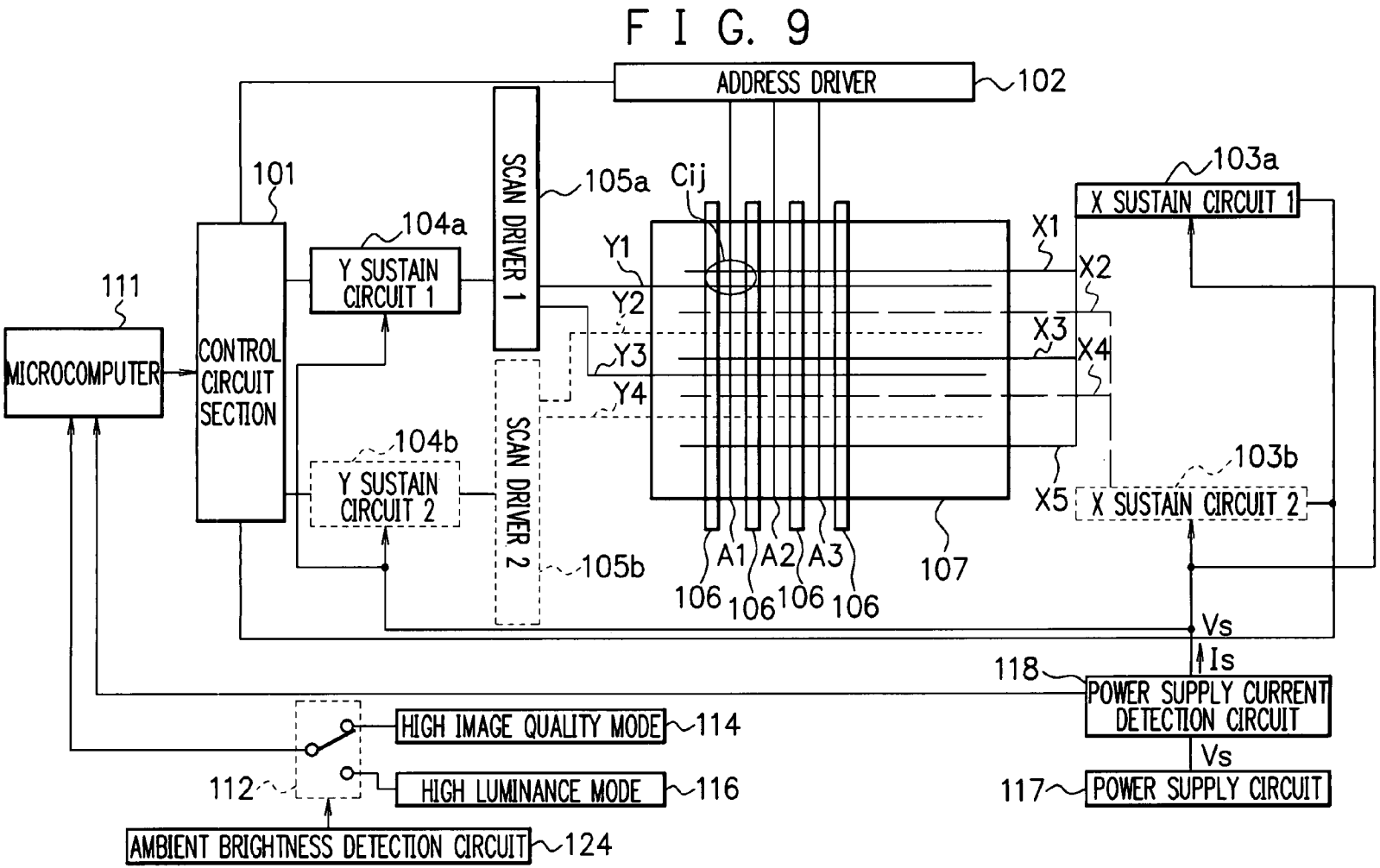
FIG. 9 is a diagram showing the configuration of a plasma display device according to a fourth embodiment of the present invention.

FIG. 9 is a diagram showing the configuration of a plasma display device according to a fourth embodiment of the present invention. This embodiment has basically the same configuration as that of the third embodiment (FIG. 8), and the description will be made on different points.

In this embodiment, a brightness detection circuit 124 for detecting the ambient brightness is provided to automatically change a mode changeover switch 112 in accordance with the ambient brightness. As a result of this, when the environment of the plasma display device is bright, a high luminance mode (first sustain drive mode) 116 is automatically selected, and when the environment of the plasma display device is dark, a high image quality mode (second sustain drive mode) 114 is automatically selected. Operations in the modes are the same as those in the third embodiment.

It should be noted that the detection result of the brightness detection circuit 124 for detecting the ambient brightness is supplied to the mode changeover switch 112 in this plasma display device, but may be supplied once to the microcomputer 111 for processing so that the microcomputer 111 may change the mode changeover switch 112. The brightness detection circuit 124 can be composed of, for example, a phototransistor.

The use of the plasma display device according to this embodiment allows an appropriate display mode (sustain drive mode) to be automatically selected in accordance with the ambient brightness.

FIFTH EMBODIMENT

Figure 10:
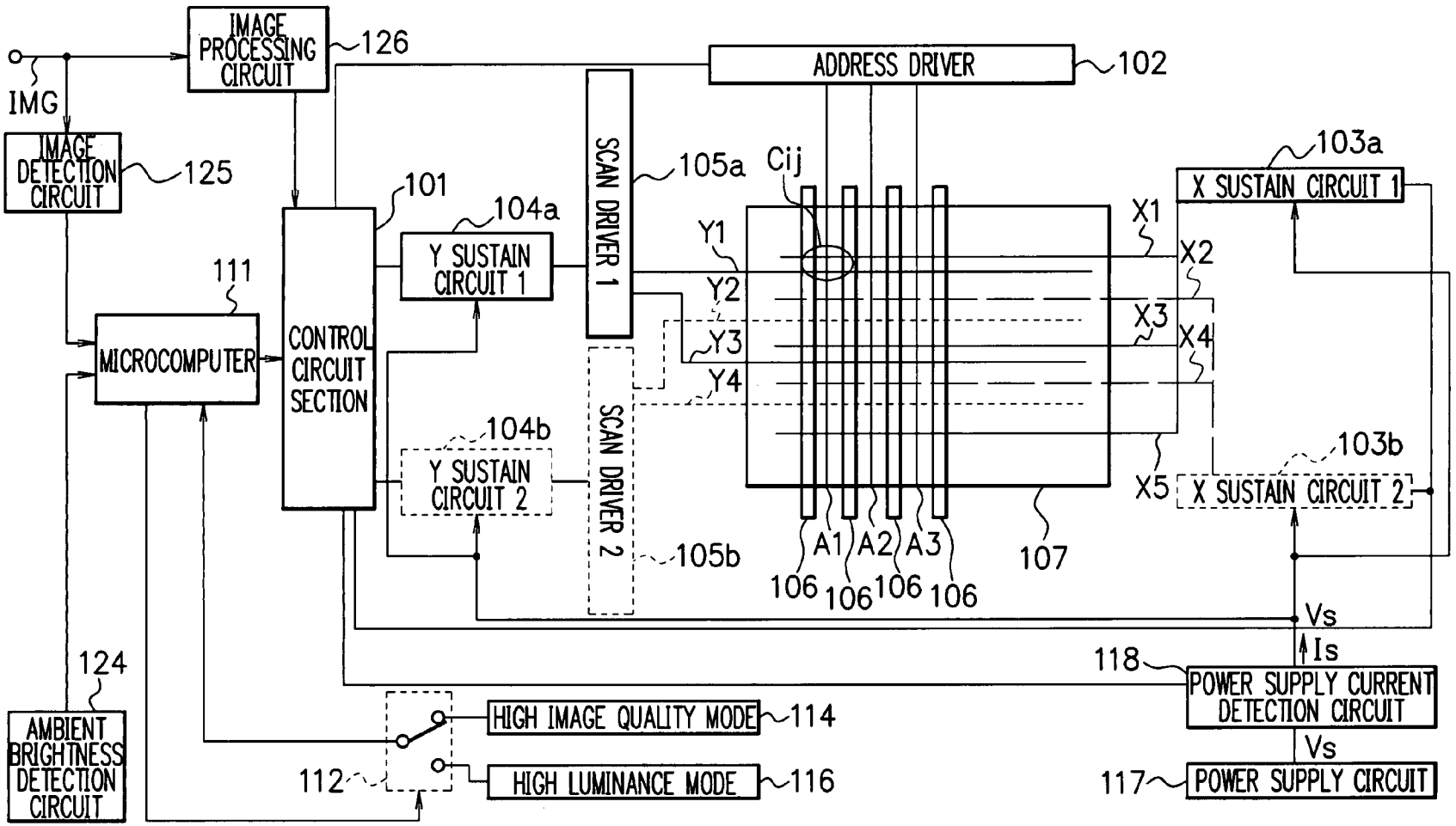
FIG. 10 is a diagram showing the configuration of a plasma display device according to a fifth embodiment of the present invention.

FIG. 10 is a diagram showing the configuration of a plasma display device according to a fifth embodiment of the present invention. This embodiment has basically the same configuration as that of the fourth embodiment (FIG. 9), and the description will be made on different points.

In the plasma display device of this embodiment, the detection result of a brightness detection circuit 124 for detecting the ambient brightness and the detection result of an image detection circuit 125 for detecting the frequency component, resolution, luminance level, and so on of a video based on an input video signal IMG are inputted into a microcomputer 111. The microcomputer 111 processes the above detection results and automatically changes between the high image quality mode (second sustain drive mode) 114 and the high luminance mode (first sustain drive mode) 116 in accordance with the ambient brightness, frequency component of a display image, resolution (definition), and brightness.

For example, the frequency component of a video is detected based on the input video signal IMG, so that when its high frequency component is at a predetermined value or more, the device is operated in the high image quality mode 114 because the video is fine, and when the high frequency component is at a value less than the predetermined value, the device is operated in the high luminance mode 116 because the video is rough.

Further, the resolution of a video is detected based on the input video signal IMG, so that for a low resolution, the device is operated in the high luminance mode 116, and for a high resolution, the device is operated in the high image quality mode 114. The detection of the resolution can be performed by, for example, counting the number of horizontal synchronization signals to detect the number of lines in one screen.

Further, the luminance level of a video is detected based on the input video signal IMG, so that for a high luminance level, the device is operated in the high luminance mode 116, and for a low luminance level, the device is operated in the high image quality mode 114.

As a result of this, the plasma display device of this embodiment can comprehensively judge the ambient brightness, frequency component of a display video, resolution, and luminance level and automatically select the high image quality mode (second sustain drive mode) 114 or the high luminance mode (first sustain drive mode) 116. Besides, the microcomputer 111 may change between the high image quality mode 114 and the high luminance mode 116 giving priority to either the output of the image detection circuit 125 or the output of the brightness detection circuit 124.

It should be noted that an image processing circuit 126 inputs the input video signal IMG thereinto, performs image processing such as color control, contrast control, and so on for the signal, and outputs the resulting signal to the control circuit section 101. The control circuit section 101 performs display processing based on the input video signal.

The control method of the above high image quality mode will be described in detail below.

SIXTH EMBODIMENT

Figure 11:
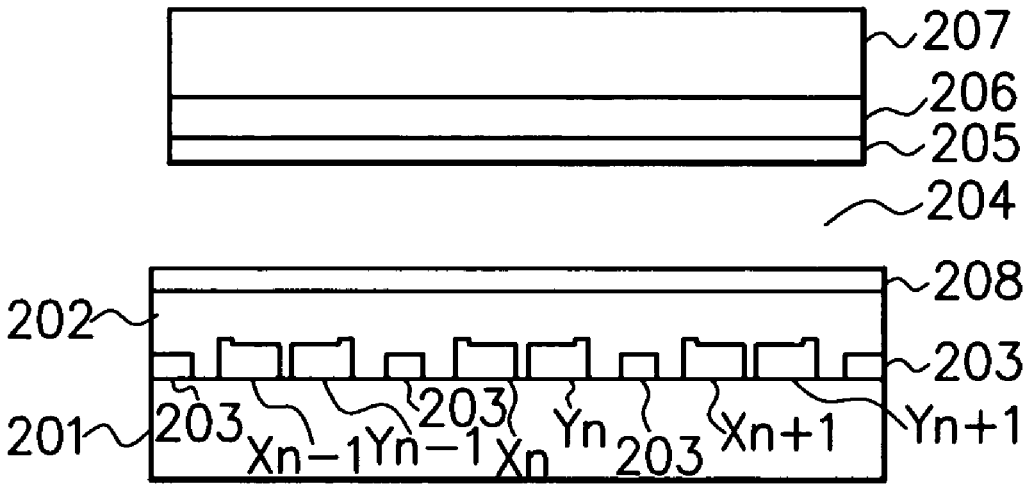
FIG. 11 is a cross-sectional view of a progressive method plasma display.

FIG. 11 is a cross-sectional view of a progressive method plasma display. On a glass substrate 201, a display cell of a sustain electrode Xn−1 and a scan electrode Yn−1, a display cell of a sustain electrode Xn and a scan electrode Yn, a display cell of a sustain electrode Xn+1 and a scan electrode Yn+1, and so on are formed. Between the display cells, light shields 203 are provided. A dielectric layer 202 is provided to cover the light shields 203 and the electrodes Xi and Yi. A protective film 208 is provided on the dielectric layer 202.

Under a glass substrate 207, an address electrode 206 and a dielectric layer 205 are provided. A discharge space 204 is provided between the protective film 208 and the dielectric layer 205 and has a Ne+Xe Penning gas or the like sealed therein. Discharged light in the display cell is reflected by the phosphor 1218 (FIG. 35C) and passes through the glass substrate 201 for display.

In the progressive method, the interval between the electrodes Xn−1 and Yn−1, the interval between the electrodes Xn and Yn, and the interval between the electrodes Xn+1 and Yn+1, being the respective pairs of electrodes constituting the display cells, are small, so that discharges can be performed. Besides, the interval between the electrodes Yn−1 and Xn and the interval between the electrodes Yn and Xn+1, the intervals existing between different display cells, are large, so that discharge is not performed. In other words, each electrode can perform a sustain discharge only with the adjacent electrode on one side thereof.

Figure 36:
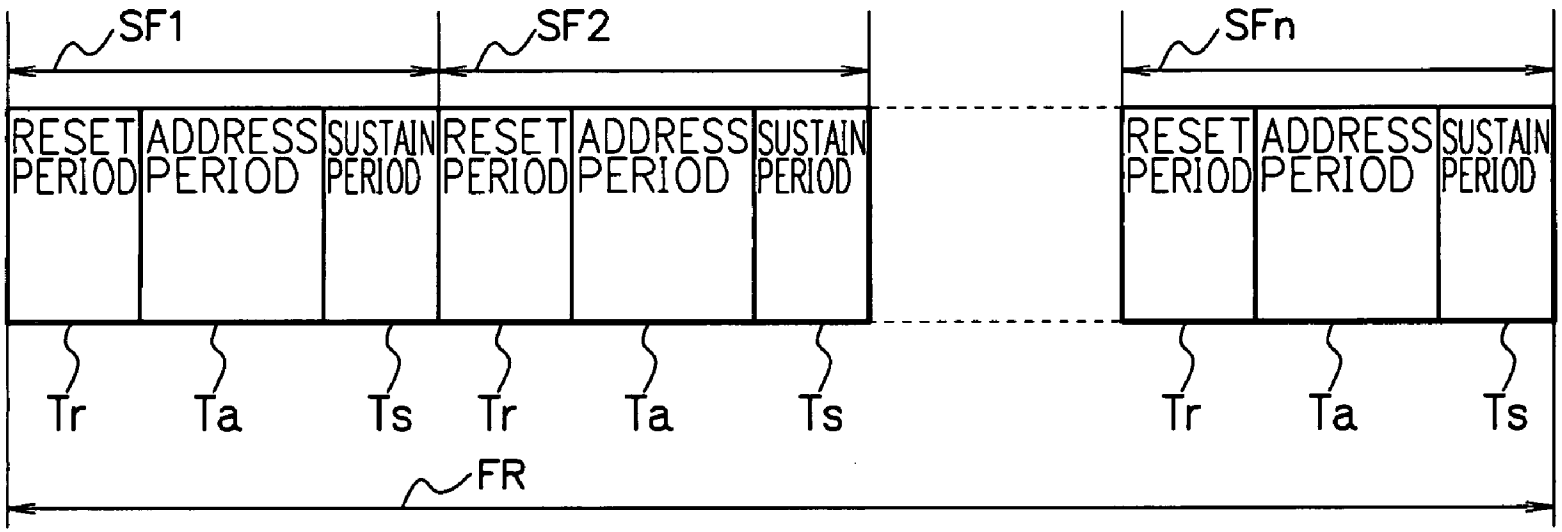
FIG. 36 is a diagram of the configuration of a frame of an image.
Figure 37:
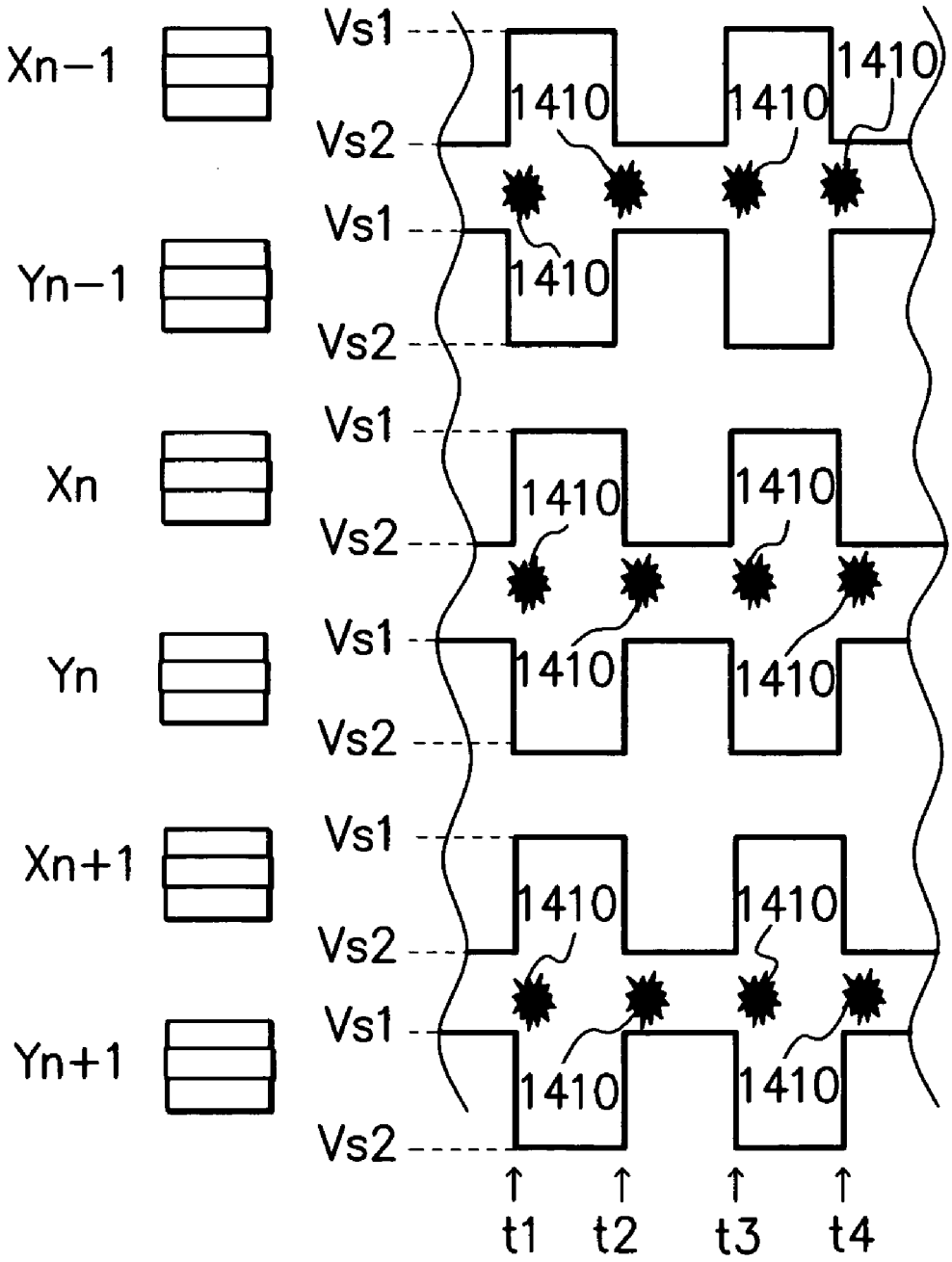
FIG. 37 is a diagram showing waveforms during a sustain period of a progressive method plasma display.

The frame of an image displayed by the plasma display is the same as that in the aforementioned FIG. 36. In FIG. 36, first, during the reset period Tr, a predetermined voltage is applied between the scan electrodes Yi and the sustain electrodes Xi to perform a total write and a total erase of charges, thereby erasing previous display contents and forming predetermined wall charges.

Then, during the address period Ta, a pulse at a positive potential (lighting selection voltage) is applied to the address electrode Aj and a pulse at a cathode potential Vs2 is applied to a desired scan electrode Yi by a sequential scan. These pulses cause an address discharge between the address electrode Aj and the scan electrode Yi to address a display cell (select for lighting).

Subsequently, during the sustain period (sustain discharge period) Ts, a predetermined voltage is applied between the sustain electrodes Xi and the scan electrodes Yi to perform a sustain discharge between the sustain electrode Xi and the scan electrode Yi which correspond to the display cell addressed during the address period Ta for light emission.

Figure 12:
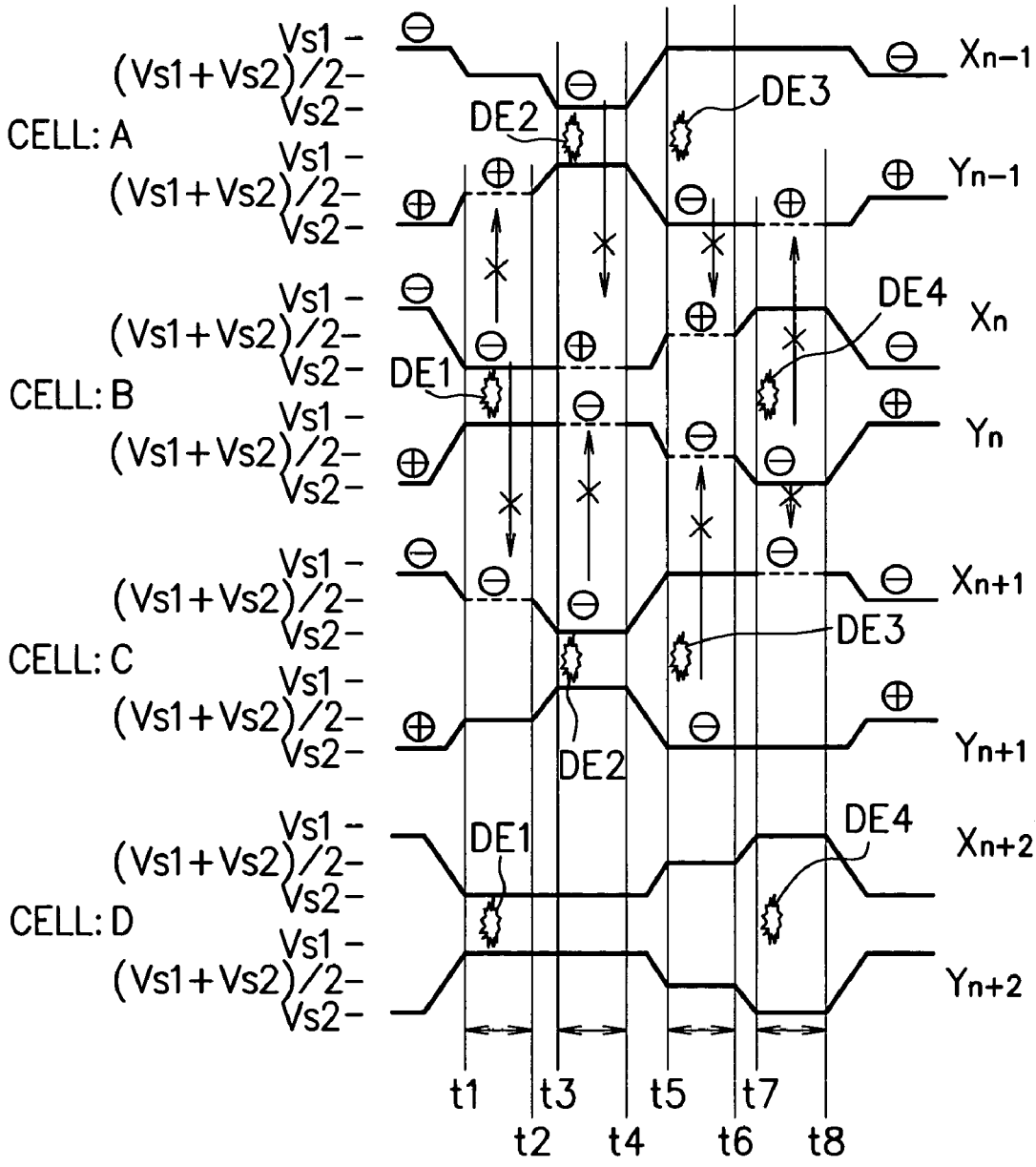
FIG. 12 is a timing chart showing a driving method during a sustain period of a progressive method plasma display according to a sixth embodiment of the present invention.

FIG. 12 is a timing chart showing a driving method during the sustain period Ts of the progressive method plasma display. The electrodes Xn−1, Yn−1, Xn, Yn, Xn+1, Yn+1, Xn+2, Yn+2, and so on are provided in sequence in order.

First, from time t1 to time t2, first discharges DE1 are performed between the electrodes Xn and Yn and between electrodes Xn+2 and Yn+2. Subsequently, from time t3 to time t4, second discharges DE2 are performed between the electrodes Xn−1 and Yn−1 and between the electrodes Xn+1 and Yn+1. Subsequently, from time t5 to time t6, third discharges DE3 are performed between the electrodes Xn−1 and Yn−1 and between the electrodes Xn+1 and Yn+1. Subsequently, from time t7 to time t8, fourth discharges DE4 are performed between the electrodes Xn and Yn and between the electrodes Xn+2 and Yn+2. The sustain discharges are repeated with the first to fourth discharges DE1 to DE4 as one cycle. This can prevent negative charges (electrons) during the discharges from diffusing to adjacent electrodes.

Here, the same voltage is applied to the sustain electrodes Xn+1, and the like on the odd-numbered rows, the same voltage is applied to the sustain electrodes Xn, Xn+2 and the like on the even-numbered rows, the same voltage is applied to the scan electrodes Yn−1, Yn+1, and the like on the odd-numbered rows, and the same voltage is applied to the scan electrodes Yn, Yn+2, and the like on the even-numbered rows.

During the sustain period Ts, even-numbered electrode pairs and odd-numbered electrode pairs, out of electrode pairs of a plurality of display cells which perform display during the sustain period Ts, perform discharges for light emission at different timings. For example, the odd-numbered electrode pairs perform the discharges DE1 and DE4, and, at a timing different therefrom, the even-numbered electrode pairs perform the discharges DE2 and DE3.

Further, the discharge for light emission of one pair of the even-numbered electrode pair and the odd-numbered electrode pair is performed first and then the discharge for light emission of the other pair is performed. In this event, the applied voltages to the one electrode pair are sustained from the start of the discharge for light emission between the one electrode pair to the end of the discharge for light emission between the other electrode pair.

-First Discharge-

Figure 13A:
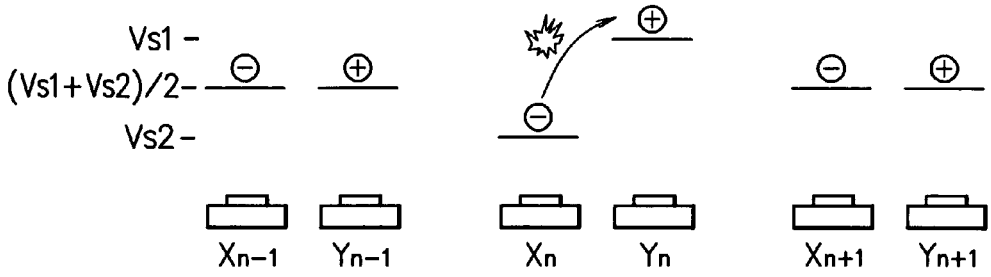
FIGS. 13A to 13C are diagrams showing applied voltages to electrodes during a first discharge.
Figure 13B:
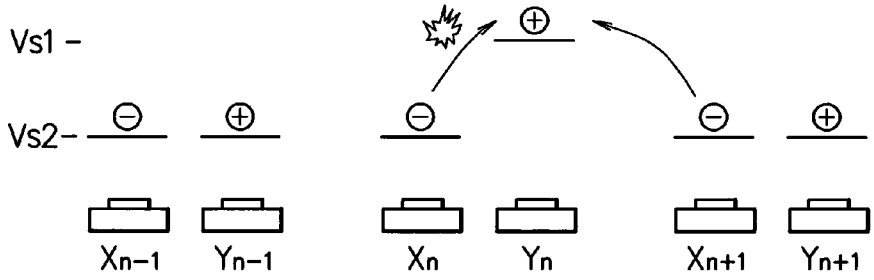
Figure 13C:
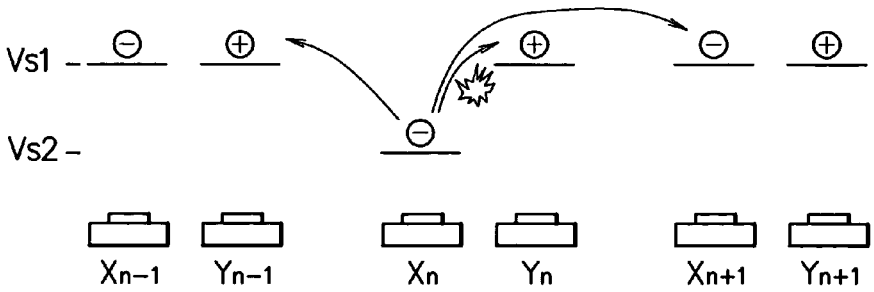

FIGS. 13A to 13C are diagrams for explaining conditions of the first discharge DE1 in FIG. 12. The display cell of the electrodes Xn and Yn is addressed (selected to light up) during the address period Ta (FIG. 36), the cathode voltage Vs2 is applied to the electrode Xn, and the anode voltage Vs1 is applied to the electrode Yn during the sustain period Ts (FIG. 36), thereby causing a discharge between the electrodes Xn and Yn. In this event, if the display cell of the electrodes Xn−1 and Yn−1 is addressed, positive wall charges are formed on the adjacent electrode Yn−1, and if the display cell of the electrodes Xn+1 and Yn+1 is addressed, negative wall charges are formed on the adjacent electrode Xn+1. The same voltage is applied to the sustain electrodes Xn−1 and Xn+1 on the odd-numbered rows, and the same voltage is applied to the scan electrodes Yn−1 and Yn+1 on the odd-numbered rows.

FIG. 13A is a diagram showing the voltages to the adjacent electrodes Yn−1 and Xn+1 set to (Vs1+Vs2)/2 when a discharge is caused between the electrodes Xn and Yn. In this case, the wall charges on the electrodes Xn and Yn never diffuse to the adjacent electrodes Yn−1 and Xn+1, thereby preventing error display.

FIG. 13B is a diagram showing the voltages to the adjacent electrodes Yn−1 and Xn+1 set to the cathode voltage Vs2 when a discharge is caused between the electrodes Xn and Yn. In this case, the negative wall charges on the adjacent electrode Xn+1 diffuse onto the electrode Yn. Therefore, the adjacent electrode Xn+1 needs to have a voltage higher than the cathode voltage Vs2. On the other hand, the wall charges on the electrodes Xn and Yn never diffuse onto the electrode Yn−1. Therefore, the adjacent electrode Yn−1 only needs to have a voltage equal to or higher than the cathode voltage Vs2.

FIG. 13C is a diagram showing the voltages to the adjacent electrodes Yn−1 and Xn+1 set to the anode voltage Vs1 when a discharge is caused between the electrodes Xn and Yn. In this case, the negative wall charges on the adjacent electrode Xn diffuse onto the adjacent electrode Yn−1. Therefore, the adjacent electrode Yn−1 needs to have a voltage lower than the anode voltage Vs1. On the other hand, when the negative charges exist on the electrode Xn+1, the negative wall charges on the electrode Xn never diffuse over the electrode Yn onto the electrode Xn+1. However, if the display cell of the electrodes Xn+1 and Yn+1 is not addressed, no wall charge exists on the electrodes Xn+1 and Yn+1. In this case, the negative wall charges on the electrode Xn diffuse over the electrode Yn onto the electrode Xn+1. This may cause the display cell of the electrodes Xn+1 and Yn+1 to light up in error later. Therefore, the adjacent electrode Xn+1 needs to have a voltage lower than the anode voltage Vs1.

Similarly, in FIG. 13B, if the display cell of the electrodes Xn−1 and Yn−1 is not addressed, no wall charge exists on the electrodes Xn−1 and Yn−1. Also in this case, it can be reasoned that the positive wall charges on the electrode Yn diffuse over the electrode Xn onto the electrode Yn−1. Actually, however, the positive wall charges are larger in mass than the negative wall charges, and thus are hard to diffuse as compared to the negative wall charges. Therefore, in FIG. 13B, the positive wall charges on the electrode Yn never diffuse over the electrode Xn onto the electrode Yn−1.

The foregoing conditions will be explained together. When the cathode voltage Vs2 is applied to the electrode Xn, and the anode voltage Vs1 is applied to the electrode Yn to cause a discharge between the electrodes Xn and Yn, an applied voltage Vyn−1 to the adjacent electrode Yn−1 only needs to be set within the following range. For example, in FIG. 12, the voltage Vyn−1=(Vs1+Vs2)/2.

$$Vs2 \leqq Vyn-1 < Vs1$$

Further, an applied voltage Vxn+1 to the adjacent electrode Xn+1 only needs to be set within the following range. For example, in FIG. 12, the voltage Vxn+1=(Vs1+Vs2)/2.

$$Vs2<Vxn+1<Vs1$$

As described above, in this event, when lighting is caused by sustain (sustain discharge) between the adjacent electrodes Xn−1 and Yn−1, the polarity of the wall charges on the electrode Yn−1, generated by the previous sustain between the electrodes Xn−1 and Yn−1, becomes positive. Similarly, when lighting is caused by sustain between the adjacent electrodes Xn+1 and Yn+1, the polarity of the wall charges on the electrode Xn+1, generated by the previous sustain between the electrodes Xn+1 and Yn+1, becomes negative. Such sustain discharge voltage prevents the negative wall charges on the electrode Xn from diffusing to the electrode Yn−1 or the electrode Xn+1.

-Second Discharge-

Figure 14A:
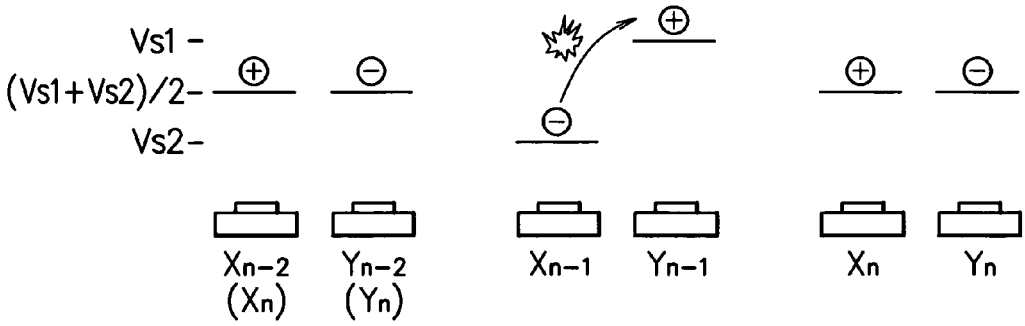
FIGS. 14A to 14C are diagrams showing applied voltages to electrodes during a second discharge.
Figure 14B:
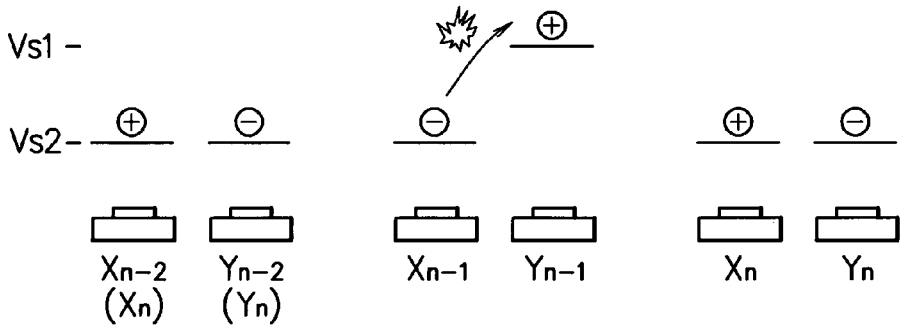
Figure 14C:
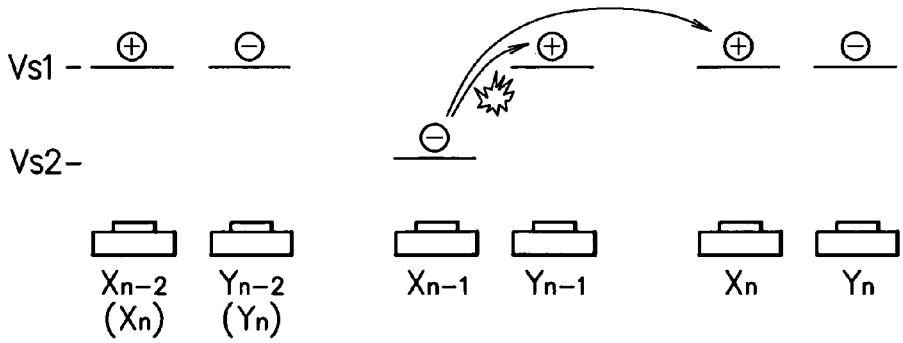

FIGS. 14A to 14C are diagrams for explaining conditions of the second discharge DE2 in FIG. 12. The display cell of the electrodes Xn−1 and Yn−1 is addressed (selected to light up) during the address period Ta (FIG. 36), the cathode voltage Vs2 is applied to the electrode Xn−1, and the anode voltage Vs1 is applied to the electrode Yn−1 during the sustain period Ts (FIG. 36), thereby causing a discharge between the electrodes Xn−1 and Yn−1. In this event, if the display cell of the electrodes Xn−2 and Yn−2 is addressed, negative wall charges are formed on the electrode Yn−2, and if the display cell of the electrodes Xn and Yn is addressed, positive wall charges are formed on the electrode Xn. The same voltage is applied to the sustain electrodes Xn−2 and Xn on the even-numbered rows, and the same voltage is applied to the scan electrodes Yn−2 and Yn on the even-numbered rows.

FIG. 14A is a diagram showing the voltages to the adjacent electrodes Yn−2 and Xn set to (Vs1+Vs2)/2 when a discharge is caused between the electrodes Xn−1 and Yn−1. In this case, the wall charges on the electrodes Xn−1 and Yn−1 never diffuse to the adjacent electrodes Yn−2 and Xn, thereby preventing error display.

FIG. 14B is a diagram showing the voltages to the adjacent electrodes Yn−2 and Xn set to the cathode voltage Vs2 when a discharge is caused between the electrodes Xn−1 and Yn−1. In this case, the charges on the electrodes Xn−1 and Yn−1 never diffuse onto the electrode Xn. Note that since positive wall charges are formed both on the electrodes Yn−1 and Xn, no charge transfers between the electrodes Yn−1 and Xn. Besides, even when the display cell of the electrodes Xn and Yn is not addressed and thus no wall charge exists on the electrodes Xn and Yn, the positive wall charges on the electrode Yn−1 never diffuse onto the electrode Xn. In this event, no negative charge exists on the electrode Xn. Therefore, the adjacent electrode Xn only needs to have a voltage equal to or higher than the cathode voltage Vs2. On the other hand, the charges on the electrodes Xn−1 and Yn−1 never diffuse to the adjacent electrode Note that the positive wall charges on the electrode Yn−1 are larger in mass than the negative wall charges, and thus never diffuse over the electrode Xn−1 onto the electrode Yn−2. Therefore, the adjacent electrode Yn−2 only needs to have a voltage equal to or higher than the cathode voltage Vs2.

FIG. 14C is a diagram showing the voltages to the adjacent electrodes Yn−2 and Xn set to the anode voltage Vs1 when a discharge is caused between the electrodes Xn−1 and Yn−1. In this case, the charges on the electrodes Xn−1 and Yn−1 never diffuse onto the adjacent electrode Yn−2. Note that since negative wall charges are formed both on the electrodes Xn−1 and Yn−2, no charge transfers between the electrodes Xn−1 and Yn−2. Besides, even when the display cell of the electrodes Xn−2 and Yn−2 is not addressed and thus no wall charge exists on the electrodes Xn−2 and Yn−2, the negative wall charges on the electrode Xn−1 never diffuse onto the electrodes Yn−2. Therefore, the adjacent electrode Yn−2 needs to have a voltage equal to or lower than the anode voltage Vs1. On the other hand, since the electrodes Yn−1 and Xn are at the same potential, the negative wall charges on the electrode Xn−1 diffuse to the electrodes Yn−1 and the electrode Xn adjacent thereto. In this event, if the positive wall charges exist or do not exist on the electrode Xn in response to the addressing of the display cell of the electrodes Xn and Yn, the negative wall charges on the electrode Xn−1 diffuse onto the electrode Xn. Therefore, the adjacent electrode Xn needs to have a voltage lower than the anode voltage Vs1.

The foregoing conditions will be explained together. When the cathode voltage Vs2 is applied to the electrode Xn−1, and the anode voltage Vs1 is applied to the electrode Yn−1 to cause a discharge between the electrodes Xn−1 and Yn−1, an applied voltage Vxn to the electrode Xn only needs to be set within the following range. For example, in FIG. 12, the voltage Vxn=Vs2.

$$Vs2\leqq Vxn<Vs1$$

Similarly, when the cathode voltage Vs2 is applied to the electrode Xn−1, and the anode voltage Vs1 is applied to the electrode Yn−1 to cause a discharge between the electrodes Xn−1 and Yn−1, an applied voltage Vyn to the electrode Yn−2 (Yn) only needs to be set within the following range. For example, in FIG. 12, the voltage Vyn=Vs1.

$$Vs2\leqq Vyn\leqq Vs1$$

In this event, when lighting is caused by sustain (sustain discharge) between the electrodes Xn and Yn, the polarity of the wall charges on the electrode Xn, generated by the previous sustain between the electrodes Xn and Yn, becomes positive, and the polarity of the wall charges on the electrode Yn becomes negative. This prevents the negative wall charges on the electrode Xn−1 from diffusing to the electrode Xn or Yn−2.

-Third Discharge-

Figure 15A:
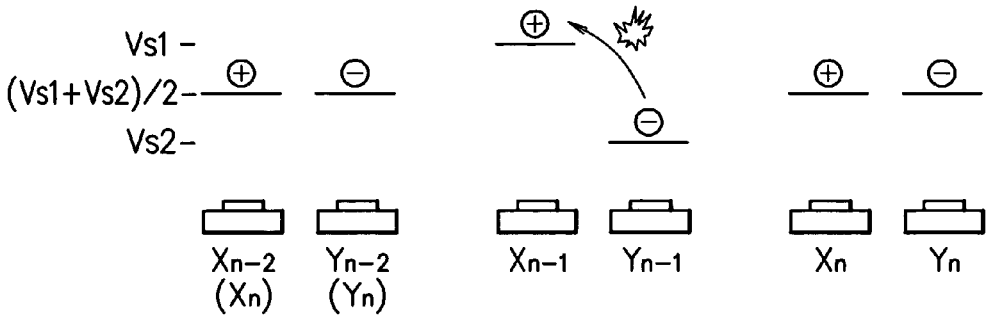
FIGS. 15A to 15C are diagrams showing applied voltages to electrodes during a third discharge.
Figure 15B:
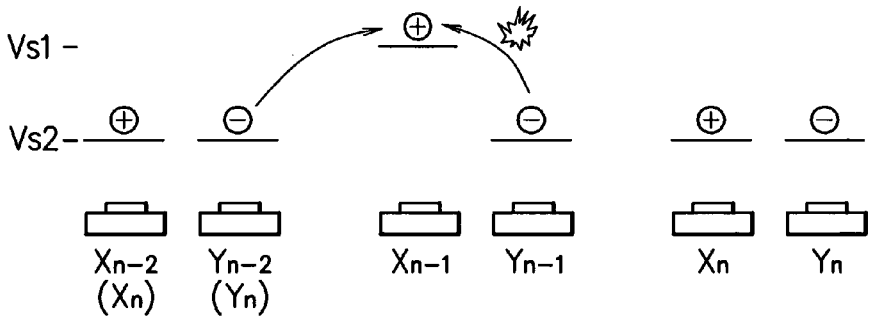
Figure 15C:
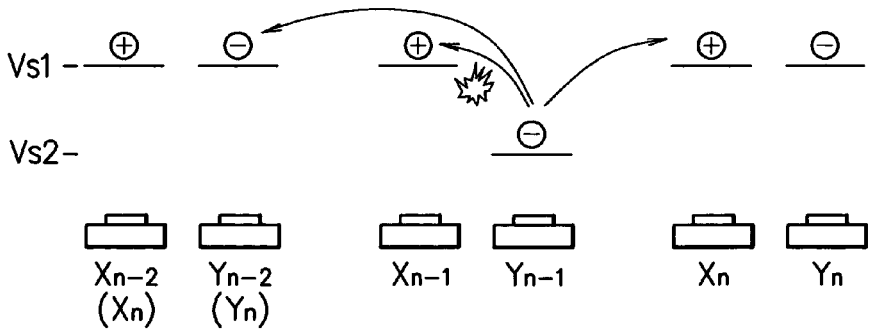

FIGS. 15A to 15C are diagrams for explaining conditions of the third discharge DE3 in FIG. 12. The display cell of the electrode Xn−1 and the electrode Yn−1 is addressed (selected to light up) during the address period Ta (FIG. 36), the anode voltage Vs1 is applied to the electrode Xn−1, and the cathode voltage Vs2 is applied to the electrode Yn−1 during the sustain period Ts (FIG. 36), thereby causing a discharge between the electrodes Xn−1 and Yn−1. In this event, if the display cell of the electrodes Xn−2 and Yn−2 is addressed, negative wall charges are formed on the electrode Yn−2, and if the display cell of the electrodes Xn and Yn is addressed, positive wall charges are formed on the electrode Xn. The same voltage is applied to the sustain electrodes Xn−2 and Xn on the even-numbered rows, and the same voltage is applied to the scan electrodes Yn−2 and Yn on the even-numbered rows.

FIG. 15A is a diagram showing the voltages to the adjacent electrodes Yn−2 and Xn set to (Vs1+Vs2)/2 when a discharge is caused between the electrodes Xn−1 and Yn−1. In this case, the wall charges on the electrodes Xn−1 and Yn−1 never diffuse to the adjacent electrodes Yn−2 or Xn, thereby preventing error display.

FIG. 15B is a diagram showing the voltages to the adjacent electrodes Yn−2 and Xn set to the cathode voltage Vs2 when a discharge is caused between the electrodes Xn−1 and Yn−1. In this case, the charges on the electrodes Xn−1 and Yn−1 never diffuse onto the electrode Xn. Note that the positive wall charges on the electrode Xn−1 are larger in mass than the negative wall charges, and thus never diffuse over the electrode Yn−1 onto the electrode Xn. Therefore, the adjacent electrode Xn only needs to have a voltage equal to or higher than the cathode voltage Vs2. On the other hand, the negative wall charges on the electrode Yn−2 diffuse onto the electrodes Xn−1. Therefore, the adjacent electrode Yn−2 needs to have a voltage higher than the cathode voltage Vs2.

FIG. 15C is a diagram showing the voltages to the adjacent electrodes Yn−2 and Xn set to the anode voltage Vs1 when a discharge is caused between the electrodes Xn−1 and Yn−1. In this case, the negative wall charges on the electrodes Yn−1 diffuse onto the adjacent electrode Xn. Therefore, the adjacent electrode Xn needs to have a voltage lower than the anode voltage Vs1. On the other hand, if negative charges exist on the electrode Yn−2, the negative wall charges on the electrode Yn−1 never diffuse over the electrode Xn−1 onto the electrode Yn−2. However, if the display cell of the electrodes Xn−2 and Yn−2 is not addressed, and thus no wall charge exists on the electrodes Xn−2 and Yn−2, the negative wall charges on the electrode Yn−1 diffuse over the electrode Xn−1 onto the electrode Yn−2. This may cause the display cell of the electrodes Xn−2 and Yn−2 to light up in error later. Therefore, the adjacent electrode Yn−2 needs to have a voltage lower than the anode voltage Vs1.

The foregoing conditions will be explained together. When the anode voltage Vs1 is applied to the electrode Xn−1 and the cathode voltage Vs2 is applied to the electrode Yn−1 to cause a discharge between the electrodes Xn−1 and Yn−1, an applied voltage Vxn to the electrode Xn only needs to be set within the following range. For example, in FIG. 12, the voltage Vxn=(Vs1+Vs2)/2.

$$Vs2 \leqq Vxn < Vs1$$

Similarly, when the anode voltage Vs1 is applied to the electrode Xn−1, and the cathode voltage Vs2 is applied to the electrode Yn−1 to cause a discharge between the electrodes Xn−1 and Yn−1, an applied voltage Vyn to the electrode Yn−2 (Yn) only needs to be set within the following range. For example, in FIG. 12, the voltage Vyn=(Vs1+Vs2)/2.

$$Vs2 < Vyn < Vs1$$

In this event, when lighting is caused by sustain (sustain discharge) between the electrodes Xn and Yn, the polarity of the wall charges on the electrode Xn, generated by the previous sustain between the electrodes Xn and Yn, becomes positive, and the polarity of the wall charges on the electrode Yn becomes negative. This prevents the negative wall charges on the electrode Yn−1 from diffusing to the electrode Xn or Yn−2.

-Fourth Discharge-

Figure 16A:
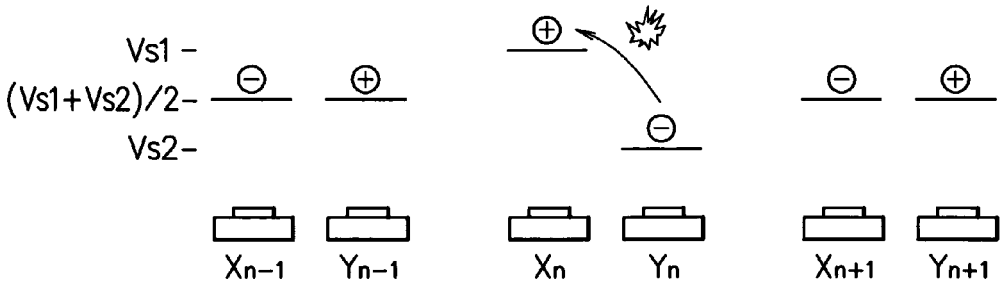
FIGS. 16A to 16C are diagrams showing applied voltages to electrodes during a fourth discharge.
Figure 16B:
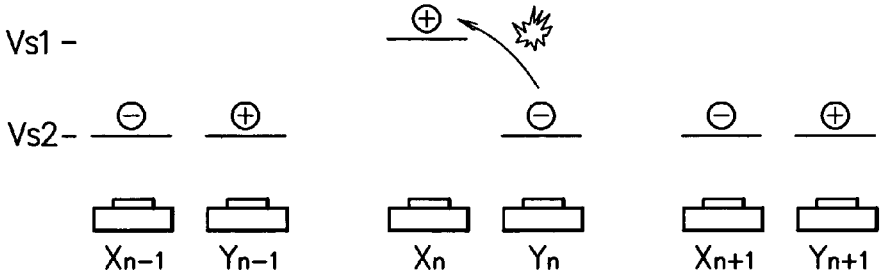
Figure 16C:
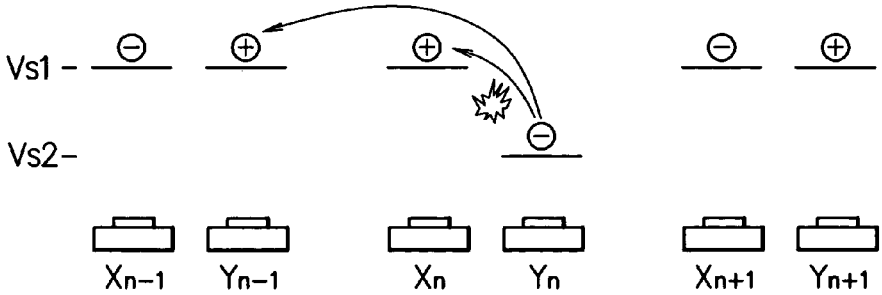

FIGS. 16A to 16C are diagrams for explaining conditions of the fourth discharge DE4 in FIG. 12. The display cell of the electrodes Xn and Yn is addressed (selected to light up) during the address period Ta (FIG. 36), the anode voltage Vs1 is applied to the electrode Xn, and the cathode voltage Vs2 is applied to the electrode Yn during the sustain period Ts (FIG. 36), thereby causing a discharge between the electrodes Xn and Yn. In this event, if the display cell of the electrodes Xn−1 and Yn−1 is addressed, positive wall charges are formed on the adjacent electrode Yn−1, and if the display cell of the electrodes Xn+1 and Yn+1 is addressed, negative wall charges are formed on the adjacent electrode Xn+1.

FIG. 16A is a diagram showing the voltages to the adjacent electrodes Yn−1 and Xn+1 set to (Vs1+Vs2)/2 when a discharge is caused between the electrodes Xn and Yn. In this case, the wall charges on the electrodes Xn and Yn never diffuse to the adjacent electrode Yn−1 or Xn+1, thereby preventing error display.

FIG. 16B is a diagram showing the voltages to the adjacent electrodes Yn−1 and Xn+1 set to the cathode voltage Vs2 when a discharge is caused between the electrodes Xn and Yn. In this case, the charges on the electrodes Xn and Yn never diffuse onto the electrode Xn+1. Note that the positive wall charges on the electrode Xn are larger in mass than the negative wall charges, and thus never diffuse over the electrode Yn onto the electrode Therefore, the adjacent electrode Xn+1 only needs to have a voltage equal to or higher than the cathode voltage Vs2. On the other hand, the charges on the electrodes Xn and Yn never diffuse onto the electrode Yn−1. Note that since the polarity of the wall charges on the electrode Yn−1 is positive, no charge transfers between the electrodes Xn and Yn−1. Besides, even when the display cell of the electrodes Xn−1 and Yn−1 is not addressed, and thus no wall charge exists on the electrodes Xn−1 and Yn−1, the positive wall charges on the electrode Xn never diffuse onto the electrode Yn−1. In this event, no negative wall charge exists on the electrode Yn−1. Therefore, the adjacent electrode Yn−1 only needs to have a voltage equal to or higher than the cathode voltage Vs2.

FIG. 16C is a diagram showing the voltages to the adjacent electrodes Yn−1 and Xn+1 set to the anode voltage Vs1 when a discharge is caused between the electrodes Xn and Yn. In this case, the charges on the electrodes Xn and Yn never diffuse onto the adjacent electrode Xn+1. Note that since the polarity of the wall charges on the electrode Xn+1 is negative, no charge transfers between the electrodes Yn and Xn+1. Besides, even when the display cell of the electrodes Xn+1 and Yn+1 is not addressed, and thus no wall charge exists on the electrodes Xn+1 and Yn+1, the negative wall charges on the electrode Yn never diffuse onto the electrode Xn+1. In this event, no positive wall charge exists on the electrode Xn+1. Therefore, the adjacent electrode Xn+1 only needs to have a voltage equal to or lower than the anode voltage Vs1. On the other hand, the negative charges on the electrode Yn diffuse over the electrode Xn to the electrode Yn−1. In this event, if the positive wall charges exist or do not exist on the electrode Yn−1 in response to the addressing of the display cell of the electrodes Xn−1 and Yn−1, the negative wall charges on the electrode Yn diffuse over the electrode Xn onto the electrode Yn−1. Therefore, the adjacent electrode Yn−1 needs to have a voltage lower than the anode voltage Vs1.

The foregoing conditions will be explained together. When the anode voltage Vs1 is applied to the electrode Xn, and the cathode voltage Vs2 is applied to the electrode Yn to cause a discharge between the electrodes Xn and Yn, an applied voltage Vyn−1 to the electrode Yn−1 only needs to be set within the following range. For example, in FIG. 12, the voltage Vyn−1=Vs2.

$$Vs2 \leqq Vyn-1 < Vs1$$

Besides, an applied voltage Vxn+1 to the electrode Xn+1 only needs to be set within the following range. For example, in FIG. 12, the voltage Vxn+1=Vs1.

$$Vs2 \leqq Vxn+1 \leqq Vs1$$

In this event, when lighting is caused by sustain (sustain discharge) between the electrodes Xn−1 and Yn−1 adjacent to the electrodes Xn and Yn, the polarity of the wall charges on the electrode Yn−1, generated by the previous sustain between the electrodes Xn−1 and Yn−1, becomes positive. Similarly, when lighting is caused by sustain between the electrodes Xn+1 and Yn+1 adjacent to the electrodes Xn and Yn, the polarity of the wall charges on the electrode Xn+1, generated by the previous sustain between the electrodes Xn+1 and Yn+1, becomes negative. Such voltage waveforms of sustain discharges prevent the negative wall charges on the electrode Yn from diffusing to the electrode Yn−1 or Xn+1.

SEVENTH EMBODIMENT

Figure 17:
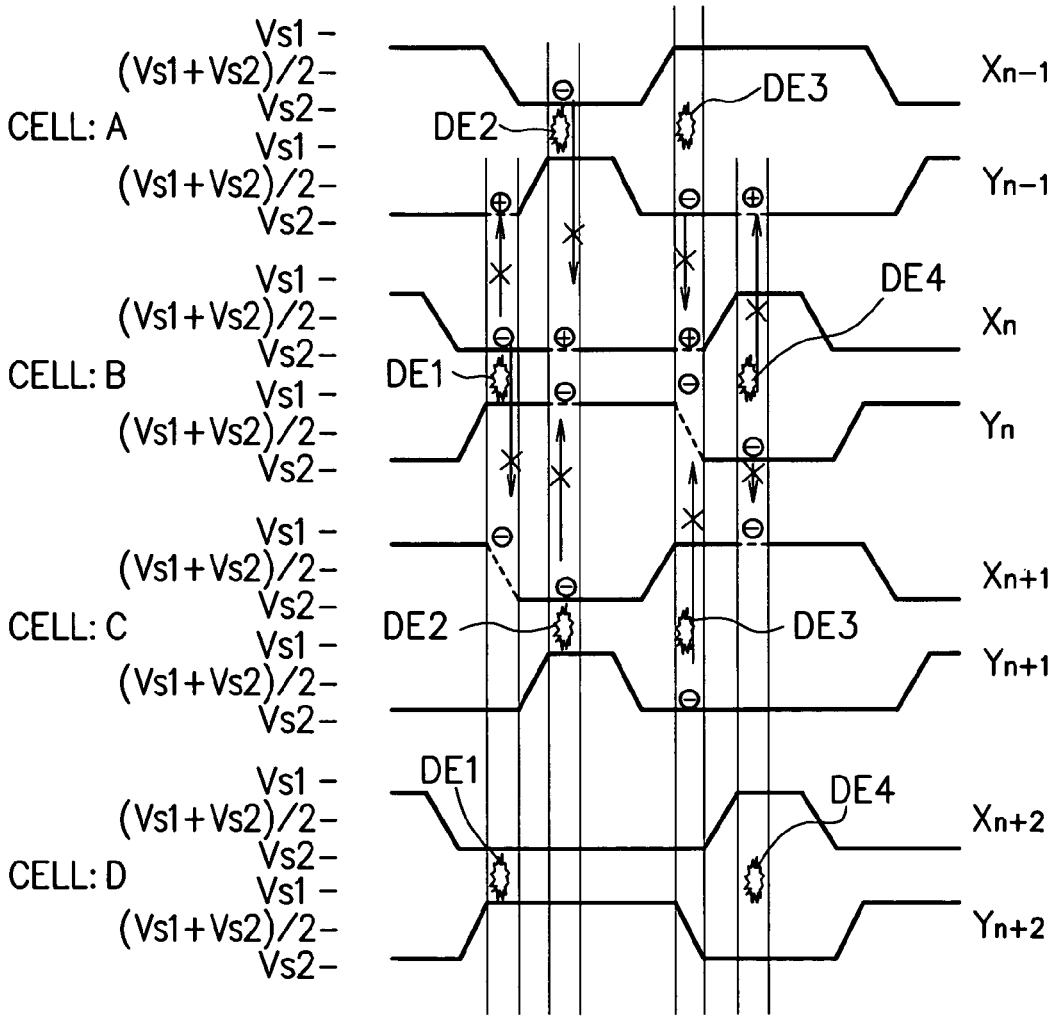
FIG. 17 is a timing chart showing a driving method during a sustain period of a progressive method plasma display according to a seventh embodiment of the present invention.

FIG. 17 is a timing chart showing a driving method during the sustain period Ts of a progressive method plasma display according to a seventh embodiment of the present invention. The voltage waveforms of sustain discharges in FIG. 17 are basically the same as those in FIG. 12, and thus the following description will be made on different points.

As for the first discharge DE1, the cathode voltage Vs2 is applied to the electrode Xn, and the anode voltage Vs1 is applied to the electrode Yn, thereby causing a discharge between the electrodes Xn and Yn. In this event, the applied voltage Vxn+1 to the adjacent electrode Xn+1 is changed within the following range.

$$Vs2 < Vxn+1 < Vs1$$

For example, the voltage Vxn+1 is gradually changed from the anode voltage Vs1 to the cathode voltage Vs2. This means that the applied voltage to the adjacent electrode may be changed during the discharge within the range of the conditions shown in the sixth embodiment. Note that, during the first discharge DE1, the adjacent electrode Yn−1 sustains the cathode voltage Vs2 as from before the first discharge DE1 in this embodiment.

As for the third discharge DE3, the anode voltage Vs1 is applied to the electrode Xn+1 and the cathode voltage Vs2 is applied to the electrode Yn+1, thereby causing a discharge between the electrodes Xn+1 and Yn+1. In this event, the applied voltage Vyn to the adjacent electrode Yn is changed within the following range.

$$Vs2 < Vyn < Vs1$$

Note that, during the third discharge DE3, the adjacent electrode Xn sustains the cathode voltage Vs2 as from before the third discharge DE3 in this embodiment.

According to this embodiment, even if the applied voltage to the adjacent electrode is changed during the discharge within the range of the conditions shown in the sixth embodiment, the same effects as those in the first embodiment can be attained. In other words, it is possible to prevent diffusion of charges so as to eliminate error display.

EIGHTH EMBODIMENT

Figure 18:
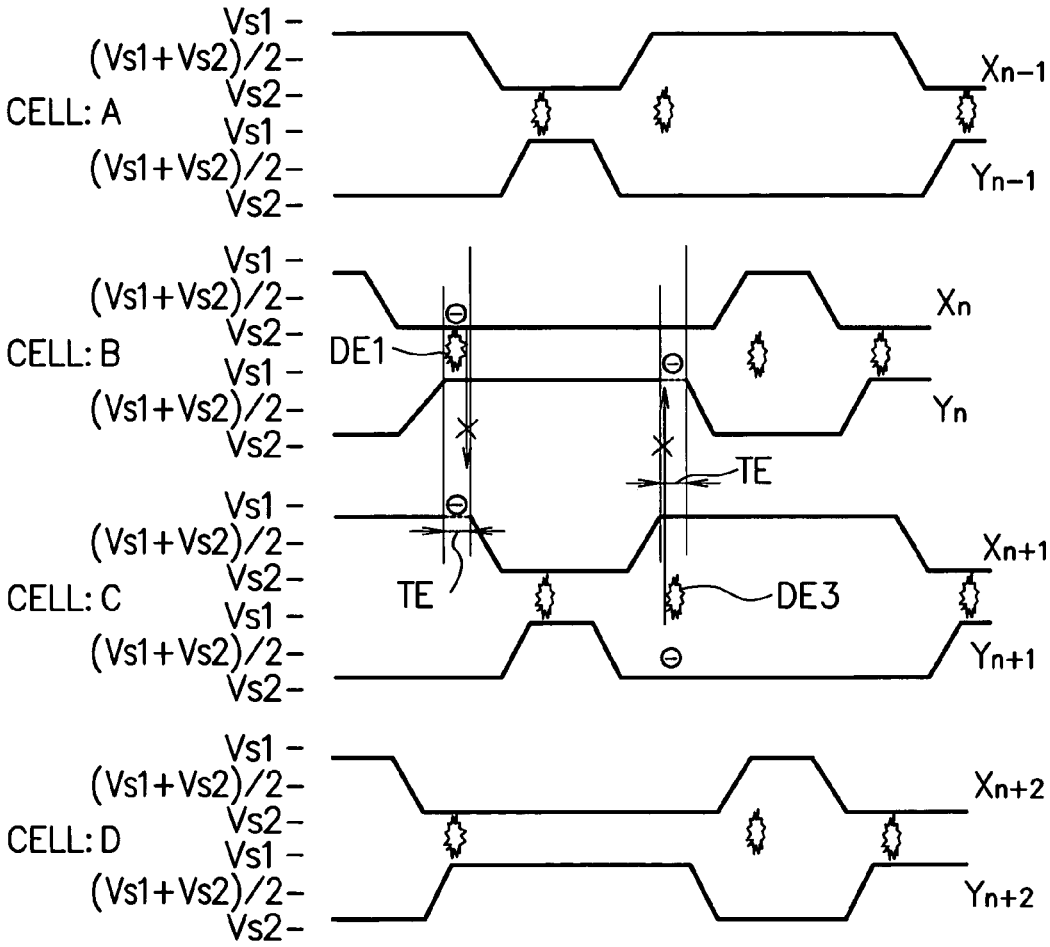
FIG. 18 is a timing chart showing a driving method during a sustain period of a progressive method plasma display according to an eighth embodiment of the present invention.

FIG. 18 is a timing chart showing a driving method during the sustain period Ts of a progressive method plasma display according to an eighth embodiment of the present invention. The voltage waveforms of sustain discharges in FIG. 18 are basically the same as those in FIG. 17 and thus the following description will be made on different points.

As for the first discharge DE1, the cathode voltage Vs2 is applied to the electrode Xn, and the anode voltage Vs1 is applied to the electrode Yn, thereby causing a discharge between the electrodes Xn and Yn. In this event, the applied voltage Vxn+1 to the adjacent electrode Xn+1 is set to Vxn+1=Vs1, exceeding the set range Vs2<Vxn+1<Vs1. In this event, however, a time TE during which Vxn+1=Vs1 is within 500 ns. For example, the time TE is 100 ns. After a lapse of the time TE, the voltage Vxn+1 is set within the range Vs2<Vxn+1<Vs1.

This applies to the third discharge DE3. During the third discharge DE3, the applied voltage Vyn to the adjacent electrode Yn is first set to Vyn=Vs1 during the time TE and then to the range Vs2<Vyn<Vs1.

According to this embodiment, within 500 ns, even if the voltage to the aforementioned adjacent electrode is Vs1, the negative charges on the electrode Xn during the period of the first discharge DE1 and the negative charges on the electrode Yn+1 during the period of the third discharge DE3 never diffuse to the electrodes Xn+1 and Yn, respectively. The reason will be described hereafter with reference to FIGS. 19A to 19C and FIGS. 20A to 20C.

Figure 19A:
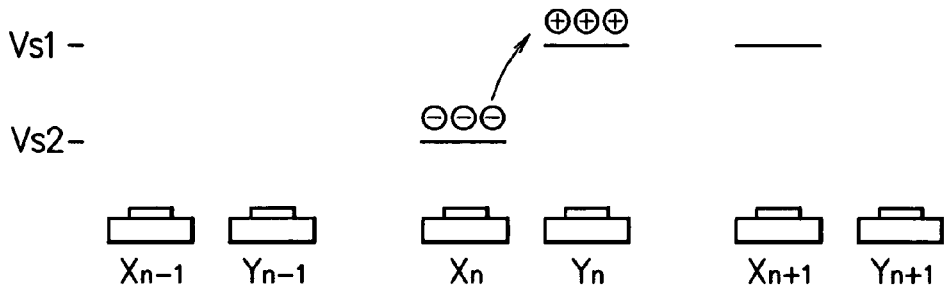
FIGS. 19A to 19C are diagrams showing a problem of applied voltages to electrodes during a first discharge in FIG. 18.
Figure 19B:
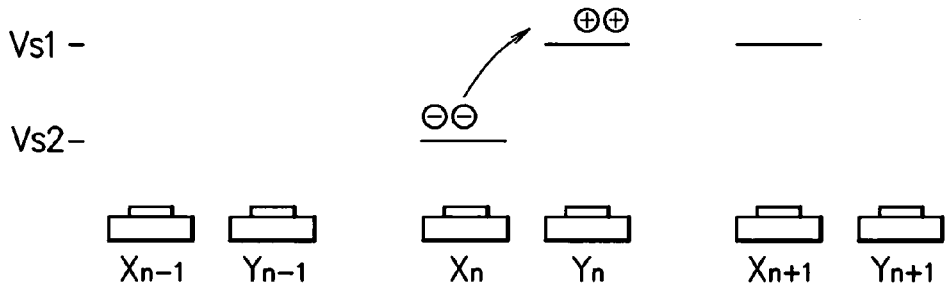
Figure 19C:
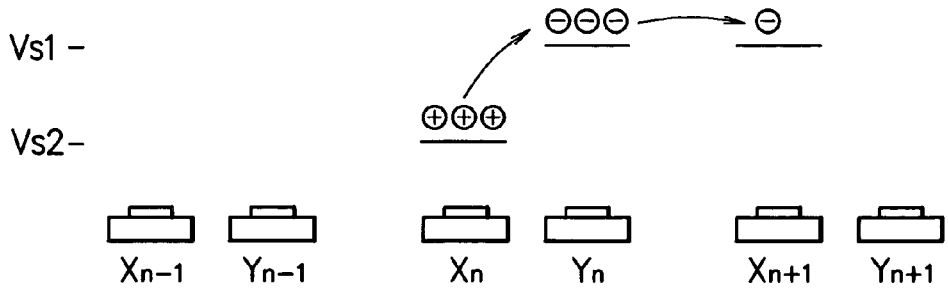

FIGS. 19A to 19C show a problem when the anode voltage Vs1 is kept applied to the adjacent electrode Xn+1 during the first discharge DE1 in FIG. 18. FIGS. 19A to 19C show the state in FIG. 13C with time transition. More specifically, the cathode voltage Vs2 is applied to the electrode Xn, the anode voltage Vs1 to the electrode Yn, and the anode voltage Vs1 to the adjacent electrode Xn+1.

In FIG. 19A, the negative charges on the electrode Xn start to transfer onto the electrode Yn due to the potential difference between the electrodes Xn and Yn. In FIG. 19B, the negative charges on the electrode Xn further transfer onto the electrode Yn. In FIG. 19C, the negative charges on the electrode Xn further transfer onto the electrode Yn to form negative charges on the electrode Yn. When a predetermined amount of negative charges are formed on the electrode Yn, the negative charges on the electrode Yn diffuse to the adjacent electrode Xn+1.

Figure 20A:
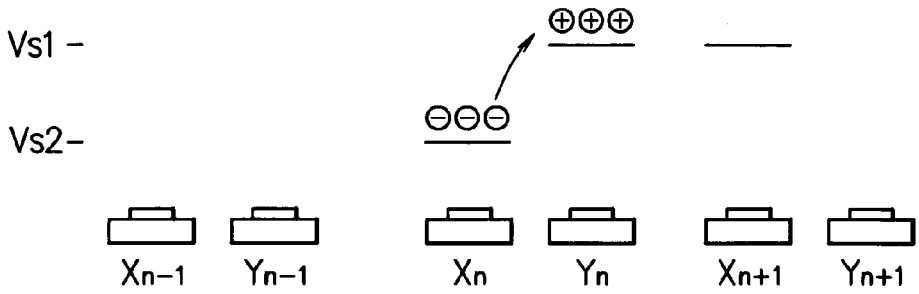
FIGS. 20A to 20C are diagrams showing applied voltages to the electrodes during the first discharge in FIG. 18.
Figure 20B:
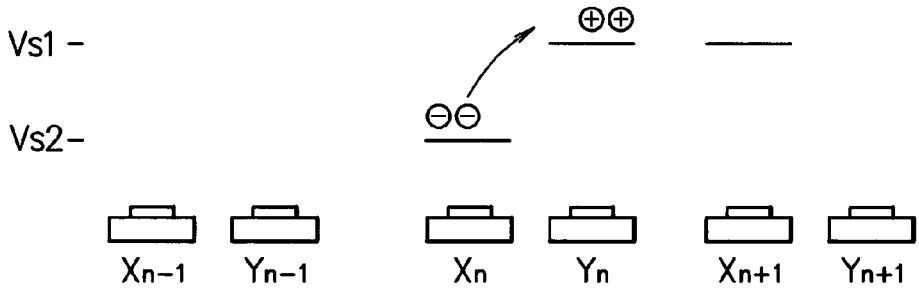
Figure 20C:
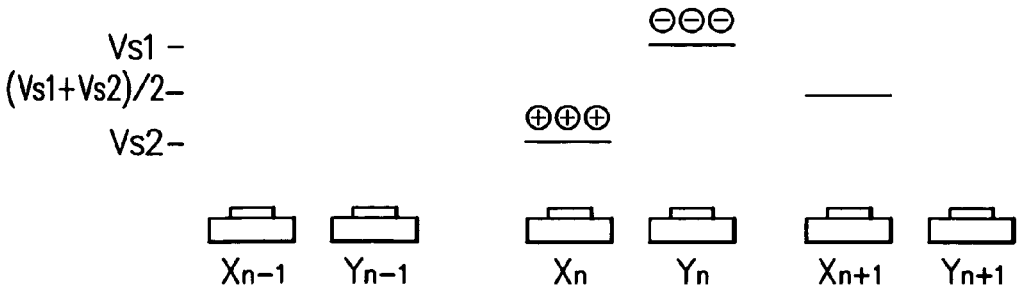

FIGS. 20A to 20C show transition of voltage to the adjacent electrode Xn+1 during the first discharge DE1 shown in FIG. 18. In FIG. 20A, the cathode voltage Vs2 is applied to the electrode Xn, the anode voltage Vs1 is applied to the electrode Yn, and the anode voltage Vs1 is applied to the adjacent electrode Xn+1. This state is sustained for the time TE (within 500 ns). Then, the negative charges on the electrode Xn transfer onto the electrode Yn as in FIG. 20B. Then, after the time TE and before a predetermined amount of negative charges are formed on the electrode Yn, as shown in FIG. 20C, the voltage Vxn+1 to the adjacent electrode Xn+1 is set within the range Vs2<Vxn+1<Vs1. For example, the voltage Vxn+1=(Vs1+Vs2)/2. This can prevent the negative charges from diffusing onto the electrode Xn+1.

NINTH EMBODIMENT

Figure 21:
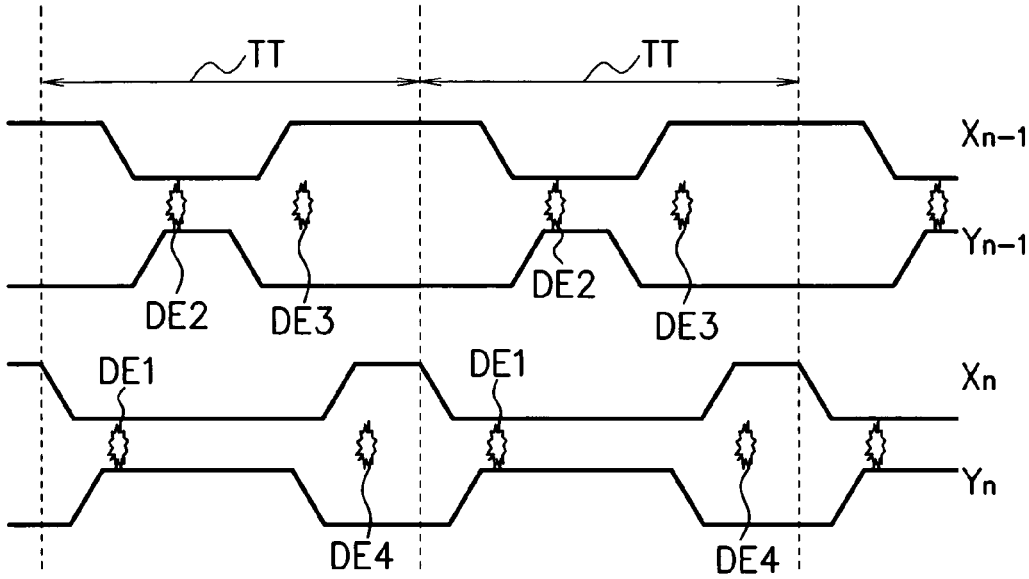
FIG. 21 is a timing chart showing a driving method during a sustain period of a progressive method plasma display according to a ninth embodiment of the present invention.

FIG. 21 is a timing chart showing a driving method during the sustain period Ts of a progressive method plasma display according to a ninth embodiment of the present invention. This embodiment shows the sustain discharge voltage waveforms of repeating the voltage waveforms during the period TT shown in the seventh embodiment (FIG. 17) as one cycle. The one cycle TT includes the first to fourth discharges DE1 to DE4.

TENTH EMBODIMENT

Figure 22:
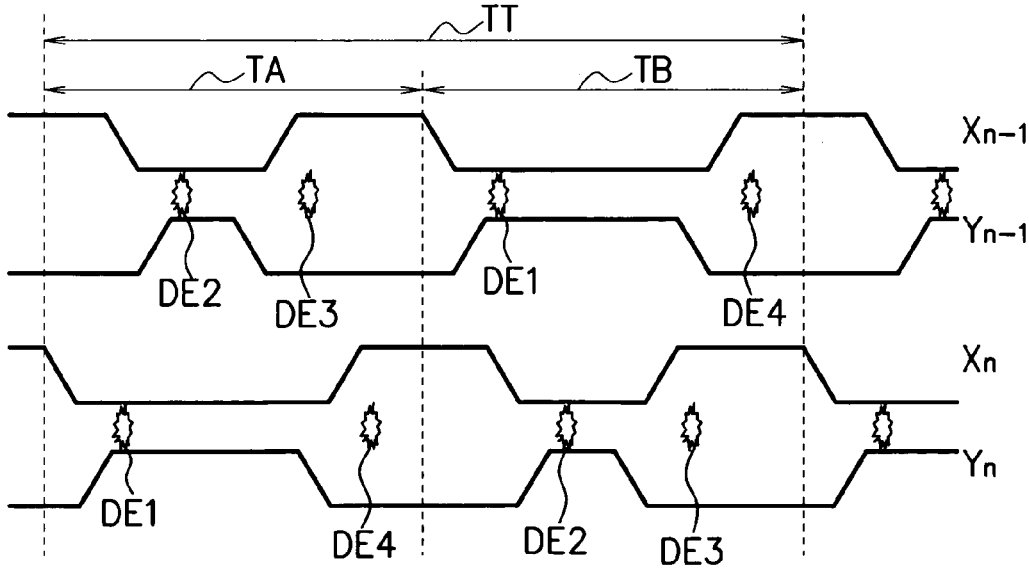
FIG. 22 is a timing chart showing a driving method during a sustain period of a progressive method plasma display according to a tenth embodiment of the present invention.

FIG. 22 is a timing chart showing a driving method during the sustain period Ts of a progressive method plasma display according to a tenth embodiment of the present invention. A period TA is the same as the period TT in FIG. 21. In a period TB subsequent thereto, in comparison with the period TA, the voltage to the sustain electrodes Xn and the like on the even-numbered rows is exchanged with the voltage to the sustain electrodes Xn−1 and the like on the odd-numbered rows, and the voltage to the scan electrodes Yn and the like on the even-numbered rows is exchanged with the voltage to the scan electrodes Yn−1 and the like on the odd-numbered rows. The waveforms during the period TT composed of a set of the period TA and the period TB are repeated as one cycle to form the voltage waveforms of sustain discharges. This embodiment can also prevent, as in the ninth embodiment, the negative charges from diffusing to eliminate error display.

In the ninth embodiment (FIG. 21), in all the periods TT, the discharges DE2 and DE3 are performed between the electrodes Xn−1 and Yn−1 at short intervals, while the discharges DE1 and DE4 are performed between the electrodes Xn and Yn at long intervals. In other words, there occurs unevenness between the intervals of discharges between the electrodes Xn−1 and Yn−1 and the intervals of discharges between the electrodes Xn and Yn. In contrast to this, in the tenth embodiment (FIG. 22), the periods TA and TB are alternately performed to eliminate the unevenness between the intervals of discharges between the electrodes Xn−1 and Yn−1 and the intervals of discharges between the electrodes Xn and Yn.

ELEVENTH EMBODIMENT

Figure 23:
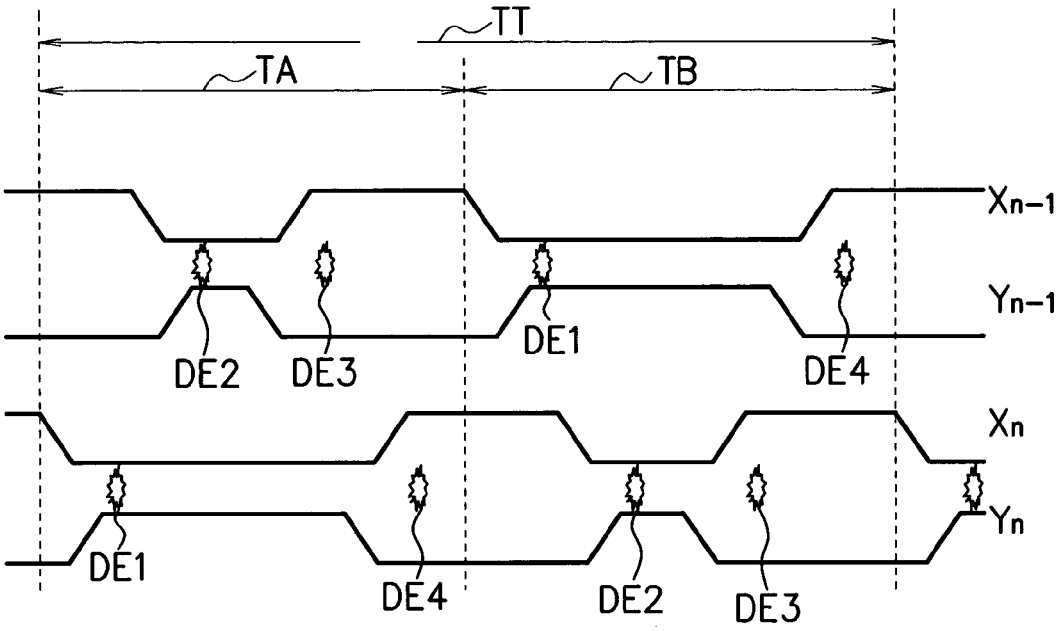
FIG. 23 is a timing chart showing a driving method during a sustain period of a progressive method plasma display according to an eleventh embodiment of the present invention.

FIG. 23 is a timing chart showing a driving method during the sustain period Ts of a progressive method plasma display according to an eleventh embodiment of the present invention. In the eleventh embodiment, as in the tenth embodiment (FIG. 22), the period TT composed of the periods TA and TB is one cycle. While the voltage waveforms in the seventh embodiment (FIG. 17) are applied to the tenth embodiment, the voltage waveforms in the eighth embodiment (FIG. 18) are applied to the eleventh embodiment. This embodiment also provides the same effects as those in the above-described embodiments.

TWELFTH EMBODIMENT

Figure 24:
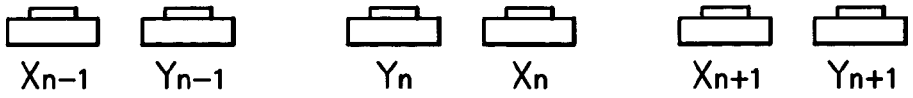
FIG. 24 is a diagram showing an arrangement of electrodes of a progressive method plasma display according to a twelfth embodiment of the present invention.

FIG. 24 shows an arrangement of electrodes of a progressive method plasma display according to a twelfth embodiment of the present invention. In the above sixth to eleventh embodiments, the description has been made on the case in which the sustain electrodes and the scan electrodes constituting the display cells are alternately provided. More specifically, the scan electrodes to be scanned for application of an address selection voltage and the sustain electrodes to which the address selection voltage is-not applied are alternately provided. In the twelfth embodiment, two adjacent scan electrodes Yn+1, Yn and the like and two adjacent sustain electrodes Xn, Xn+1 and the like are alternately provided.

THIRTEENTH EMBODIMENT

Figure 25:
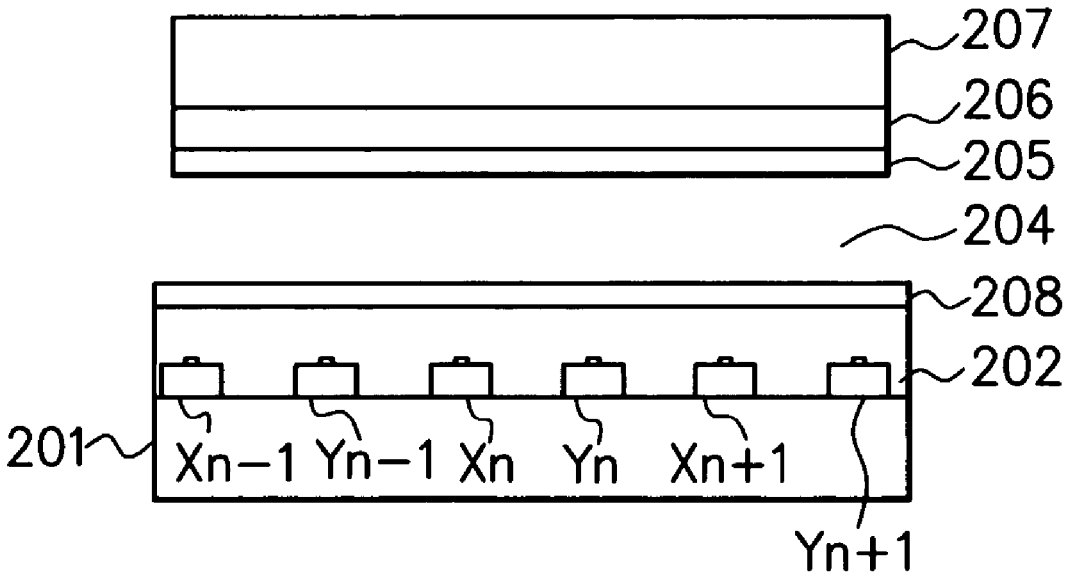
FIG. 25 is a cross-sectional view of an ALIS method plasma display according to a thirteenth embodiment of the present invention.

FIG. 25 is a cross-sectional view of an ALIS method plasma display according to a thirteenth embodiment of the present invention. This configuration is basically the same as that of the progressive method plasma display in FIG. 11. In the ALIS method, however, all of intervals between the electrodes Xn−1, Yn−1, Xn, Yn, Xn+1, and Yn+1 are the same with no light shield 203 provided. Gaps between the electrodes Xn−1 and Yn−1, between the electrodes Xn and Yn, and between the electrodes Xn+1 and Yn+1 are first slits respectively, and gaps between the electrodes Yn−1 and Xn and between the electrodes Yn and Xn+1 are second slits respectively. In the ALIS method, sustain discharges in the first slits are performed in a first frame FR in FIG. 36 as an odd field, and sustain discharges in the second slits are performed in a second frame FR subsequent thereto as an even field. These odd and even fields are repeatedly performed. Each of the electrodes can perform sustain discharges with respect to adjacent electrodes on both sides. The ALIS method has the number of display lines (rows) twice that of the progressive method, and thus enables high definition.

Figure 26A:
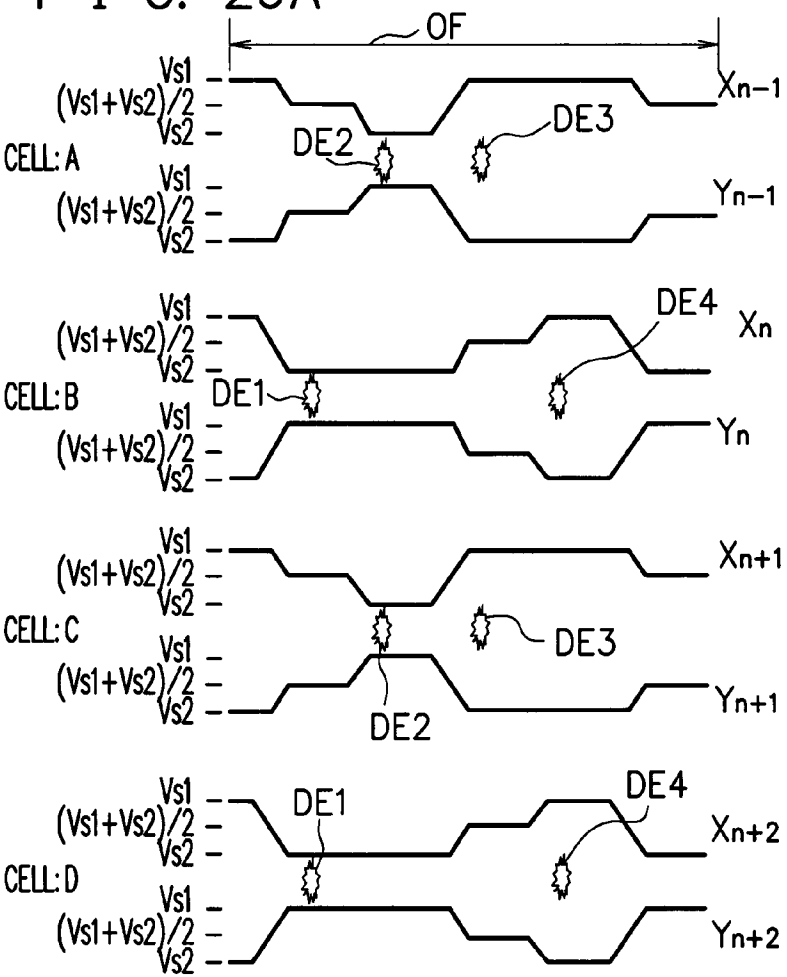
FIGS. 26A and 26B are timing charts each showing a driving method during a sustain period of an ALIS method plasma display according to the thirteenth embodiment.
Figure 26B:
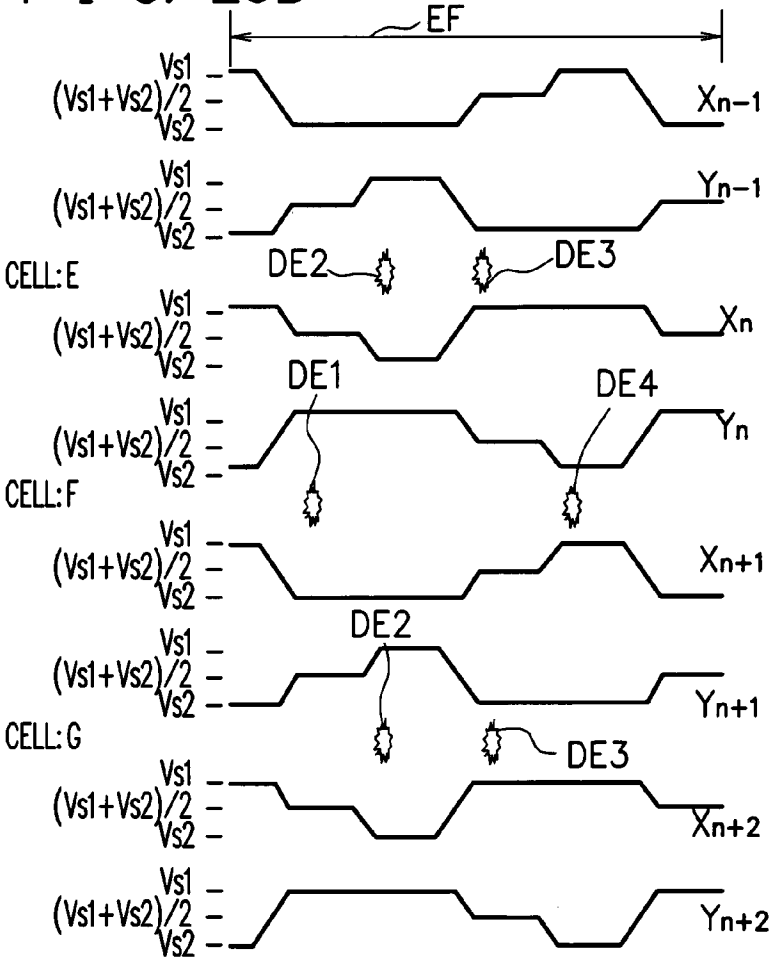

FIGS. 26A and 26B are timing charts each showing a driving method during the sustain period Ts of the ALIS method plasma display according to this embodiment, in which the sixth embodiment (FIG. 12) is applied to the ALIS method. FIG. 26A shows the voltage waveforms of sustain discharges in an odd field OF, and FIG. 26B shows the voltage waveforms of sustain discharges in an even field EF. The voltage waveforms in the odd field OF are the same as those in the sixth embodiment (FIG. 12). In the even field EF, in comparison with the odd field OF, the voltage to the sustain electrodes Xn−1, Xn+1, and the like on the odd-numbered rows is exchanged with the voltage to the sustain electrodes Xn, Xn+2, and the like on the even-numbered rows.

FOURTEENTH EMBODIMENT

Figures 27A, 27B:
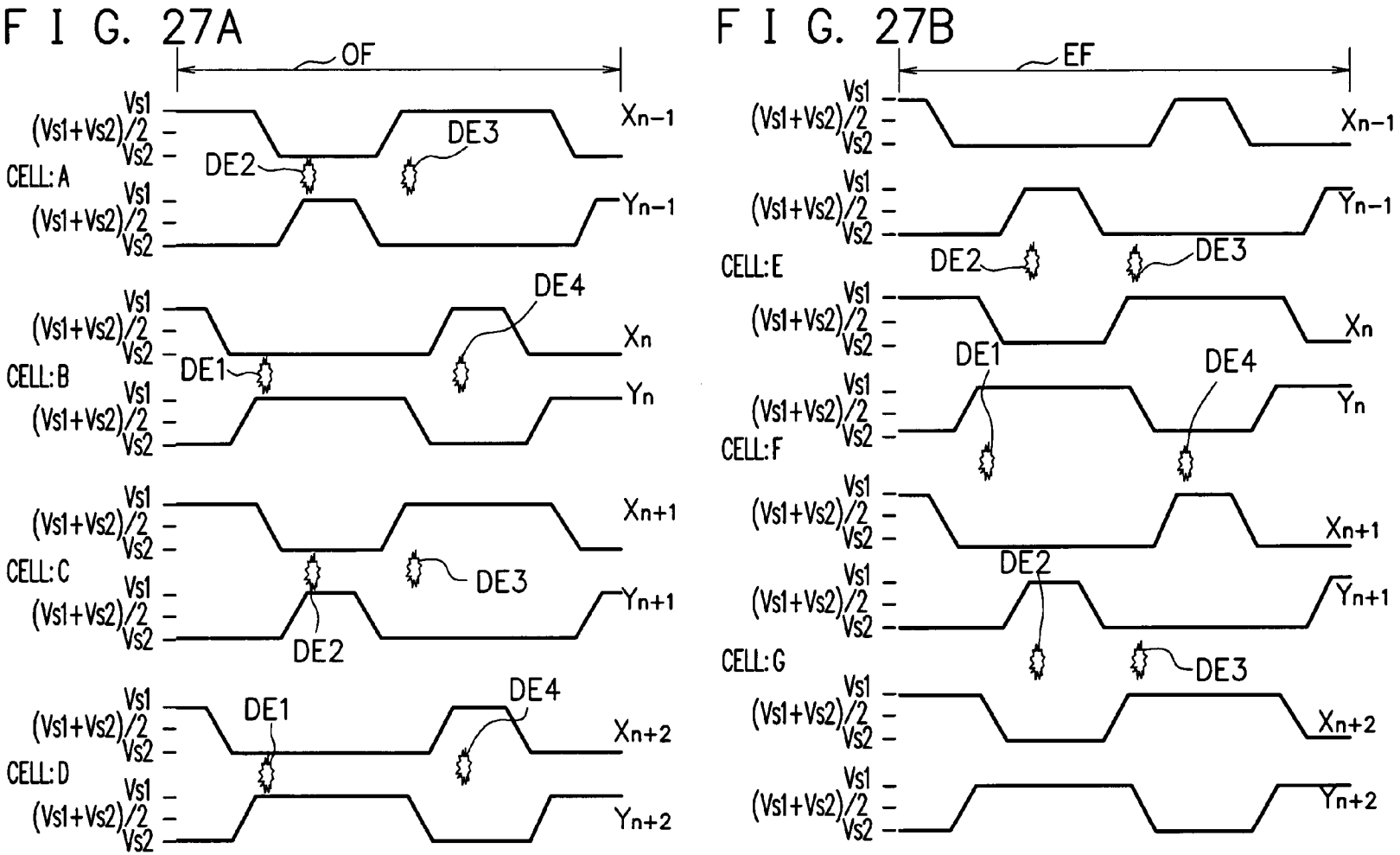
FIGS. 27A and 27B are timing charts each showing a driving method during a sustain period of an ALIS method plasma display according to a fourteenth embodiment of the present invention.

FIGS. 27A and 27B are timing charts each showing a driving method during the sustain period Ts of an ALIS method plasma display according to a fourteenth embodiment of the present invention, in which the seventh embodiment (FIG. 17) is applied to the ALIS method. FIG. 27A shows the voltage waveforms of sustain discharges in an odd field OF, and FIG. 27B shows the voltage waveforms of sustain discharges in an even field EF. The voltage waveforms in the odd field OF are the same as those in the seventh embodiment (FIG. 17). In the even field EF, in comparison with the odd field OF, the voltage to the sustain electrodes Xn−1, Xn+1, and the like on the odd-numbered rows is exchanged with the voltage to the sustain electrodes Xn, Xn+2, and the like on the even-numbered rows.

FIFTEENTH EMBODIMENT

Figure 28A:
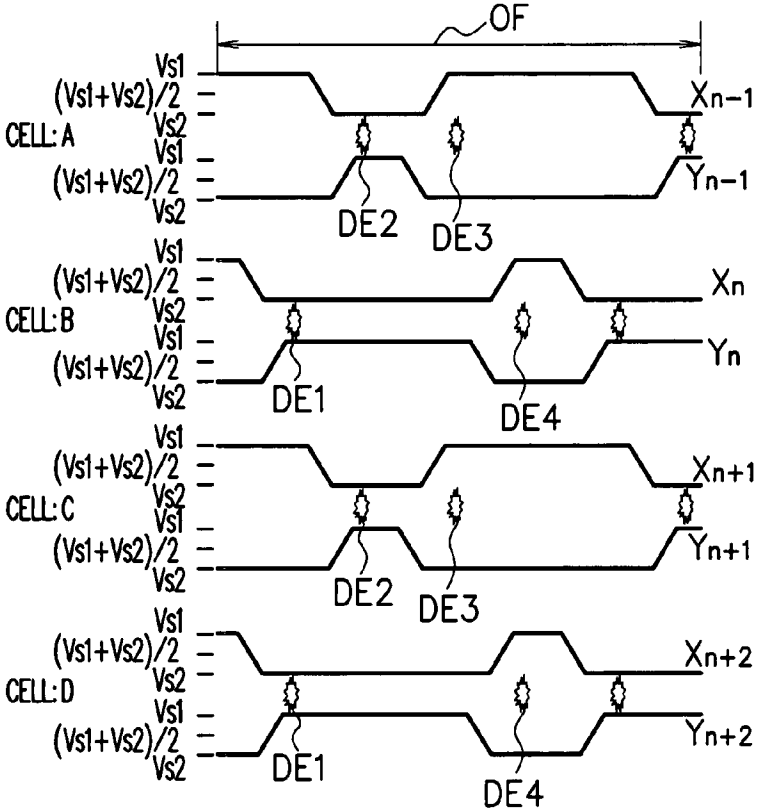
FIGS. 28A and 28B are timing charts each showing a driving method during a sustain period of an ALIS method plasma display according to a fifteenth embodiment of the present invention.
Figure 28B:
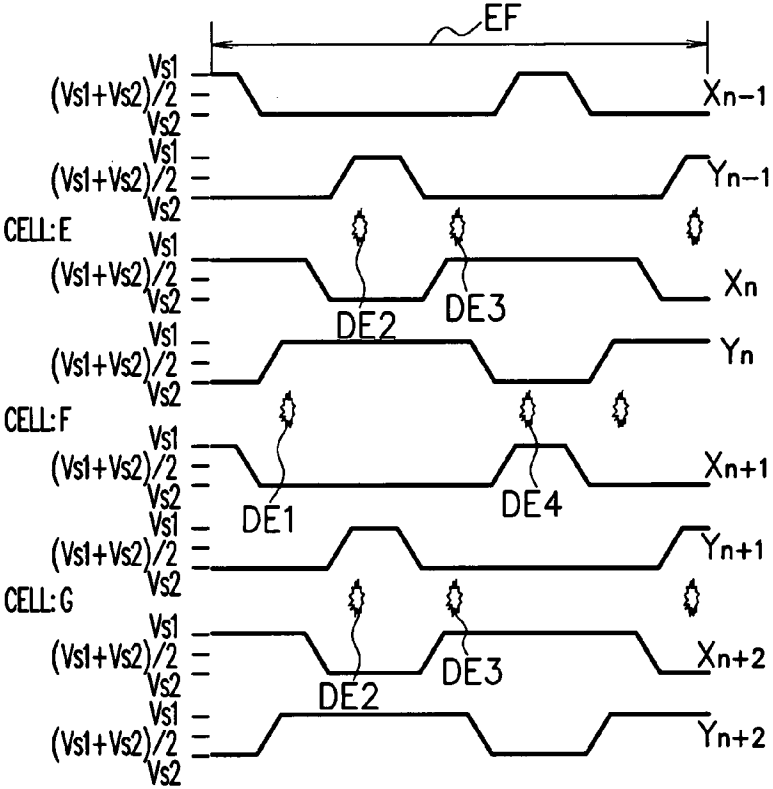

FIGS. 28A and 28B are timing charts each showing a driving method during the sustain period Ts of an ALIS method plasma display according to a fifteenth embodiment of the present invention, in which the eighth embodiment (FIG. 18) is applied to the ALIS method. FIG. 28A shows the voltage waveforms of sustain discharges in an odd field OF, and FIG. 28B shows the voltage waveforms of sustain discharges in an even field EF. The voltage waveforms in the odd field OF are the same as those in the eighth embodiment (FIG. 18). In the even field EF, in comparison with the odd field OF, the voltage to the sustain electrodes Xn−1, Xn+1, and the like on the odd-numbered rows is exchanged with the voltage to the sustain electrodes Xn, Xn+2, and the like on the even-numbered rows.

SIXTEENTH EMBODIMENT

Figure 29A:
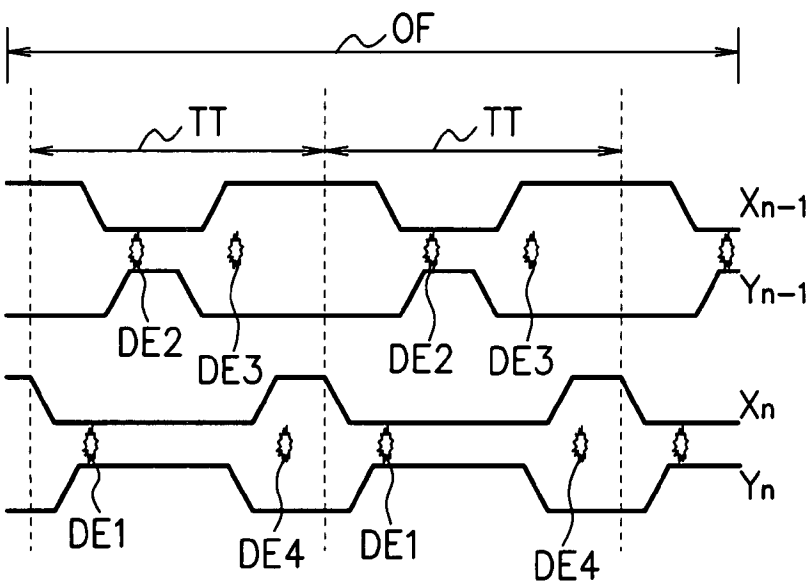
FIGS. 29A and 29B are timing charts each showing a driving method during a sustain period of an ALIS method plasma display according to a sixteenth embodiment of the present invention.
Figure 29B:
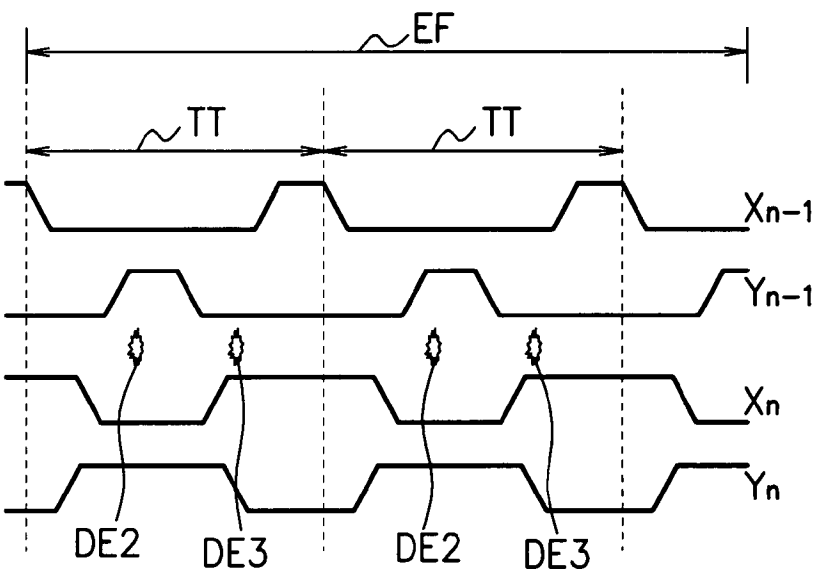

FIGS. 29A and 29B are timing charts each showing a driving method during the sustain period Ts of an ALIS method plasma display according to a sixteenth embodiment of the present invention, in which the ninth embodiment (FIG. 21) is applied to the ALIS method. FIG. 29A shows the voltage waveforms of sustain discharges in an odd field OF, and FIG. 29B shows the voltage waveforms of sustain discharges in an even field EF. The voltage waveforms in the odd field OF are the same as those in the ninth embodiment (FIG. 21). In the even field EF, in comparison with the odd field OF, the voltage to the sustain electrodes Xn−1 and the like on the odd-numbered rows is exchanged with the voltage to the sustain electrodes Xn and the like on the even-numbered rows.

SEVENTEENTH EMBODIMENT

Figure 30A:
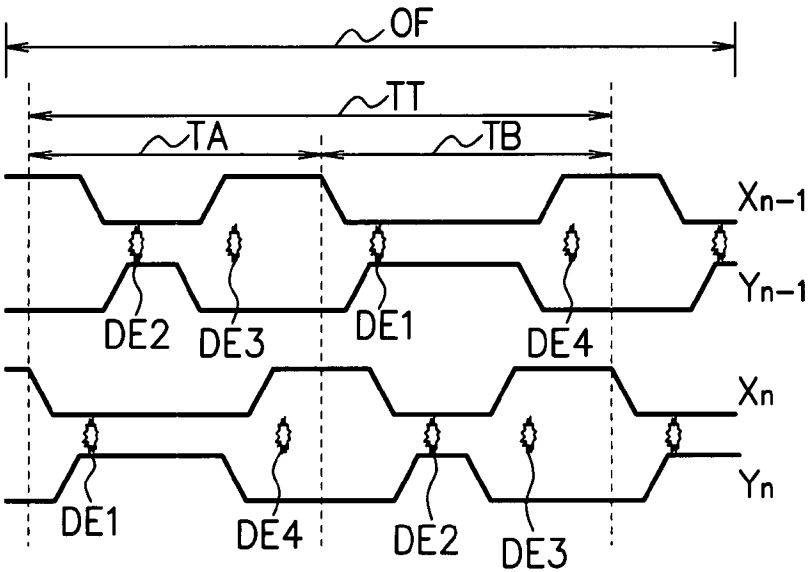
FIGS. 30A and 30B are timing charts each showing a driving method during a sustain period of an ALIS method plasma display according to a seventeenth embodiment of the present invention.
Figure 30B:
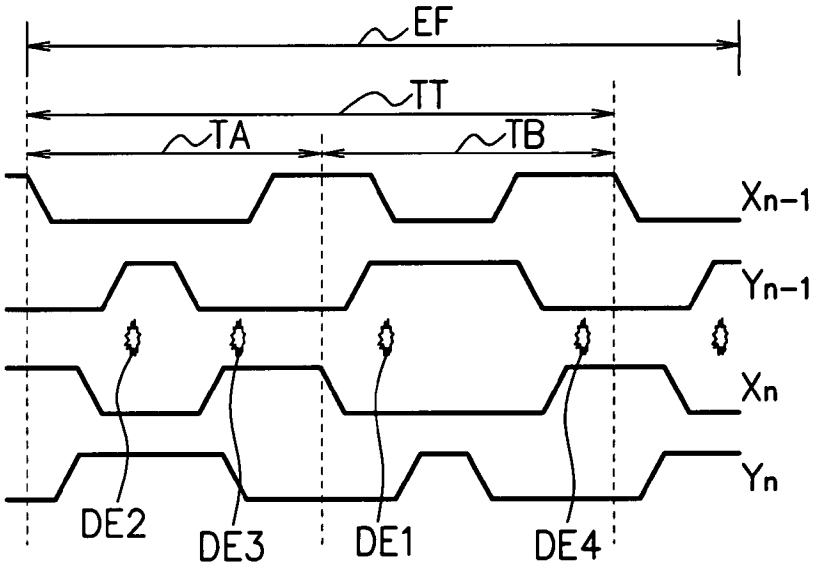

FIGS. 30A and 30B are timing charts each showing a driving method during the sustain period Ts of an ALIS method plasma display according to a seventeenth embodiment of the present invention, in which the tenth embodiment (FIG. 22) is applied to the ALIS method. FIG. 30A shows the voltage waveforms of sustain discharges in an odd field OF, and FIG. 30B shows the voltage waveforms of sustain discharges in an even field EF. The voltage waveforms in the odd field OF are the same as those in the tenth embodiment (FIG. 22). In the even field EF, in comparison with the odd field OF, the voltage to the sustain electrodes Xn−1 and the like on the odd-numbered rows is exchanged with the voltage to the sustain electrodes Xn and the like on the even-numbered rows.

EIGHTEENTH EMBODIMENT

Figure 31A:
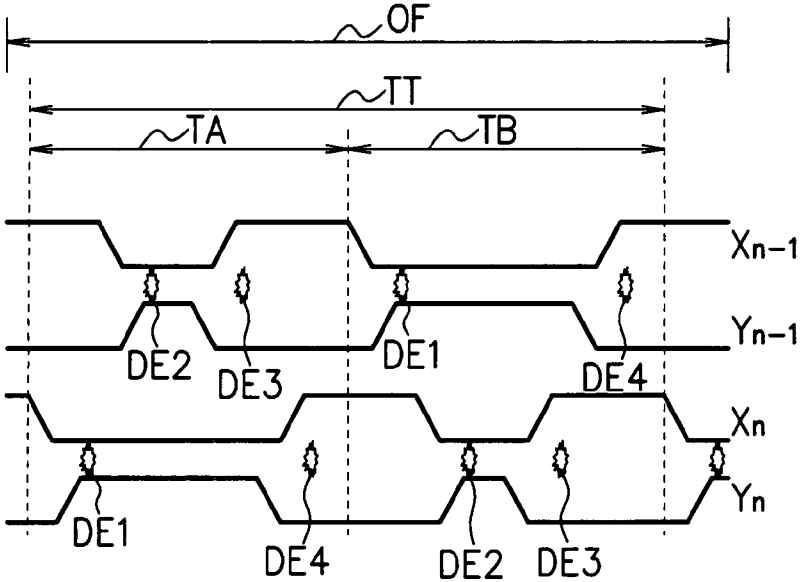
FIGS. 31A and 31B are timing charts each showing a driving method during a sustain period of an ALIS method plasma display according to an eighteenth embodiment of the present invention.
Figure 31B:
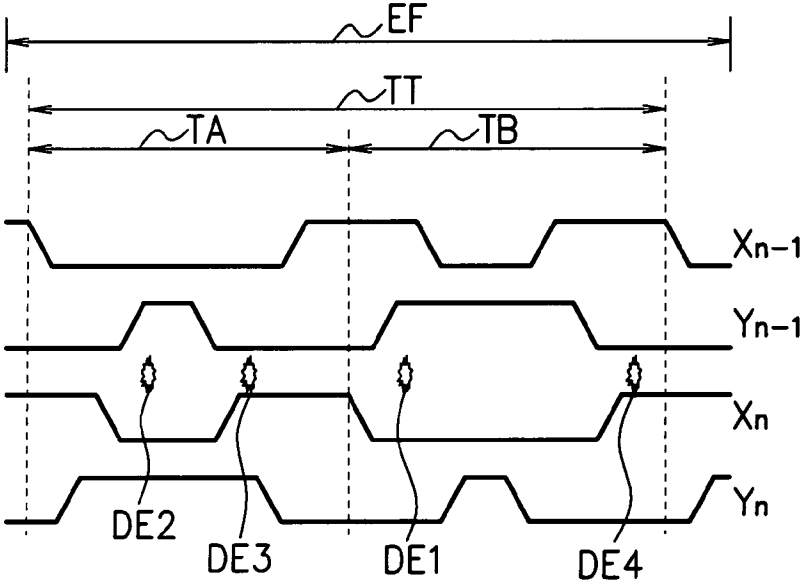

FIGS. 31A and 31B are timing charts each showing a driving method during the sustain period Ts of an ALIS method plasma display according to an eighteenth embodiment of the present invention, in which the eleventh embodiment (FIG. 23) is applied to the ALIS method. FIG. 31A shows the voltage waveforms of sustain discharges in an odd field OF, and FIG. 31B shows the voltage waveforms of sustain discharges in an even field EF. The voltage waveforms in the odd field OF are the same as those in the eleventh embodiment (FIG. 23). In the even field EF, in comparison with the odd field OF, the voltage to the sustain electrodes Xn−1 and the like on the odd-numbered rows is exchanged with the voltage to the sustain electrodes Xn and the like on the even-numbered rows.

In the ALIS method, as shown in FIG. 25, the intervals of the first slits and second slits are the same and thus likely to cause error display. According to the thirteenth to eighteenth embodiments, even by the ALIS method, each display cell can perform stable sustain discharges without receiving adverse effects from adjacent electrodes.

Note that while the description has been made, in the thirteenth to eighteenth embodiments, on the case in which the voltage to the sustain electrodes on the odd-numbered rows is exchanged with the voltage to the sustain electrodes on the even-numbered rows between the odd field and the even field, the voltages to the scan electrodes may be exchanged with each other in place of the sustain electrodes.

NINETEENTH EMBODIMENT

Figure 32A:
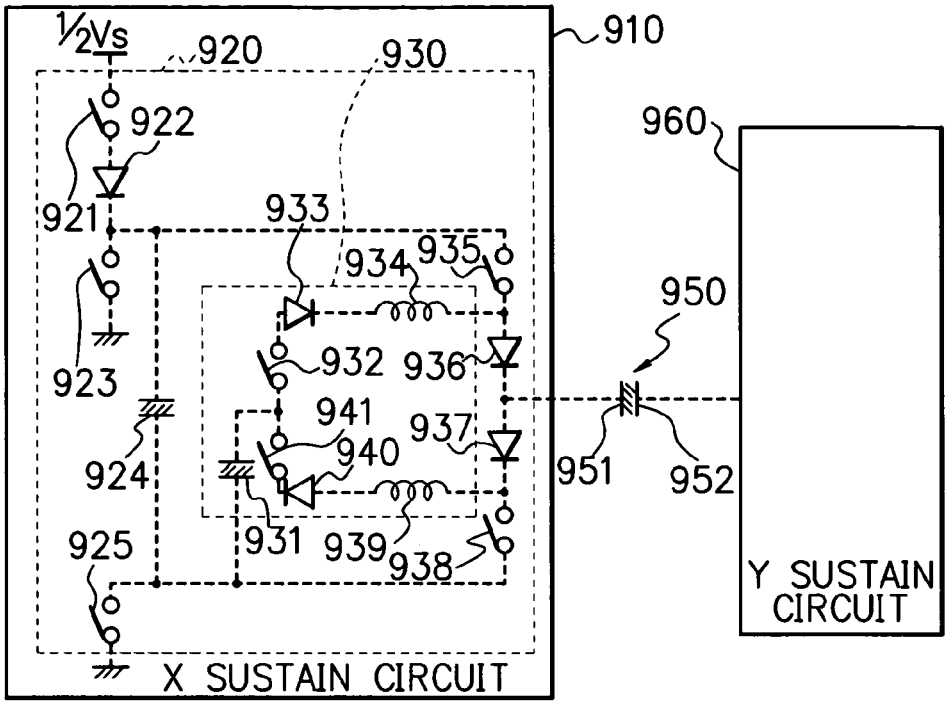
FIGS. 32A and 32B are circuit diagrams of sustain electrode sustain circuits and scan electrode sustain circuits according to a nineteenth and a twentieth embodiment of the present invention.

FIG. 32A shows the configuration of a sustain electrode sustain circuit 910 and a scan electrode sustain circuit 960 according to a nineteenth embodiment of the present invention. The sustain electrode sustain circuit 910, corresponding to the sustain electrode sustain circuits 103*a* and 103*b* in FIG. 1, is connected to a sustain electrode 951. The scan electrode sustain circuit 960, corresponding to the scan electrode sustain circuits 104*a* and 104*b* in FIG. 1, is connected to a scan electrode 952. A capacitor 950 is constituted of the sustain electrode 951, the scan electrode 952, and a dielectric therebetween. The sustain electrode sustain circuit 910 has a TERES (Technology of Reciprocal Sustainer) circuit 920 and a power recovery circuit 930.

First, the description will be made on the configuration of the TERES circuit 920. A diode 922 has an anode connected to a first potential (for example, Vs1=Vs/2[V]) via a switch 921 and a cathode connected to a second potential (for example, the ground) lower than the first potential via a switch 923. A capacitor 924 has one end connected to the cathode of the diode 922 and the other end connected to the second potential via a switch 925. A diode 936 has an anode connected to the cathode of the diode 922 via a switch 935 and a cathode connected to the sustain electrode 951. A diode 937 has an anode connected to the sustain electrode 951 and a cathode connected to the aforementioned other end of the capacitor 924 via a switch 938.

Figure 33A:
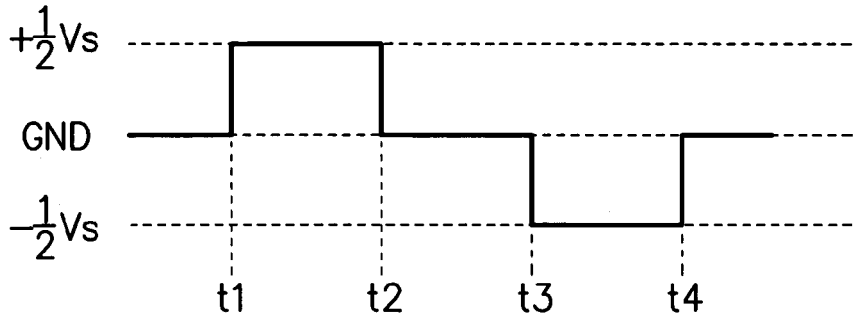
FIGS. 33A to 33C are diagrams showing voltage waveforms of sustain discharges.

Next, the description will be made on the operation of the TERES circuit 920 without the power recovery circuit 930. The following description is made on the case in which a sustain discharge voltage shown in FIG. 33A is applied to the sustain electrode Xn. The above-described anode voltage Vs1 is, for example, Vs/2[V], and the cathode voltage Vs2 is, for example, −Vs/2[V]. At time t1, the switches 921, 925, and 935 are closed, and the switches 923 and 938 are opened. Then, the potential of Vs/2 is applied to the sustain electrode 951 via the switches 921 and 935. Besides, the electrode on the upper side (hereafter referred to as the upper end) in the drawing is connected to Vs/2, and the electrode on the lower side (hereafter referred to as the lower end) in the drawing is connected to the ground so that the capacitor 924 is charged. In this event, the charges on the capacitor 924 are discharged via the switch 935 and the diode 936 to the capacitor 950.

Subsequently, at time t2, the switches 925 and 938 are closed, and the switches 923 and 935 are opened. Then, the ground potential is applied to the sustain electrode 951 via the switches 925 and 938.

Subsequently, at time t3, the switches 923 and 938 are closed, and the switches 921, 925, and 935 are opened. Then, the capacitor 924 has the upper end at the ground and the lower end at −Vs/2. The cathode potential of −Vs/2 is applied to the sustain electrode 951 via the switch 938.

Subsequently, at time t4, the switches 923 and 935 are closed, and the switches 921, 925, and 938 are opened. Then, the ground potential is applied to the sustain electrode 951 via the switches 923 and 935.

As described above, the use of the TERES circuit 920 enables generation of the anode potential Vs1, the cathode potential Vs2, and an intermediate potential (Vs1+Vs2)/2 with a simple circuit configuration.

Next, the description will be made on the configuration of the power recovery circuit 930. A capacitor 931 has a lower end connected to the lower end of the capacitor 924. A diode 933 has an anode connected to an upper end of the capacitor 931 via a switch 932 and a cathode connected to the anode of the diode 936 via a coil 934. A diode 940 has an anode connected to the cathode of the diode 937 via a coil 939 and a cathode connected to the upper end of the capacitor 931 via a switch 941.

Figure 33B:
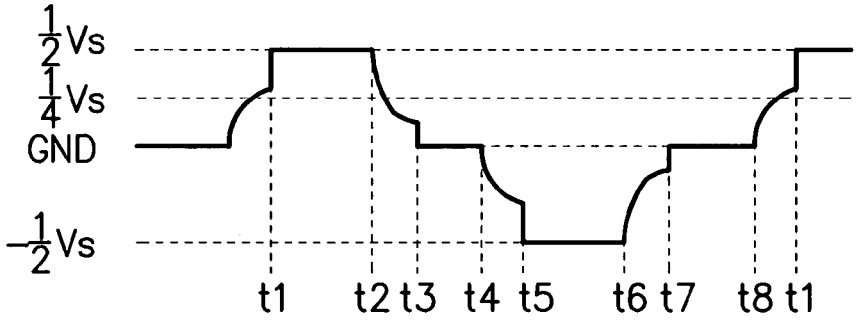

Next, the description will be made on the operation of the power recovery circuit 930 with reference to FIG. 33B. First, at time t1, the switches 921, 925, and 935 are closed, and the other switches are opened. Note that while the switch 935 is closed here, the switch 932 is closed before time t1 and thus may be kept closed also from time t1 to time t2. Then, the potential of Vs/2 is applied to the sustain electrode 951 from the power supply and the capacitor 924 via the switches 921 and 935. The capacitor 924 is charged to the potential of Vs/2 from the power supply as well as discharges it to the capacitor 950 of the sustain electrode 951.

Subsequently, at time t2, the switch 935 is opened, and the switch 941 is closed. Then, the charges on the sustain electrode 951 are supplied to the upper end of the capacitor 931 via the coil 939. The lower end of the capacitor 931 is connected to the second potential (GND) via the switch 925. Due to an LC resonance of the coil 939 and the capacitor (panel capacitance) 950, the capacitor 931 is charged so that power is recovered. This lowers the potential of the sustain electrode 951 to near Vs/4. Further, the diodes 940 and 937 remove the resonance, and the coil 939 can stabilize the potential of the sustain electrode 951 at near Vs/4.

Subsequently, at time t3, the switch 938 is closed. Then, the potential of the sustain electrode 951 becomes the ground.

Subsequently, at time t4, the switches 941 and 938 are opened, thereafter the switches 921 and 925 are opened, and the switch 923 is closed. Subsequently, the switch 941 is closed. The sustain electrode 951 is connected to the ground via the diode 937, the coil 939, the diode 940, the switch 941, the capacitor 931, the capacitor 924, and the switch 923. Then, due to the LC resonance, the potential of the sustain electrode 951 lowers to near −Vs/4.

Subsequently, at time t5, the switch 938 is closed. The potential of the sustain electrode 951 lowers to −Vs/2.

Subsequently, at time t6, the switches 941 and 938 are opened, and the switch 932 is closed. Due to the LC resonance, the potential of the sustain electrode 951 lowers to near −Vs/4.

Subsequently, at time t7, when the switch 935 is closed, the potential rises to the ground. Thereafter, the switches 932 and 935 are opened, the switch 923 is opened, the switches 921 and 925 are closed, and the switch 938 is closed.

Subsequently, at time t8, the switch 938 is opened, and the switch 932 is closed. The potential of the sustain electrode 951 rises to near Vs/4. Thereafter, a cycle of the above-described time t1 to time t8 can be repeated.

The configuration of the scan electrode sustain circuit 960 is similar to that of the sustain electrode sustain circuit 910. The use of the power recovery circuit 930 can improve the energy efficiency to reduce the power consumption.

TWENTIETH EMBODIMENT

Figure 32B:
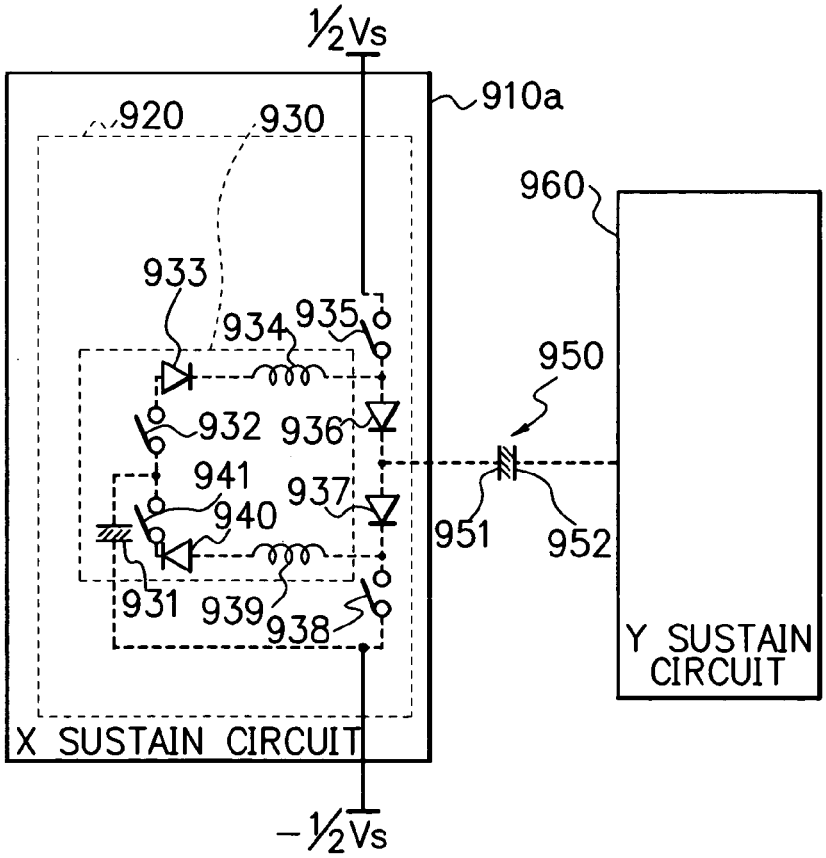

FIG. 32B shows the configuration of a sustain electrode sustain circuit 910*a* according to a twentieth embodiment of the present invention. The description will be made on the point of the sustain electrode sustain circuit 910*a* differing from the circuit 910 in FIG. 32A. The sustain electrode sustain circuit 910*a* is made by omitting the switches 921, 923, and 925, the diode 922, and the capacitor 924 in FIG. 32A, connecting the switch 935 between the anode of the diode 936 and the power supply of Vs/2, and connecting the switch 938 between the cathode of the diode 937 and the power supply of −Vs/2.

Figure 33C:
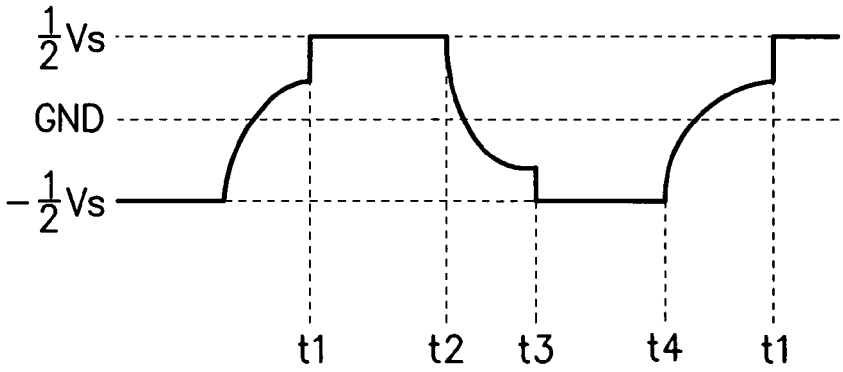
Figure 34:
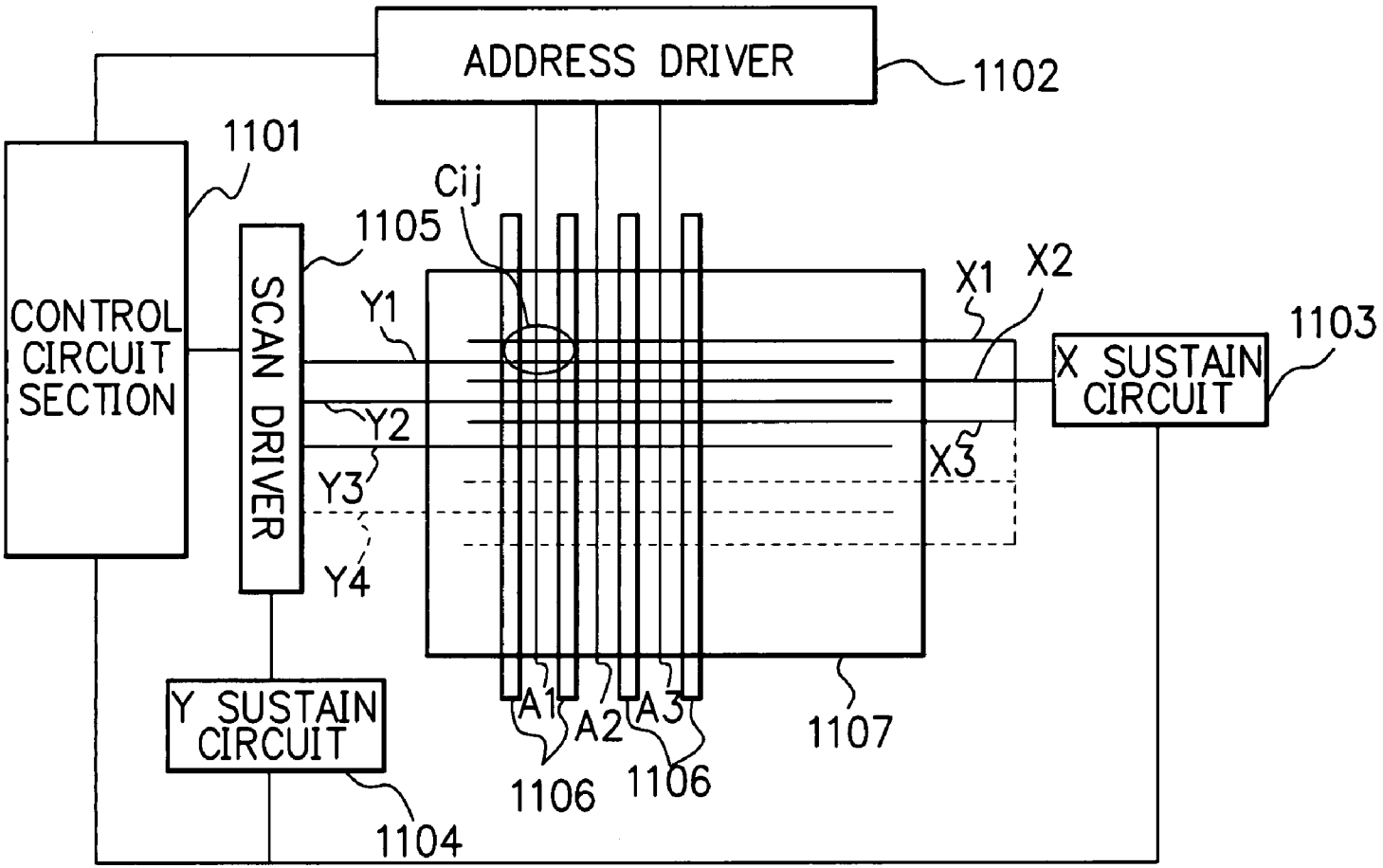
FIG. 34 is a diagram showing the configuration of a plasma display device.

Next, the description will be made on the operation of the sustain electrode sustain circuit 910*a* with reference to FIG. 33C. First, at time t1, the switch 935 is closed, and the other switches are opened. Note that while the switch 935 is closed here, the switch 932 is closed before time t1 and thus may be kept closed also from time t1 to time t2. The sustain electrode 951 is connected to the power supply of Vs/2 and sustains the potential of Vs/2.

Subsequently, at time t2, the switch 935 is opened, and the switch 941 is closed. The sustain electrode 951 is connected to the capacitor 931 via the switch 941, and lowers in potential to near −Vs/4 due to an LC resonance.

Subsequently, at time t3, the switch 938 is closed. The sustain electrode 951 is connected to the power supply of −Vs/2 and sustains the potential of −Vs/2.

Subsequently, at time t4, the switches 941 and 938 are opened, and the switch 932 is closed. The sustain electrode 951 is connected to the capacitor 931 via the switch 932 and lowers in potential to near Vs/4 due to the LC resonance. Thereafter, a cycle of the above-described time t1 to time t4 can be repeated.

As described above, in the high image quality mode, sustain discharge pulses to all adjacent electrodes rise or fall at different timings as shown in FIG. 2 and so on. During performance of the sustain discharges between first and second display electrodes, the applied voltage to third electrodes adjacent to the first and second electrodes performing the sustain discharges and the polarity of wall charges formed on the third electrodes are controlled, thereby preventing the charges on the first and second electrodes from diffusing to the adjacent electrodes to eliminate error display. With an increase in definition of plasma displays, the distance between electrodes becomes shorter and likely to cause interference between adjacent display cells. The interference between them is suppressed, whereby stable operation can be realized by increased margin of operating voltage.

Besides, in the low power mode and the high luminance mode, sustain discharge pulses to predetermined adjacent electrodes rise or fall in the same direction at the same time as shown in FIG. 3. In the low power mode, the plasma display device can perform a low power display when driven with the same number of sustain discharge pulses as that in the high image quality mode. In the high luminance mode, the plasma display device can perform a high luminance display when driven with the same power consumption as that in the high image quality mode, because the number of sustain discharge pulses increases.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

As has been described, it is possible to prevent changes on the X electrode and the Y electrode for performing a sustain discharge from diffusing to adjacent electrodes in the second sustain drive mode, thus making it possible to eliminate an error display and perform a high image quality display. In the first sustain drive mode, the plasma display device can perform a low lower display when driven with the same number of discharge pulses as that in the second sustain drive mode, and can perform a high luminance display when driven with the same power consumption as that in the second sustain drive mode because the number of sustain discharge pulses increases.

What is claimed is:

1. A plasma display device, comprising:

a plurality of X electrodes;

a plurality of Y electrodes arranged adjacent to said plurality of X electrodes for causing sustain discharges between said plurality of X electrodes and said plurality of Y electrodes;

an X electrode drive circuit for applying a sustain discharge voltage to said plurality of X electrodes; and a Y electrode drive circuit for applying a sustain discharge voltage to said plurality of Y electrodes, wherein said X electrode drive circuit and said Y electrode drive circuit have:

a first sustain drive mode in which discharge pulses to predetermined adjacent electrodes rise or fall in the same direction at the same time; and a second sustain drive mode in which discharge pulses to all adjacent electrodes rise or fall at different timings.

2. The plasma display device according to claim 1, wherein said X electrode drive circuit has:

an odd-numbered X electrode drive circuit for applying a sustain discharge voltage to odd-numbered electrodes of said plurality of X electrodes; and an even-numbered X electrode drive circuit for applying a sustain discharge voltage to even-numbered electrodes of said plurality of X electrodes, and wherein said Y electrode drive circuit has:

an odd-numbered Y electrode drive circuit for applying a sustain discharge voltage to odd-numbered electrodes of said plurality of Y electrodes; and an even-numbered Y electrode drive circuit for applying a sustain discharge voltage to even-numbered electrodes of said plurality of Y electrodes.

3. The plasma display device according to claim 2, wherein, in said first sustain drive mode, a discharge pulse outputted from said even-numbered Y electrode drive circuit rises concurrently with rising of a discharge pulse outputted from said odd-numbered X electrode drive circuit, and thereafter a discharge pulse outputted from said odd-numbered Y electrode drive circuit rises concurrently with rising of a discharge pulse outputted from said even-numbered X electrode drive circuit.

4. The plasma display device according to claim 2, wherein, in said first sustain drive mode, a discharge pulse outputted from said even-numbered Y electrode drive circuit falls concurrently with falling of a discharge pulse outputted from said odd-numbered X electrode drive circuit, and thereafter when a discharge pulse outputted from said odd-numbered Y electrode drive circuit falls concurrently with falling of a discharge pulse outputted from said even-numbered X electrode drive circuit.

5. The plasma display device according to claim 2, wherein each of said plurality of X electrodes and said plurality of Y electrodes capable of a sustain discharge with respect to an adjacent electrode only on one side thereof.

6. The plasma display device according to claim 3, wherein each of said plurality of X electrodes and said plurality of Y electrodes capable of a sustain discharge with respect to an adjacent electrode only on one side thereof.

7. The plasma display device according to claim 4, wherein each of said plurality of X electrodes and said plurality of Y electrodes capable of a sustain discharge with respect to an adjacent electrode only on one side thereof.

8. The plasma display device according to claim 2, wherein each of said plurality of X electrodes and said plurality of Y electrodes capable of sustain discharges with respect to adjacent electrodes on both sides thereof.

9. The plasma display device according to claim 3, wherein each of said plurality of X electrodes and said plurality of Y electrodes capable of sustain discharges with respect to adjacent electrodes on both sides thereof.

10. The plasma display device according to claim 4, wherein each of said plurality of X electrodes and said plurality of Y electrodes capable of sustain discharges with respect to adjacent electrodes on both sides thereof.

11. The plasma display device according to claim 1, wherein each of said plurality of X electrodes and said plurality of Y electrodes capable of a sustain discharge with respect to an adjacent electrode only on one side thereof.

12. The plasma display device according to claim 1, wherein each of said plurality of X electrodes and said plurality of Y electrodes capable of sustain discharges with respect to adjacent electrodes on both sides thereof.

13. The plasma display device according to claim 1, wherein said X electrode drive circuit and said Y electrode drive circuit, in said second sustain drive mode, generate sustain discharge voltages such that when a display cell including adjacent first electrode and second electrode of said plurality of X electrodes and said plurality of Y electrodes is selected to light up, and a first voltage Vs1 is applied to said first electrode and a second voltage Vs2 is applied to said second electrode to cause a sustain discharge between said first and second electrodes, an applied voltage Vc to a third electrode adjacent to said first electrode opposite to said second electrode falls within a range $$Vs2 \leqq Vc < Vs1, \text{ and}$$

in this case, when a display cell including said third electrode is selected to light up, the polarity of a wall charge formed on said third electrode becomes positive.

14. The plasma display device according to claim 1, wherein said X electrode drive circuit and said Y electrode drive circuit, in said second sustain drive mode, generate sustain discharge voltages such that when a display cell including adjacent first electrode and second electrode of said plurality of X electrodes and said plurality of Y electrodes is selected to light up, and a first voltage Vs1 is applied to said first electrode and a second voltage Vs2 is applied to said second electrode to cause a sustain discharge between said first and second electrodes, an applied voltage Vd to a third electrode adjacent to said second electrode opposite to said first electrode falls within a range $$Vs2 \leqq Vd < Vs1, \text{ and}$$

in this case, when a display cell including said third electrode is selected to light up, the polarity of a wall charge formed on said third electrode becomes positive.

15. The plasma display device according to claim 1, wherein said X electrode drive circuit and said Y electrode drive circuit, in said second sustain drive mode, generate sustain discharge voltages such that when a display cell including adjacent first electrode and second electrode of said plurality of X electrodes and said plurality of Y electrodes is selected to light up, and a first voltage Vs1 is applied to said first electrode and a second voltage Vs2 is applied to said second electrode to cause a sustain discharge between said first and second electrodes, an applied voltage Vc to a third electrode adjacent to said first electrode opposite to said second electrode falls within a range $$Vs2 < Vc < Vs1, \text{ and}$$

in this case, when a display cell including said third electrode is selected to light up, the polarity of a wall charge formed on said third electrode becomes negative.

16. The plasma display device according to claim 1, wherein said X electrode drive circuit and said Y electrode drive circuit, in said second sustain drive mode, generate sustain discharge voltages such that when a display cell including adjacent first electrode and second electrode of said plurality of X electrodes and said plurality of Y electrodes is selected to light up, and a first voltage Vs1 is applied to said first electrode and a second voltage Vs2 is applied to said second electrode to cause a sustain discharge between said first and second electrodes, an applied voltage Vc to a third electrode adjacent to said first electrode opposite to said second electrode falls within a range Vc=Vs1 within first 500 ns and thereafter $$Vs2<Vc<Vs1, \text{ and}$$

in this case, when a display cell including said third electrode is selected to light up, the polarity of a wall charge formed on said third electrode becomes negative.

17. The plasma display device according to claim 1, wherein said X electrode drive circuit and said Y electrode drive circuit, in said second sustain drive mode, generate sustain discharge voltages such that when a display cell including adjacent first electrode and second electrode of said plurality of X electrodes and said plurality of Y electrodes is selected to light up, and a first voltage Vs1 is applied to said first electrode and a second voltage Vs2 is applied to said second electrode to cause a sustain discharge between said first and second electrodes, an applied voltage Vd to a third electrode adjacent to said second electrode opposite to said first electrode falls within a range $$Vs2 \leqq Vd \leqq Vs1, \text{ and}$$

in this case, when a display cell including said third electrode is selected to light up, the polarity of a wall charge formed on said third electrode becomes negative.

18. The plasma display device according to claim 1, wherein said plurality of X electrodes and said plurality of Y electrodes include a first to a sixth electrode adjacent in order therein, and wherein said X electrode drive circuit and said Y electrode drive circuit, in said second sustain drive mode, generate sustain discharge voltages such that when a second voltage Vs2 is applied to said third electrode and a first voltage Vs1 is applied to said fourth electrode to cause a sustain discharge between said third and fourth electrodes, an applied voltage V2 to said second electrode falls within a range Vs2≦V2<Vs1, and, in this case, when a display cell including said first and second electrodes is selected to light up, the polarity of a wall charge formed on said second electrode becomes positive, and an applied voltage V5 to said fifth electrode falls within a range Vs2<V5<Vs1, and, in this case, when a display cell including said fifth and sixth electrodes is selected to light up, the polarity of a wall charge formed on said fifth electrode becomes negative, subsequently, when the second voltage Vs2 is applied to said first electrode, and the first voltage Vs1 is applied to said second electrode to cause a sustain discharge between said first and second electrodes, an applied voltage V3 to said third electrode falls within a range Vs2≦V3<Vs1, and when the second voltage Vs2 is applied to said fifth electrode, and the first voltage Vs1 is applied to said sixth electrode to cause a sustain discharge between said fifth and sixth electrodes, an applied voltage V4 to said fourth electrode falls within a range Vs2≦V4≦Vs1, subsequently, when the first voltage Vs1 is applied to said first electrode, and the second voltage Vs2 is applied to said second electrode to cause a sustain discharge between said first and second electrodes, the applied voltage V3 to said third electrode falls within a range Vs2≦V3<Vs1, and when the first voltage Vs1 is applied to said fifth electrode, and the second voltage Vs2 is applied to said sixth electrode to cause a sustain discharge between said fifth and sixth electrodes, the applied voltage V4 to said fourth electrode falls within a range Vs2<V4<Vs1, and subsequently, when the first voltage Vs1 is applied to said third electrode, and the second voltage Vs2 is applied to said fourth electrode to cause a sustain discharge between said third and fourth electrodes, the applied voltage V2 to said second electrode falls within a range Vs2≦V2<Vs1, and the applied voltage V5 to said fifth electrode falls within a range Vs2≦V5≦Vs1.

19. The plasma display device according to claim 1, wherein said plurality of X electrodes and said plurality of Y electrodes include a first to a sixth electrode adjacent in order therein, and wherein said X electrode drive circuit and said Y electrode drive circuit, in said second sustain drive mode, generate sustain discharge voltages such that when a second voltage Vs2 is applied to said third electrode and a first voltage Vs1 is applied to said fourth electrode to cause a sustain discharge between said third and fourth electrodes, an applied voltage V2 to said second electrode falls within a range Vs2≦V2<Vs1, and, in this case, when a display cell including said first and second electrodes is selected to light up, the polarity of a wall charge formed on said second electrode becomes positive, and an applied voltage V5 to said fifth electrode falls within a range V5=Vs1 within first 500 ns and thereafter Vs2<V5<Vs1, and, in this case, when a display cell including said fifth and sixth electrodes is selected to light up, the polarity of a wall charge formed on said fifth electrode becomes negative, subsequently, when the second voltage Vs2 is applied to said first electrode, and the first voltage Vs1 is applied to said second electrode to cause a sustain discharge between said first and second electrodes, an applied voltage V3 to said third electrode falls within a range Vs2≦V3<Vs1, and when the second voltage Vs2 is applied to said fifth electrode, and the first voltage Vs1 is applied to said sixth electrode to cause a sustain discharge between said fifth and sixth electrodes, an applied voltage V4 to said fourth electrode falls within a range Vs2≦V4≦Vs1, subsequently, when the first voltage Vs1 is applied to said first electrode, and the second voltage Vs2 is applied to said second electrode to cause a sustain discharge between said first and second electrodes, the applied voltage V3 to said third electrode falls within a range Vs2≦V3<Vs1, and when the first voltage Vs1 is applied to said fifth electrode, and the second voltage Vs2 is applied to said sixth electrode to cause a sustain discharge between said fifth and sixth electrodes, the applied voltage V4 to said fourth electrode falls within a range V4=Vs1 within first 500 ns and thereafter Vs2<V4<Vs1, and subsequently, when the first voltage Vs1 is applied to said third electrode, and the second voltage Vs2 is applied to said fourth electrode to cause a sustain discharge between said third and fourth electrodes, the applied voltage V2 to said second electrode falls within a range Vs2≦V2<Vs1, and the applied voltage V5 to said fifth electrode falls within a range Vs2≦V5≦Vs1.

20. The plasma display device according to claim 1, wherein said X electrode drive circuit and said Y electrode drive circuit, in said second sustain drive mode, perform at different timings the sustain discharges of even-numbered electrode pairs and odd-numbered electrode pairs of said plurality of pairs of X electrodes and Y electrodes for performing sustain discharges.

21. The plasma display device according to claim 20, wherein said X electrode drive circuit and said Y electrode drive circuit, in said second sustain drive mode, perform the sustain discharge for light emission of one pair of said even-numbered electrode pair and said odd-numbered electrode pair among said plurality of pairs of X electrodes and Y electrodes for performing sustain discharges, and then perform the sustain discharge for light emission of another pair, and wherein the applied voltages to said one electrode pair are sustained from the start of the sustain discharge for light emission between said one electrode pair to the end of the sustain discharge for light emission between said other electrode pair.

22. The plasma display device according to claim 21, wherein said X electrode drive circuit and said Y electrode drive circuit, in said second sustain drive mode, when performing the sustain discharge for light emission between said one electrode pair, apply a first voltage Vs1 to one of electrodes constituting said one electrode pair, and apply a second voltage Vs2 to another electrode (Vs1>Vs2), and wherein an applied voltage Vc to an electrode, adjacent to said one electrode, of electrodes constituting said other electrode pair falls within a range Vs2<Vc<Vs1, and an applied voltage Vd to an electrode adjacent to said other electrode falls within a range Vs2≦Vd<Vs1.

23. The plasma display device according to claim 1, further comprising:

an ambient light detector for detecting ambient brightness, wherein said X electrode drive circuit and said Y electrode drive circuit change between the first sustain drive mode and the second sustain drive mode in accordance with the detected ambient light by said ambient light detector.

24. The plasma display device according to claim 23, wherein said X electrode drive circuit and said Y electrode drive circuit operate in the first sustain drive mode when the ambient brightness is high and operate in the second sustain drive mode when the ambient brightness is low.

25. The plasma display device according to claim 1, wherein said X electrode drive circuit and said Y electrode drive circuit change between the first sustain drive mode and the second sustain drive mode in accordance with an input video signal.

26. The plasma display device according to claim 25, wherein said X electrode drive circuit and said Y electrode drive circuit detect a resolution or a frequency component of a video based on the input video signal and change between the first sustain drive mode and the second sustain drive mode in accordance with the resolution or the frequency component.

27. The plasma display device according to claim 26, wherein said X electrode drive circuit and said Y electrode drive circuit detect the frequency component of a video based on the input video signal, and operate in the second sustain drive mode when a high frequency component is at a predetermined value or more and operate in the first sustain drive mode when the high frequency component is at a value less than the predetermined value.

28. The plasma display device according to claim 26, wherein said X electrode drive circuit and said Y electrode drive circuit detect the resolution of a video based on the input video signal, and operate in the first sustain drive mode for a low resolution and operate in the second sustain drive mode for a high resolution.

29. The plasma display device according to claim 1, further comprising:

a pulse number controller for detecting current or voltage to be supplied to said X electrode drive circuit and said Y electrode drive circuit and controlling the number of discharge pulses generated by said X electrode drive circuit and said Y electrode drive circuit so that the current or voltage is at a predetermined value or less.

30. The plasma display device according to claim 1, further comprising:

an ambient light detector for detecting ambient brightness; and a video signal detector for detecting an input video signal, wherein a change is made between the first sustain drive mode and the second sustain drive mode in accordance with the detected ambient brightness and/or the input video signal.

* * * * *

UNITED STATES PATENT AND TRADEMARK OFFICE

CERTIFICATE OF CORRECTION

PATENT NO. : 7,239,294 B2
APPLICATION NO. : 10/798369
DATED : July 3, 2007
INVENTOR(S) : Makoto Onozawa et al.

It is certified that error appears in the above-identified patent and that said Letters Patent is hereby corrected as shown below:

On the title page item (56), line 5, Column 2 (U.S. Patent Documents), insert --2002/0089472 7/2002 Tsai--.

On the title page item (56), line 1, Column 2 (Foreign Patent Documents), insert --EP 1041600 10/2000--.

Signed and Sealed this

Eighth Day of January, 2008

JON W. DUDAS
*Director of the United States Patent and Trademark Office*